US008092032B2

(12) United States Patent
Pearse

(10) Patent No.: US 8,092,032 B2
(45) Date of Patent: Jan. 10, 2012

(54) LED LIGHTING ARRAY ASSEMBLY

(75) Inventor: Michael R. Pearse, Burlington (CA)

(73) Assignee: King Luminaire Co., Inc., Jefferson, OH (US)

( * ) Notice: Subject to any disclaimer, the term of this patent is extended or adjusted under 35 U.S.C. 154(b) by 466 days.

(21) Appl. No.: 12/383,091

(22) Filed: Mar. 19, 2009

(65) Prior Publication Data

US 2009/0267519 A1 Oct. 29, 2009

Related U.S. Application Data

(63) Continuation-in-part of application No. 12/378,502, filed on Feb. 17, 2009, now abandoned.

(60) Provisional application No. 61/125,371, filed on Apr. 24, 2008.

(51) Int. Cl.
*F21V 21/00* (2006.01)

(52) U.S. Cl. ..... 362/11; 362/240

(58) Field of Classification Search ..... 362/800, 362/11, 12, 240, 237, 238, 239, 227, 362, 362/363, 365, 364; 315/51, 52, 76, 185 R, 315/193, 312, 313

See application file for complete search history.

(56) References Cited

U.S. PATENT DOCUMENTS

| | | | | |
|---|---|---|---|---|
| 3,145,934 | A | 8/1964 | Guggemos | |
| 3,705,300 | A | 12/1972 | Plemmons et al. | |
| 4,096,555 | A | 6/1978 | Lasker | |
| 4,231,080 | A | 10/1980 | Compton | |
| 4,261,028 | A | 4/1981 | Adam | |
| 4,969,074 | A | 11/1990 | Davis | |
| 6,250,774 | B1 | 6/2001 | Begemann | |
| 6,573,536 | B1 | 6/2003 | Dry | |
| 6,621,222 | B1 | 9/2003 | Hong | |
| 6,688,752 | B2 | 2/2004 | Moore | |
| 6,715,900 | B2 | 4/2004 | Zhang | |
| 6,815,724 | B2 | 11/2004 | Dry | |
| 6,831,303 | B2 | 12/2004 | Dry | |
| 6,942,361 | B1 | 9/2005 | Kishimura | |
| 6,991,351 | B1 | 1/2006 | Petrick | |
| 7,014,337 | B2 | 3/2006 | Chen | |
| 7,152,996 | B2 * | 12/2006 | Luk | 362/240 |
| 7,182,547 | B1 | 2/2007 | Leonhardt | |
| 7,242,028 | B2 | 7/2007 | Dry | |
| 7,267,459 | B2 * | 9/2007 | Matheson | 362/362 |
| 7,284,881 | B2 | 10/2007 | Kim | |
| 7,288,796 | B2 | 10/2007 | Dry | |
| 7,311,423 | B2 | 12/2007 | Frecska | |
| 7,325,998 | B2 | 2/2008 | Leonhardt | |

(Continued)

FOREIGN PATENT DOCUMENTS

WO WO 02/066889 A1 8/2002

*Primary Examiner* — David Hung Vu
(74) *Attorney, Agent, or Firm* — Robert R. Hussey

(57) ABSTRACT

A lighting array assembly has a plurality of support members facing different directions and on which emitters are mounted. Each support member has an emitter circuit thereon in operative association with at least one emitter and has a lighting center point. The emitters on each support member are positioned together around the lighting center point. The number of emitters mounted on each of the outer surfaces is determined by the light specified in each direction to meet the desired lighting distribution configuration in each direction. A method of configuring an emitter lighting array assembly includes selecting the desired lighting distribution configuration to achieve a desired lighting distribution.

18 Claims, 28 Drawing Sheets

U.S. PATENT DOCUMENTS

| | | | | |
|---|---|---|---|---|
| 7,387,403 | B2 | 6/2008 | Mighetto | |
| 7,738,235 | B2 * | 6/2010 | Gloisten et al. | 361/173 |
| 2003/0230765 | A1 | 12/2003 | Dry | |
| 2004/0000677 | A1 | 1/2004 | Dry | |
| 2004/0026721 | A1 | 2/2004 | Dry | |
| 2004/0114367 | A1 | 6/2004 | Li | |
| 2004/0141326 | A1 | 7/2004 | Dry | |
| 2004/0165387 | A1 | 8/2004 | Zhang | |
| 2005/0258439 | A1 | 11/2005 | Dry | |
| 2005/0258440 | A1 | 11/2005 | Dry | |
| 2005/0269581 | A1 | 12/2005 | Dry | |
| 2007/0195527 | A1 | 8/2007 | Russell | |
| 2007/0230183 | A1 | 10/2007 | Shuy | |
| 2007/0230184 | A1 | 10/2007 | Shuy | |
| 2008/0084694 | A1 | 4/2008 | Rose | |
| 2008/0130299 | A1 | 6/2008 | Dorogi | |

* cited by examiner

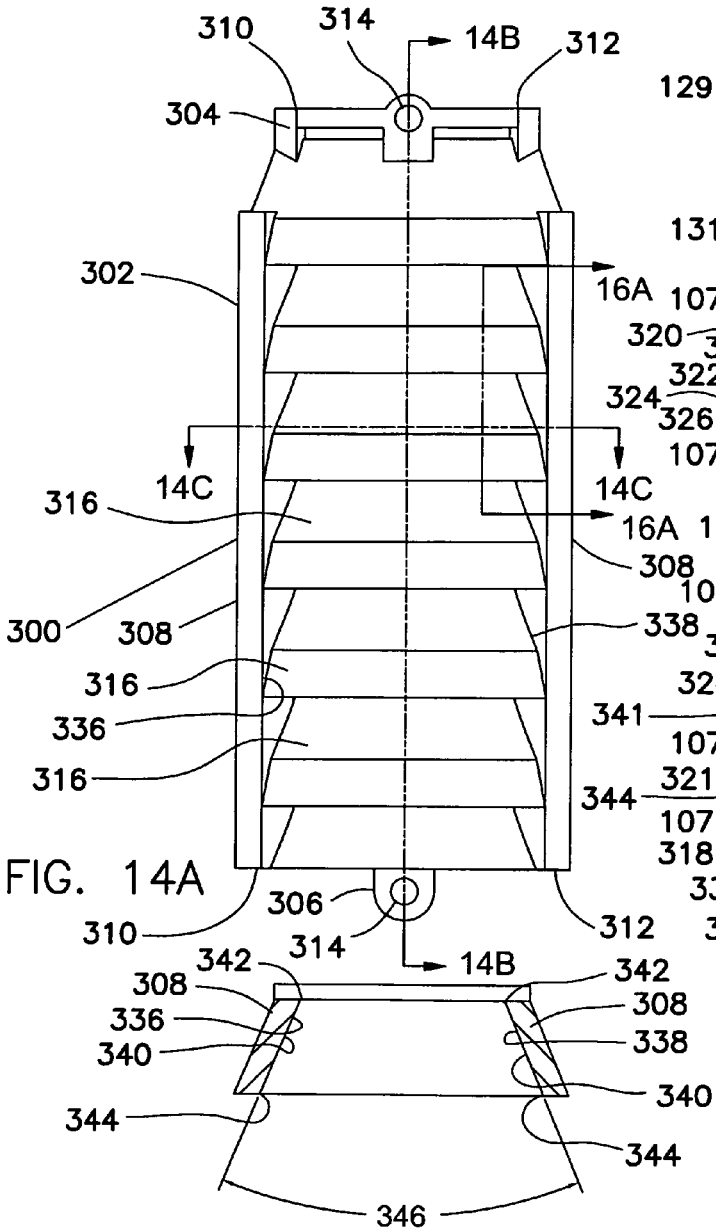
FIG. 14A
FIG. 14C
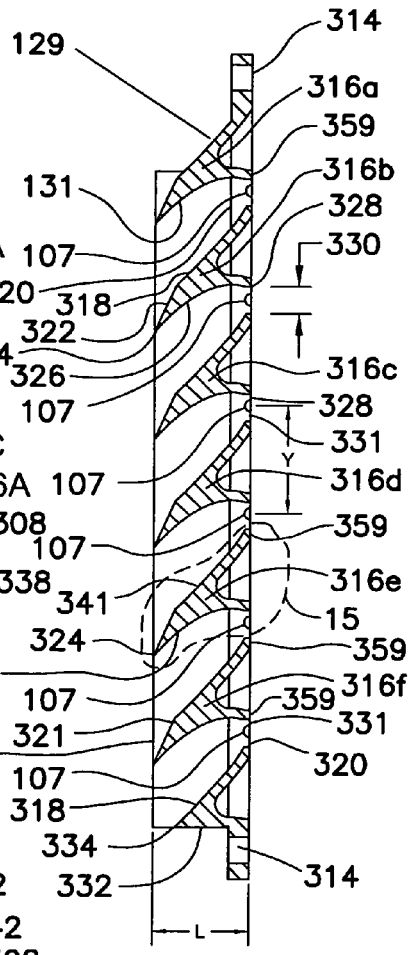
FIG. 14B

LED LIGHTING ARRAY ASSEMBLY

CROSS-REFERENCE TO RELATED APPLICATIONS

This application is a continuation-in-part of U.S. application Ser. No. 12/378,502 filed on Feb. 17, 2009, now abandoned which claims the benefit of U.S. Provisional Application No. 61/125,371 filed on Apr. 24, 2008 both of which are incorporated herein by reference.

TECHNICAL FIELD

This invention relates to a lighting fixture having light emitting diodes (LEDs or emitters) in which the direction and amount of light is configurable.

BACKGROUND

Lighting fixtures that utilize light emitting diodes as a light source are increasingly desirable, particularly in outdoor lighting environments. There is a need to control the direction and intensity of light output by such fixtures. For example, achieving the high optical performance required for roadway lighting demands reduction in glare to pedestrians and motorists and uplight pollution produced by the lighting fixture, while maximizing horizontal surface illumination and maintaining a smooth illumination distribution. There are different lighting configurations, for example in roadway and parking lot applications.

In roadway lighting, depending on the position of the lighting fixture and area of the roadway to be illuminated it is desirable to control the intensity of the light along the roadway with minimal light in other directions. In controlling the light along the roadway, it is desirable to provide a relatively uniform distribution of light along the roadway where desired.

In the field of parking lot lighting, is also desirable to control the direction and intensity of the light emitted by a lighting fixture. For example, if a lighting fixture is mounted to a building, any substantial light in a direction towards the building would be undesirable and inefficient. It is desirable that the light emitted by the fixture is most efficiently used in lighting the parking lot.

Conventional outdoor lighting fixtures are of a wide variety of constructions and designs. Single source lamps, such as incandescent bulbs, tungsten and halogen bulbs, are used. While being low in initial cost, it is difficult to control the direction of the light emitted therefrom and illuminate different directions with different sources of light. Generally, the single source lamps radiate light all the way around the lamp and also over the distance of the filament, for example, over the length of an elongated are tube. Another type of single source lamps are fluorescent bulbs which are more efficient but are bulky, fragile and require a starter circuit. Both of these sources of light are difficult to control since they generate light over a distance and radiate in all directions.

More recently, light emitting diodes (LEDs or emitters) have been used as a light source for outdoor lighting fixtures. An emitter is a relatively good source of bright and efficiently produced light, and emitter technology is advancing rapidly. It is recognized that emitters generate substantial heat that, if not dissipated, can shorten the life span of the emitter.

In various outdoor lighting applications it is desirable to light specific predetermined areas. For example, in street lighting it may be desirable to light specific areas, such as along the roadway, and not light or provide low level light to other areas. In other applications, such as in a parking lot where the outdoor lighting fixture is adjacent to a building, it is desirable to provide light to the parking lot but minimal, if any, light to the roof of the building. In other applications, light directed to other areas may not only be undesirable from an efficiency stand point but also be a nuisance depending on the position of the lighting fixture.

The directional light characteristics of LEDs are known. Bagemann U.S. Pat. No. 6,250,774 provides for rotation of LEDs to direct the light emitted from the LEDs. Bagemann shows street lighting fixture with lighting units, each having an LED and an associated reflector/refractor/diffractor. The LEDs may be rotated to direct the light in different directions. The LEDs are pivotally mounted on a housing and independently movable to direct the light emitted from the LED associated with the reflector/refractor in different directions. By rotating the LED lens unit, the direction of the light can be changed.

Frecska, U.S. Pat. No. 7,311,423, shows LEDs mounted on a support member which is rotatable to change the direction of light emitted from the LEDs. Diffuser lenses are provided for diffusing the light rays for indirect lighting. Kishimura, U.S. Pat. No. 6,942,361, also shows a street lighting fixture utilizing LEDs.

Dry in U.S. Pat. Nos. 6,815,724, 6,831,303, 7,242,028, 7,288,796, 6,573,536, and US Patent Application Publications 2003/230765, 2004/026721, 2004/141326, 2005/258439, 2005/258440, 2005/269581 provide an octagonal tower on which LEDs are mounted to the tower. Air flows through the tower and carries away some of the heat generated by the LEDs.

Additional approaches providing LEDs in lighting fixtures are known. For example, in Mighetto, U.S. Pat. No. 7,387,403, a plurality of modular lighting element subassemblies each carrying an LED are coupled into modular stacked frames at locations of the users selection and electrically connected using interconnects such as conductors. In Hong, U.S. Pat. No. 6,621,122, a light emitting circuit assembly is formed of a hollow polygonal circuit board in a rectangular, triangular or hexagonal profile, with a plurality of LEDs in each of its peripheral walls.

Depicted in Moore, U.S. Pat. No. 6,668,752, is a two dimensional array of LEDs controlled by a microprocessor running a computer program that illuminates the LEDs in a sequence to simulate a flame. The array of LEDs is arranged on the surface of a cylinder or several flat surfaces forming a faceted tube.

In U.S. Pat. No. 6,715,900 and US Publication No. 2004/0165387, both to Zhang, a luminary unit has a plurality of LEDs on the peripheral surface of a supporting frame.

It is desirable to improve the efficiency of a lighting fixture and use the light generated by the lighting fixture to light only the desired area or areas. It is also desirable to provide a lighting fixture that provides relatively uniform illumination over the area to be illuminated. It is further desirable to configure the direction and amount of light provided by a lighting fixture to achieve a desired lighting distribution.

Various other desirable features are set forth in the following brief description of the drawings, the description of the preferred embodiments, and the appended claims.

SUMMARY OF THE INVENTION

The present invention provides a lighting array assembly for use with emitters or light emitting diodes, and a method for configuring such a lighting array assembly for use with a lighting fixture.

In general, an emitter lighting array assembly having a desired lighting distribution, includes a plurality of emitter support members. Each of the emitter support members have an emitter circuit thereon, an outer surface, and a lighting center point. The outer surfaces of the emitter support members face at least two different directions. At least one emitter is mounted on each of the outer surface of each of the emitter support members. Each emitter is in operative association with the emitter circuit on the emitter support member. The desired lighting distribution has a desired lighting distribution configuration in each emitter support member direction. The number of emitters mounted on each of the outer surfaces of the emitter support members is determined by the light specified in each direction to meet the desired lighting distribution configuration in each direction. The emitters on each of the emitter support members are positioned together around the lighting center point of that emitter support member.

In general, a method of configuring an emitter lighting array assembly for use with a lighting fixture includes the steps of selecting a desired lighting distribution configuration to achieve a desired lighting distribution, selecting a plurality of emitter support members, each of the emitter support members having an outer surface, and selecting the characteristics and number of emitters for mounting on the outer surface of each of the emitter support members to achieve the desired lighting distribution configuration. At least one emitter circuit on each of the emitter support members is provided for powering the selected characteristic and number of the emitters for each emitter support member. The emitters selected are mounted on each of the emitter support members in operational association with the emitter circuit on each emitter support member. The emitter support members are mounted on the lighting fixture with the outer surfaces of the emitter support members facing at least two different directions.

While the present invention has been described above in connection with the preferred embodiment, it should be understood that other embodiments utilizing the present invention is within the scope of this invention. Some of these embodiments are described below in the detailed description of the invention.

BRIEF DESCRIPTION OF THE DRAWINGS

FIG. 14A is a side elevational view of a baffle assembly of the present invention.

FIG. 14B is a sectional view of the baffle assembly shown in FIG. 14A and taken along lines 14B-14B thereof.

FIG. 14C is a sectional view of the baffle assembly shown in FIG. 14A and taken along lines 14C-14C thereof.

DETAILED DESCRIPTION

The present invention provides a lighting fixture 100 as shown in FIGS. 1-6 and method of making same for illuminating predetermined areas. A preferred embodiment of this invention relates to a lighting fixture 100 having emitters 107, such as electrically driven light emitting diodes (LEDs), as a light source mounted in various arrays 111*a*-111*h* (shown in FIGS. 12A-12B) to illuminate different areas as will be further described. It should be understood that as used herein, the terms emitter and LED emitter and plurals thereof include OLEDs (organic LEDs) and other technology which can employ the techniques and mechanisms of the present invention. A preferred embodiment of this invention also relates to baffles 316 positioned adjacent the emitters 107 to distribute the light from the emitters over a predetermined area as shown for example in FIGS. 16A-16B.

Figure 1:
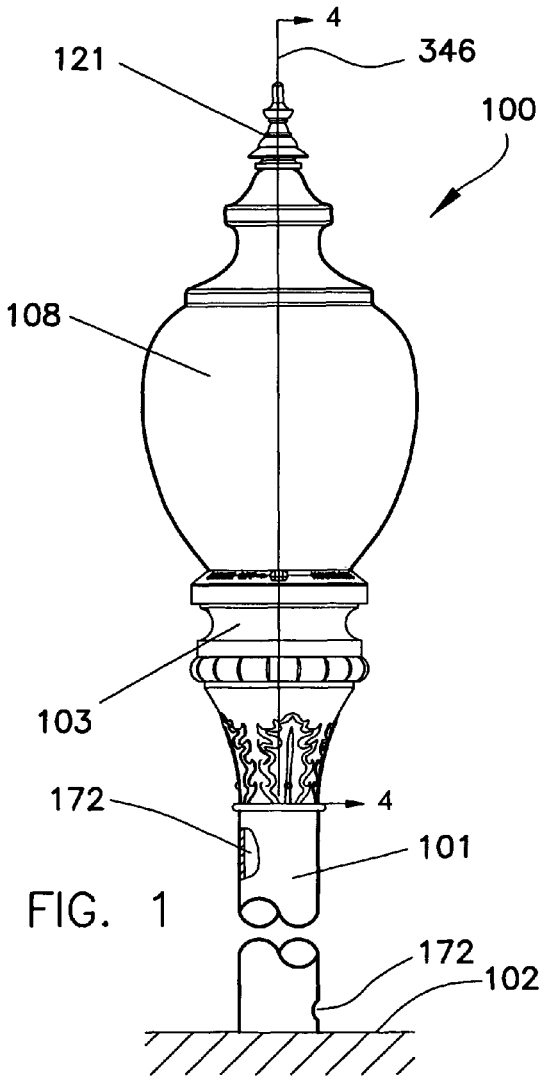
FIG. 1 is a side plan view of a lighting fixture of the present invention.
Figure 2:
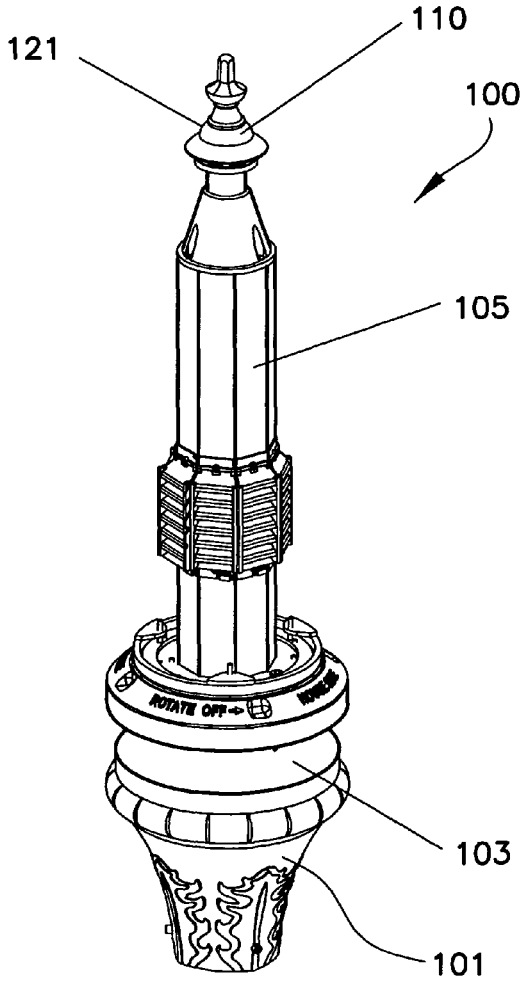
FIG. 2 is a perspective view of the lighting fixture shown in FIG. 1 with the globe of the lighting fixture removed.
Figure 4:
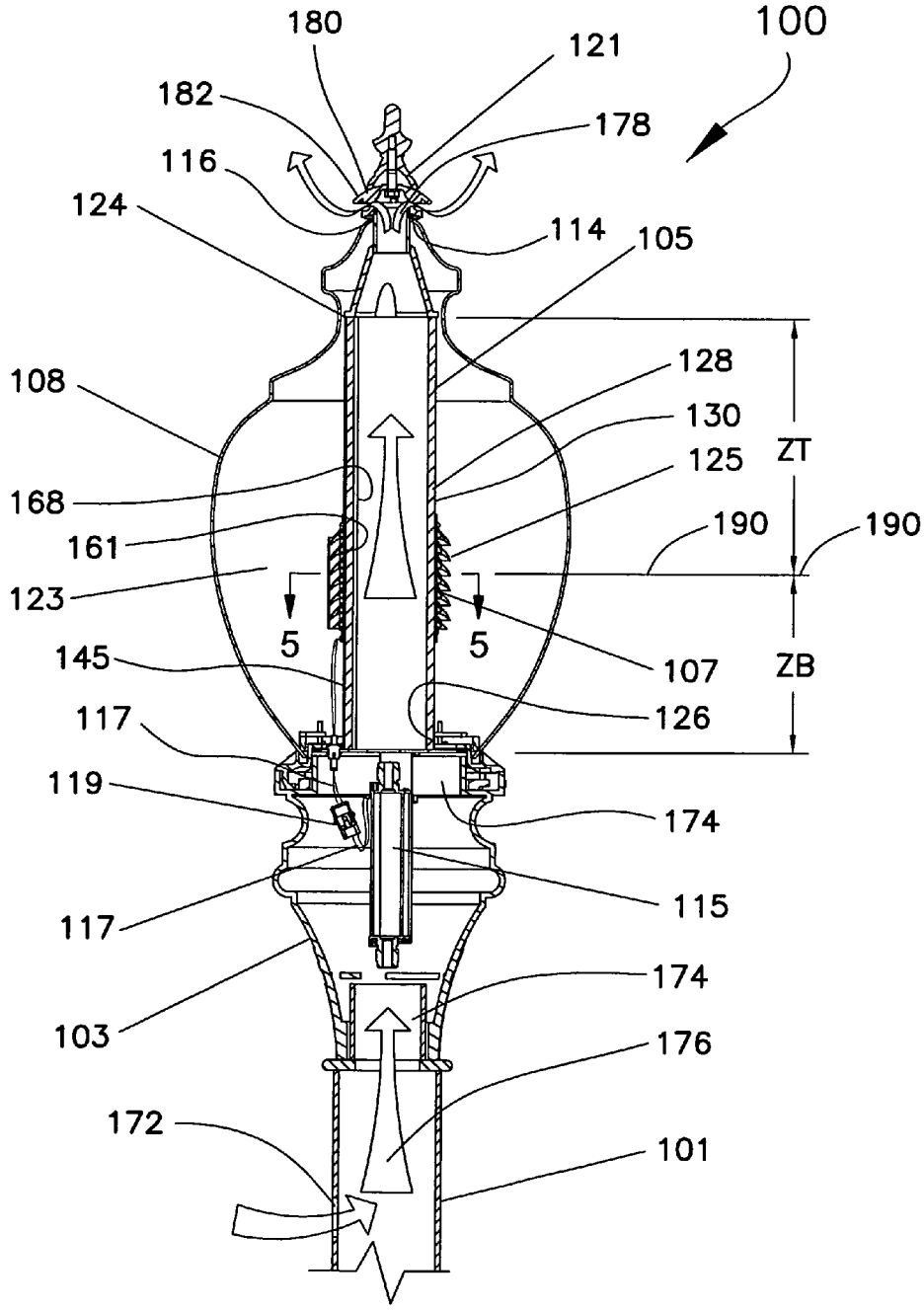
FIG. 4 is a full sectional view of the lighting fixture shown in FIG. 1 and taken along lines 4-4 thereof.

The preferred embodiment of the lighting fixture 100 of the present invention is mounted on various supporting devices, such as a pole 101 mounted in the ground 102 as shown in FIGS. 1 and 4. It is within the contemplation of this invention to use a wide variety of supporting devices for the lighting fixture 100. For example, the fixture 100 may be mounted on a building or other structure. In the lighting fixture design shown in FIGS. 1 and 2, the fixture is described for an outside environment and it should be understood, and it is in the contemplation of this invention, that the features of this invention can be used in a variety of different environments.

The lighting fixture 100 has a capital 103 secured to the pole 101 and has a tower 105 supported in a substantially vertical direction by the capital 103 of the lighting fixture as shown in FIGS. 1-4. The capital 103 is an element of the lighting fixture 100 that is provided to support the lighting fixture on a support, such as the pole 101. The lighting fixture 100 also has a globe 108 and an LED tower 105. The globe 108 is supported by the capital 103 so that it surrounds the tower and allows the light generated by the emitters 107 to be transmitted there through. The capital 103 also supports the tower 105 as will be more fully described. The lighting fixture 100 has a vented finial 121 which engages the top 114 of the globe 108 and allows heated fluid to escape from the top 110 of the lighting fixture 100 as will be more fully described.

Figure 3:
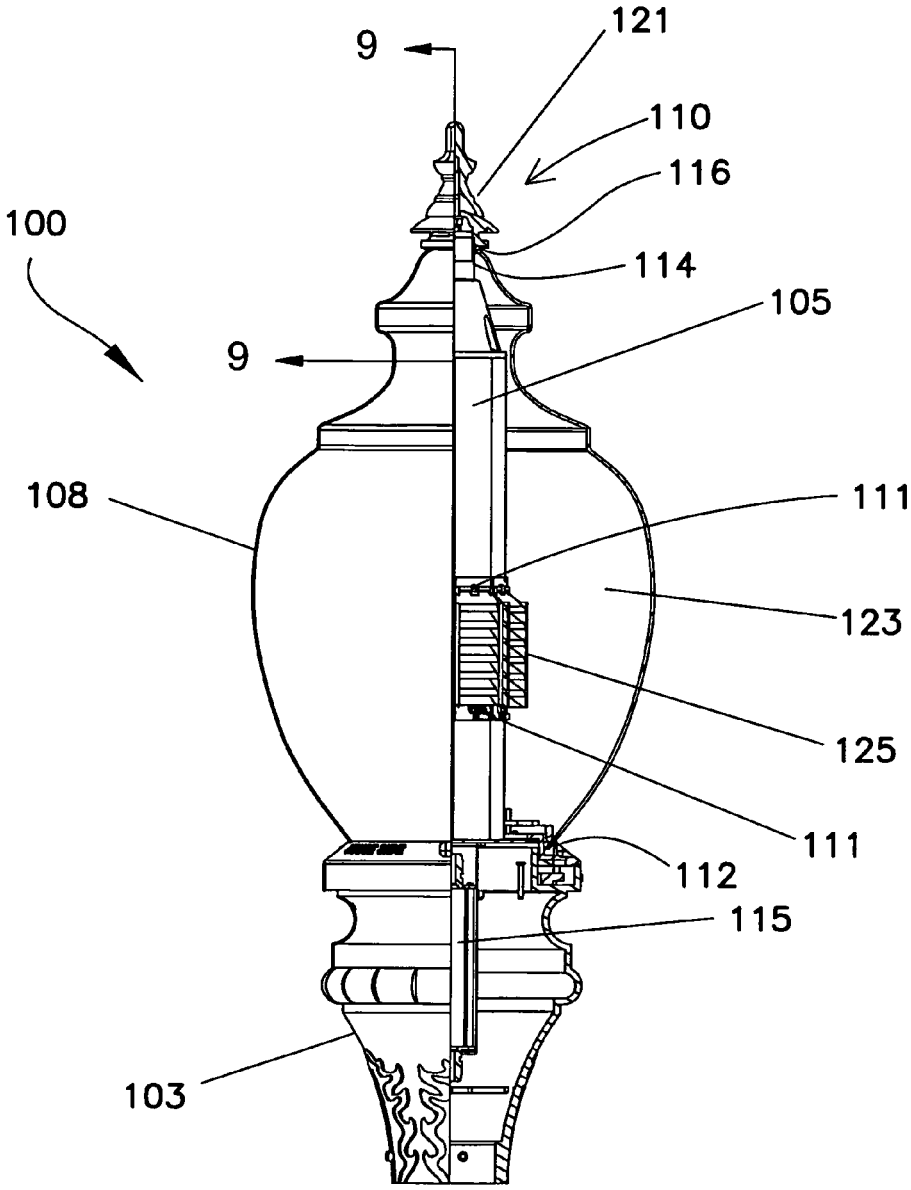
FIG. 3 is a partial cutaway view of the lighting fixture shown in FIG. 1.

An internal optical chamber 123 is provided as shown in FIGS. 3 and 4 to improve the optical performance of the fixture 100. The bottom 112 of the globe 108 is in sealing engagement with the capital 103 and the top 114 of the globe is in sealing engagement with the bottom 116 of the vented finial 121 so that an internal optical chamber 123 is provided. As will be more fully described, the internal optical chamber 123 is the chamber in which the emitters, tower, various electronics, and optical baffles are mounted, and are sealed and isolated from the outside, making the chamber 123 both dust resistant, and moisture resistant. Such a design of the internal optical chamber 123 provides a lower LLD (Light Loss Factor) due to decreasing dirt build up on the inside of the luminarie globe 108, thus improving the optical performance of the fixture. This sealed system design also allows the optical chamber 123 to achieve a high degree IP (ingress protection) rating of IP66 as will be more fully described.

Figure 5:
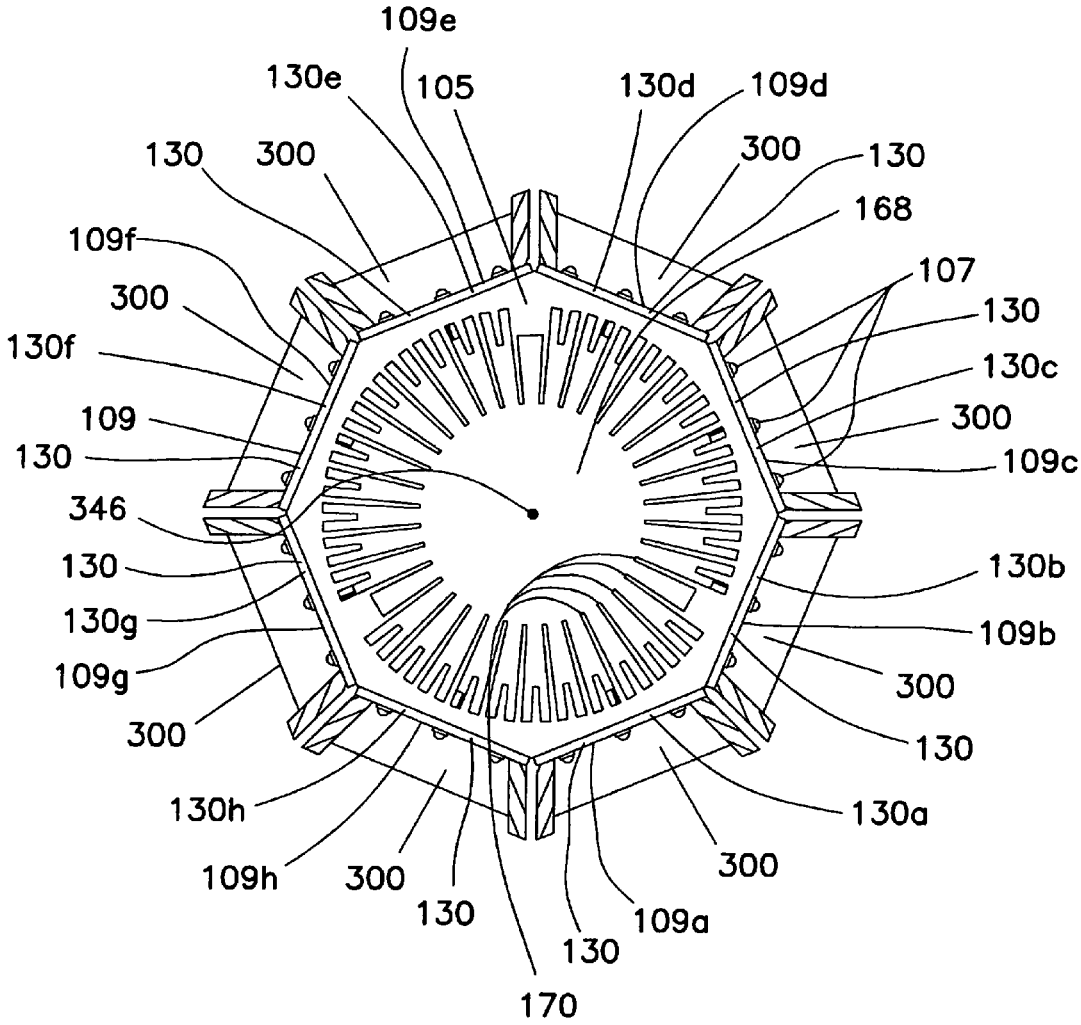
FIG. 5 is a sectional view of the tower shown in FIG. 4 and taken along lines 5-5 thereof.
Figure 6:
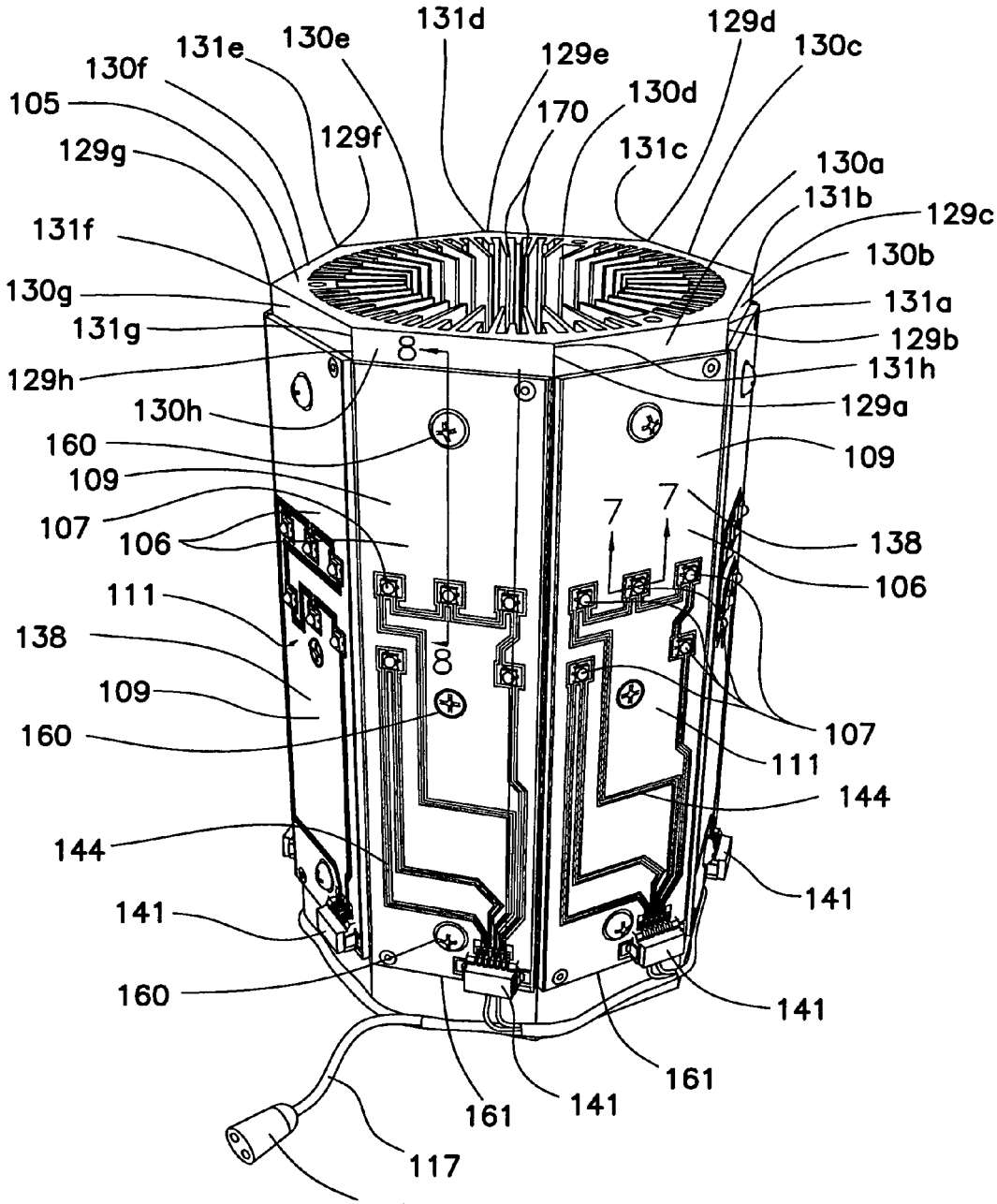
FIG. 6 is a partial perspective view of the tower and an emitter boards shown in FIG. 5.

The tower 105 has a top 124 and a bottom 126 and a central portion 128 extending there between. The tower 105 has outside faces or surfaces 130*a*-130*h* and generally referred to as outside faces or surfaces 130 as shown in FIGS. 4-6. The outside surfaces 130*a*-130*h* form a cross sectional octagon. Each of the adjacent outside surfaces 130*a*-130*h* are contiguous with each other and extend from substantially the top 124 to the bottom 126 of the tower 105. The outside surfaces 130*a*-130*h* have sides 129*a*-129*h* respectively. The outside surfaces also have sides 131*a*-131*h* respectively which are opposite their respective sides 129*a*-129*h*. Since the adjacent outside surfaces 130*a*-130*h* are contiguous with each other, for example, the sides 129*a*, 131*a* of the outside surface 130*a* are adjacent to the sides 131*h*, 129*b* respectively of the outside surfaces 130*h* and 130*b* respectively. The other sides 129*b*-129*h* and 131*b*-131*h* of the surfaces 130*b*-130*h* respectively are similarly adjacent their corresponding adjacent sides. It should be understood that the number of outside faces 130 are dependent on the lighting application and the area to which light is to be supplied. As described, the tower has eight equal sides and the emitters on each face illuminate an area 45 degrees around the fixture.

It is within the contemplation of this invention to provide a tower with any number of outside surfaces and the eight sides shown is provided in connection with the embodiment described. If for example, the tower had three equal sides, the emitters on each face would illuminate an area 120 degrees around the fixture. In the case where the tower had 4 equal sides, the emitters on each face would illuminate an area 90 degrees (illumination area) around the fixture. The degrees of illumination or illumination area, when the sides are equal, is 360 degrees divided by the number of faces. It is also within the contemplation of this invention for the faces to be of different widths, that is the distance between the sides 129*a*-129*h* and their complementary sides 131*a*-131*h*. In that case, the emitters on each face will have different illumination areas.

Figure 7:
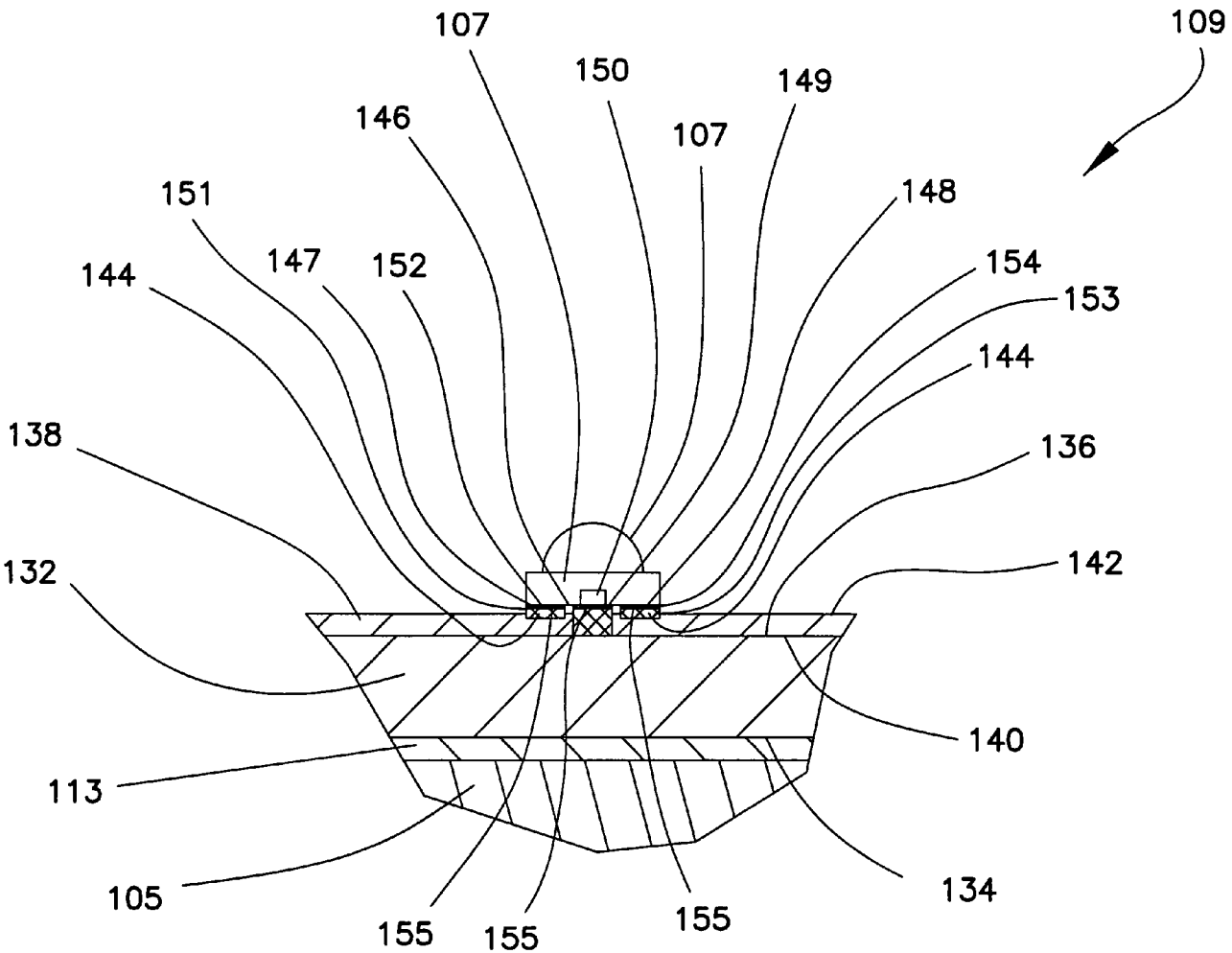
FIG. 7 is a partial sectional view of the tower and emitter board shown in FIG. 6 and taken along line 7-7 thereof.
Figure 8:
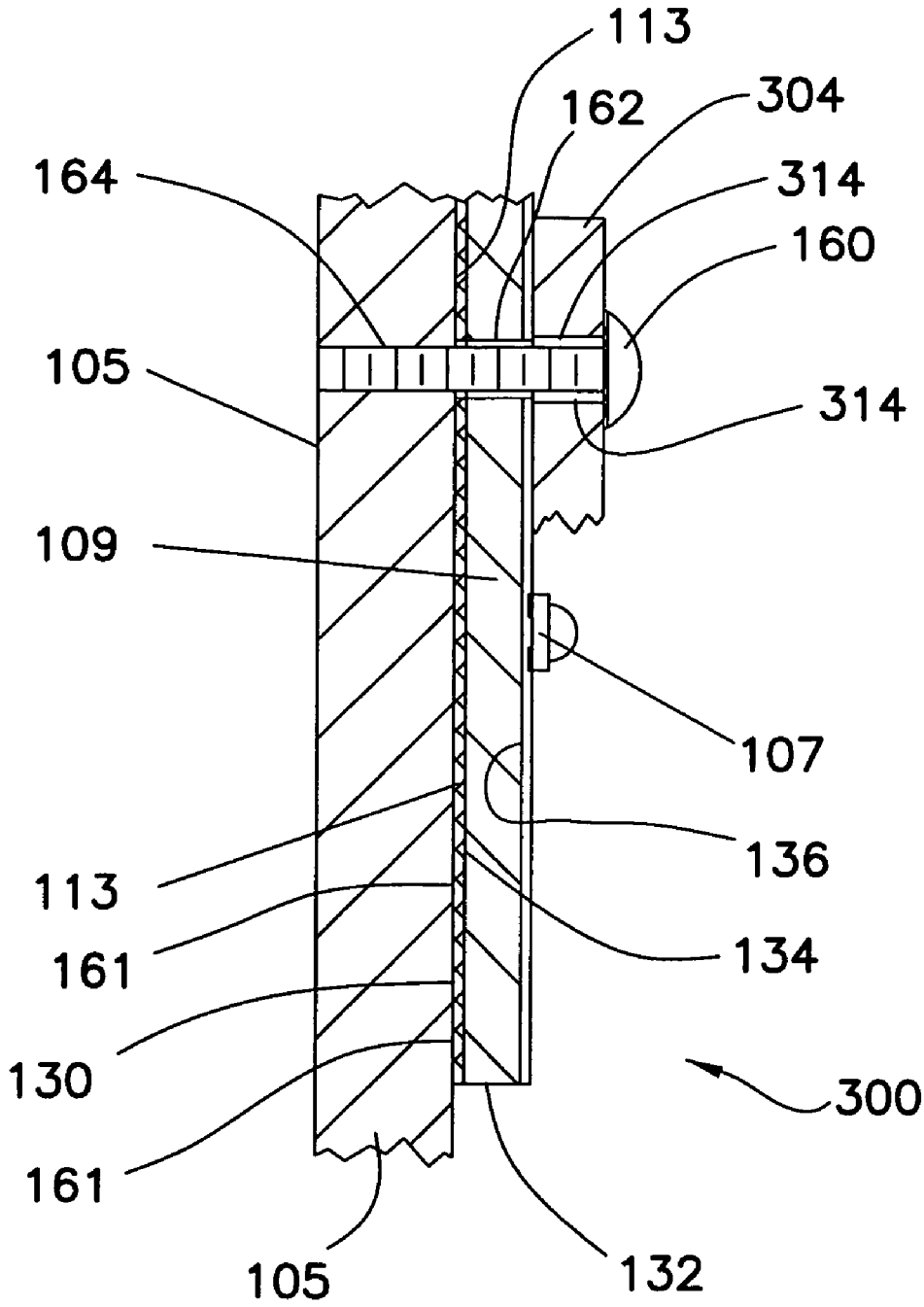
FIG. 8 is a partial sectional view of the tower and emitter board shown in FIG. 6 and taken along line 8-8 thereof.

As shown in FIGS. 6-8, the emitter support member 109 is provided to support and mount the emitters on the tower, such as, for example, the emitter support boards 109 have been suitable to mount the emitters 107 on the tower 105. It should be understood that the emitter support member could also be the tower. An emitter lighting array assembly 106 is provided which includes an emitter board 109, and emitters 107 mounted on the emitter board. For ease of description, one typical emitter board 109 and one LED emitter 107 is described in detail and it should be understood that specific emitter boards 109*a*-109*h* provide for a greater or lesser number of emitters as will be described herein. The additional LED emitters are mounted on the emitter boards in a similar manner. The variations in different emitter boards are made as described herein and mounted on the tower to achieve the features of the present invention.

The emitter board 109 of the emitter lighting array assembly 106 has a base 132 which is formed from a heat conductive material, such as aluminum, and has an inner surface 134 and an outer surface 136. The outer surface 136 has a non conductive insulating coating 138, of a plastic or ceramic material, having an inner surface 140 adhered to the outer surface 136 of the emitter board base 132. The insulating coating 138 has an outer surface 142 with a printed emitter circuit 144 adhered thereto.

Emitters 107 of the emitter lighting array assembly 106 generate considerable heat during operation and the lighting fixture shown transmits the heat generated by the emitters to the emitter board. The emitter board then transmits that heat to the tower where it is dissipated and carried away. The emitters 107 have a bottom portion 146 which includes electrically conductive terminals 147, 148 which are electrically connected to the printed emitter circuit 144 to power the LED emitter as shown in FIGS. 6-8. The emitters 107 also include an emitter die 150 which is the heat receiving component of the emitter when in operation. The emitter board 109 includes a thermally conductive member 149 directly under and in contact with the emitter die 150. The conductive member 149 is in direct thermal contact with the outer surface 136 of the base 132.

In operation, the heat generated by the emitter is transmitted from the emitter die 150 to the thermally conductive member 149 which conducts the heat to the board base 132 which in turn dissipates the heat through the tower 105 as herein described. The board base 132 has a heat transfer capacity to receive the heat from the emitter die and absorbs that heat to subsequently transfer that heat to the tower. The board base is in thermal contact with the tower over a substantial area. The size of the board base 132, and the surface area over which it transfers heat to the tower and the effectiveness of heat dissipated by the tower allows for its heat transfer capacity. These characteristics provide for heat transfer capacity, that is the amount of heat that is transferred to the board base 132 and heat dissipation capacity, that is the amount of heat that is dissipated by the board base 132.

The emitter board 109 has an electrically conductive emitter circuit 144 adhered to the outside surface 142 of the non-conductive, insulating coating 138. The emitter circuit may be of a variety of designs and is illustrated in the drawings as printed circuit 144. The emitter circuit 144 is composed of an electrically conductive material which may include, but is not restricted to, copper or silver. The emitter circuit 144 has exposed upper surfaces 154, 152 which have terminal pads 151, 153 for transmitting power to the emitter and for mounting the emitter thereon. To mount the emitter on the emitter circuit 144, the electrically conductive terminals 147 and 148 of the emitter 107 are positioned in alignment and contact with their respective terminal pads 151, 153 on the emitter circuit. The emitter circuit 144 carries electrical power to the terminal pads 151, 153 which is conducted to the electrically conductive terminals 147 and 148 on the emitter 107 so that the emitter is in operative association with the emitter circuit or printed circuit.

The emitter is secured to the emitter board by electrically and thermally conductive solder 155. The solder is applied between the electrically conductive terminals 147 and 148 of the emitter 107 and the terminal pads 151, 153 on the printed circuit respectively to provide an electrical connection and support the emitters thereon. The electrically and thermally conductive solder 155 is also applied between the emitter die 150 and the thermally conductive member 149 of the emitter to provide a thin layer of solder 155 there between to conduct heat from the emitter to the circuit board base 132. The solder 155 provides a thermally conductive path, as well as providing the means to secure the emitter 107 to the emitter board 109. It is within the contemplation of this invention to use a variety of different devices other than solder to provide the electrical and thermal conductivity and secure the emitter to the emitter board.

Power is provided to the emitters by the printed circuit 144 adhered to the outside surface 142 of the non-conductive, insulating coating 138. All of the emitters 107 on the emitter boards 109 of the lighting fixture 100 receive electrical power from the same driver 115 shown in FIGS. 3 and 4. The driver 115 is a fully integrated, electronic power converter that takes in the electrical service feed, (typically, 120 v through 277 v) and converts that voltage, and furnish the necessary amperage required for the emitters 107. The printed circuitry 144 on each of the emitter boards 109 distributes the electrical power from the driver to the emitters on each emitter board.

The printed circuits 144 are electrically connected to the driver 115 via a multi-stranded, power harness 117. This cable can be uncoupled from the driver by means of a multi-pinned plug type connector 119, and can likewise be disconnected from the individual emitter boards 109 via an emitted board mounted pin connector 141. This design provides for easily changing the emitter boards 109 of the fixture 100.

By mounting the emitters on the emitter boards that are removably connected to the tower, instead of directly on the tower, additional desirable features of the present invention are provided. The design of the fixture 100 allows the area illuminated by the fixture and the amount of light in a selected direction to be easily changed. As will be further described in greater detail, the number and position of the emitters on each emitter board, in part, define the amount of light in each direction of the emitter boards and the area to be illuminated. When it is desirable to change the emitter board, the connector 141 is disconnected and when the new emitter board is in place, the connector 141 is reconnected and the emitters are connected for operation. This may or may not require the use of a new wire harness 117. This feature allows for changing the emitter boards with different configurations and allows the fixture to provide lighting for different areas as will be further described.

To removably connect the emitter boards to the tower, a variety of known devices may be used, such as the threaded fasteners 160 as shown in FIGS. 6 and 8. The emitter boards 109 are mounted to the tower 105 on the emitter board mounting portion or area 161 of the tower by means of threaded fasteners 160 spaced apart vertically. The emitter board 109 has an aperture 162 to slidably receive the threaded fastener 160 therein. The tower has a threaded aperture 164 therein to threadedly engage the threaded fastener in the emitter board mounting portion 161 of the tower.

The emitter board mounting portion 161 is defined by the area that the inner surface 134 of the emitter board 109 contacts the outer side surface 130 of the tower. The emitter board has a top 156, bottom 157 and sides 158, 159 describing the boundaries of the inner surface 134 which defines the emitter board mounting portion 161 when the emitter board is mounted on the tower. It should be understood that the distance between the top 124 and bottom 126 of the outer surface 130 of the tower is greater than the distance between the top 156 and the bottom 157 of the emitter board. Preferably, the emitter board 109 is mounted in the central portion 128 of the tower 105 with portions 143, 145 of the tower extending above and below, respectively, the emitter board mounting portion 161 of the tower, as shown in FIG. 4. Such a design provides for a more efficient dissipation of the heat generated by the emitters as will be described.

When it is desirable to remove the emitter board from the tower, the threaded fasteners 160 are removed, the driver connector 119 is disconnected, and connector 141 on the emitter board is disconnected and the emitter board is removed. When it is desirable to attach the emitter board to the tower, a thin coating of metal impregnated thermo-conducting grease 113 is applied to either the inner surface 134 of the emitter board base 132 or the portion of outer surface 130 defining the emitter board mounting portion 161 of the tower 105. The threaded fasteners 160 are inserted through the apertures 162 in the emitter board and then engage the threaded apertures 164 in the tower and are tightened, shown in FIG. 8. The metal impregnated thermo-conducting grease 113 provides an improved thermal connection between the emitter board base 132 and the tower to effectively transfer heat from the emitter board to the tower.

Emitters generate a great amount of heat which must be carried away from the emitters for them to operate efficiently. As will be further described, it is advantageous to position the emitters on an emitter board in close proximity to each other, which further accentuates the need for efficient cooling of the emitters.

As has been described above, the heat from the emitters is conducted to the tower by the emitter boards. To dissipate the heat conducted to the tower, the tower 105 is made from a heat conductive material, such as aluminum and has a cooling aperture 168 as seen in FIGS. 4 and 5. The cooling aperture 168 extends from the bottom 126 through the central portion 128 and through the top 124 of the tower 105 and allows a fluid, such as air to pass there through. The emitter tower 105 has a plurality of cooling fins 170 extending radially inwardly into the cooling aperture 168. To maximize the area that the cooling fins are in contact with the air in the cooling passageway, the fins extend from the bottom 126 to the top 124 of the tower.

These fins 170 are designed to take advantage of the upwardly moving air caused by convection due to the air in the cooling aperture 168 of the tower 105 being heated by the emitters 107. The cross-sectional shape of the tower 105 with a number of fins 170 provides for an increased amount of surface area which allows the tower 105 to act as the primary heat sink to dissipate the heat generated by the emitters 107.

The cooling aperture 168 is connected to ambient air which flows through the cooling aperture and carries heat away from the tower. As illustrated in FIGS. 1 and 4, ambient air enters the luminarie or lighting fixture 100 from an aperture 172 in the mounting pole 101. The aperture in the pole 101 or capital 103 may be in a variety of positions and the aperture 172 in the pole 101 as shown in the drawings is illustrative of just one such position. In other designs, the pole aperture may be the aperture through which wiring enters the inside of the pole 101.

The ambient air then passes through the passageways 174 in the fixture capital 103, as shown in FIG. 4 by the arrow 176 to the cooling aperture 168. The cooling aperture extends from the bottom 126 to the top 124 of the tower 105 and is defined in part by the cooling fins 170. When in the cooling aperture 168, the ambient air is heated as it flows across the cooling fins 170 and travels upward through the tower 105 by convection. It is within the contemplation of this invention to provide a source of ambient air to the capital passageway 174 and cooling fins 170 with a wide variety of constructions and designs.

The heated air in the cooling aperture 168 is vented to the outside by means of the vented finial 121 mounted on the top 124 of the vertical tower 105 and globe 108 causing a chimney effect. In addition, the vented finial 121 provides for sealing the top of the globe to provide the optical compartment 123 as described above.

Figure 9:
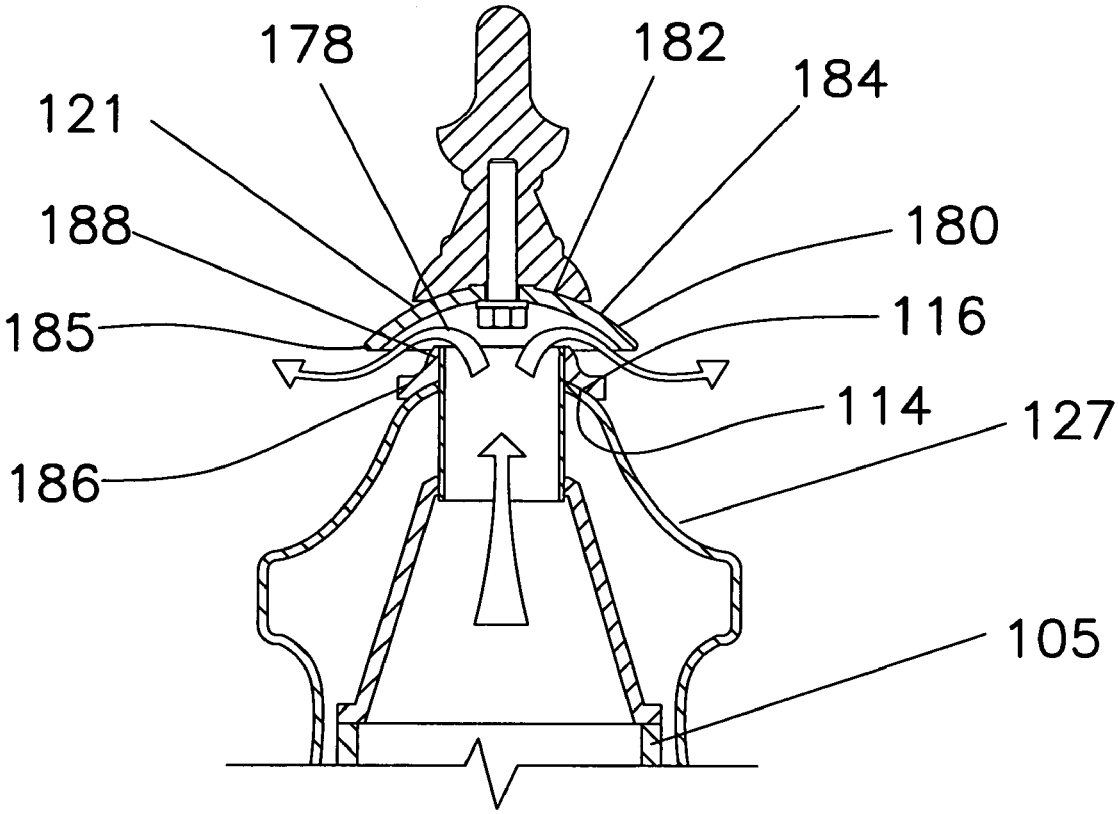
FIG. 9 is a partial sectional view of the top of the fixture shown in FIG. 3 and taken along line 9-9 thereof.

The vented finial 121 has apertures or passageways 178 therein to allow heat to escape from the lighting fixture, as shown in FIGS. 4 and 9. The passageways 178 in the finial 121 connect the cooling aperture or passageway 168 to the atmosphere. The lighting fixture 100 has a globe 108 surrounding the light source of the lighting fixture. The finial 121 is mounted on the top of the lighting fixture adjacent the top 114 of the globe 108 to provide the internal optical compartment 123 as described above.

To maintain the integrity of the internal optical compartment 123, the finial 121 is designed to minimize the contaminants that can enter the internal optical compartment 123 through the passageway 178. The finial has a protective portion 180 having a top 182, and side portions 184 extending downwardly and radially outwardly of the top 182 and terminating in a bottom edge 185. The bottom edge 185 is positioned below and radially outwardly of the top portion 182.

The finial apertures or passageways 178 are positioned in the finial 121 inside and adjacent the protective portion 180 so as to protect the finial apertures 178 from the elements. The final has an inner portion 186 positioned below the top portion 182 and terminating in an upper edge 188. The upper edge 188 is substantially horizontally parallel or vertically above the bottom edge 185 of the protective portion 180 to protect against the elements, such as rain or dust, from entering the internal optical compartment 123 through the passageway 178. Accordingly, the passageway 178 is protected from outside elements such as rain or dirt from entering the internal optical compartment 123. An improved lower LLF (Light Loss Factor) due to decreasing dirt build up on the inside of the globe 108 is provided, thus improving the optical performance of the fixture.

Figure 10:
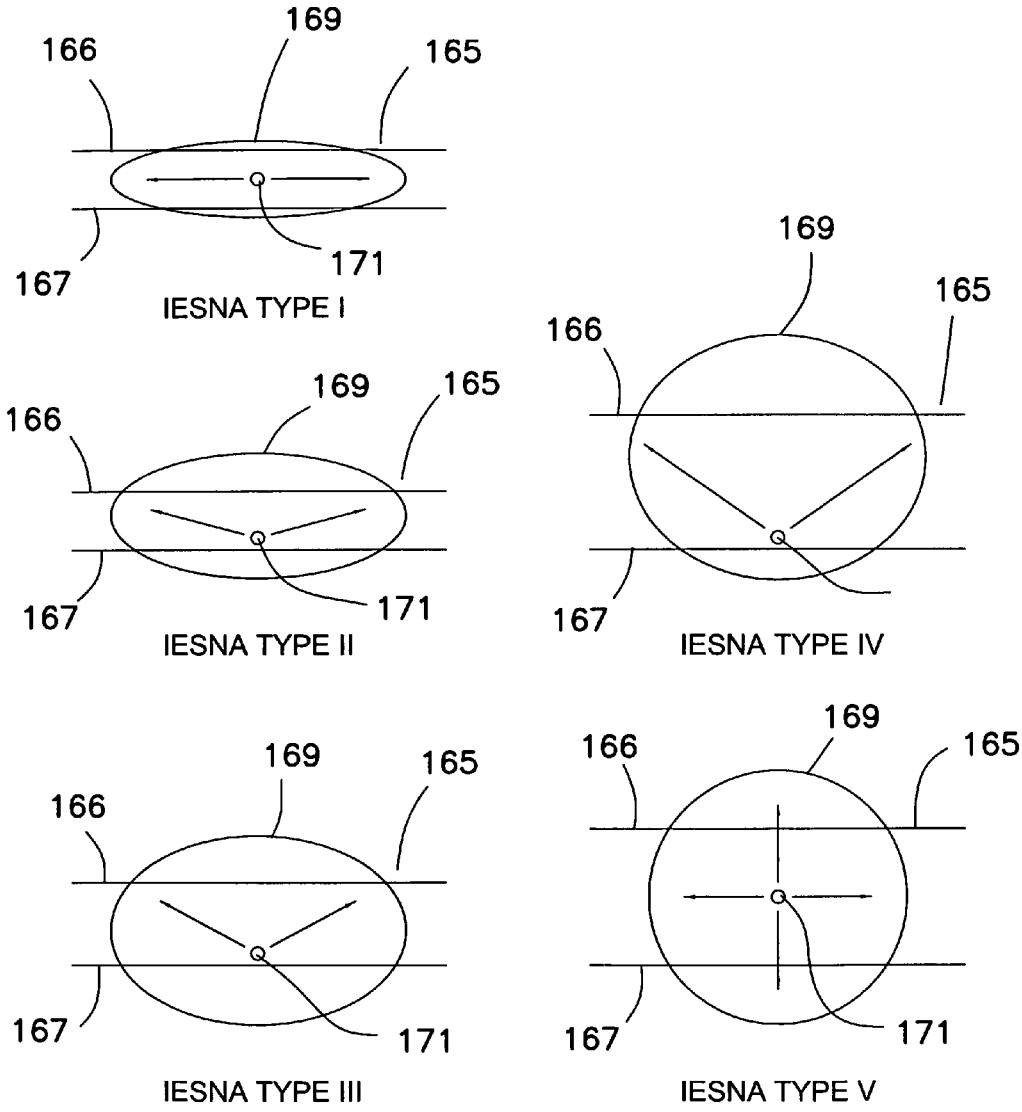
FIG. 10 is a schematic of various light distribution patterns.

The design of the present invention provides for configuring the direction and amount of light as desired. Some of the lighting distribution configurations for lighting a roadway are shown in FIG. 10 and depend on the position of the lighting fixture, for example, in the middle or on the side of the roadway, and the areas where the most light is to be distributed. It should be understood that the present invention can be used to provide a wide variety of lighting configurations and the described configurations are provided only for purposes of illustration.

The present invention provides various emitters 107 mounted on their respective emitter boards 109*a*-109*h* in various arrays 111*a*-111*h*. The emitter boards 109*a*-109*h* are mounted to the faces 130*a*-130*h*, respectively, of the tower 105 as shown in FIG. 5 with various arrays 111*a*-111*h* having various configurations and numbers and patterns, as shown for example in FIGS. 11A-11D and FIGS. 12A-12D as will be more fully described. Depending on which light distribution pattern shown in FIG. 10 is to be met, the arrays 111*a*-111*h* is varied to control the intensity of the light in at least two different directions.

By varying the number and configuration of the emitters 107 on each emitter board 109*a*-109*h*, and having each emitter board 109*a*-109*h* placed on a separate face, the light output of the lighting fixture 100 can be varied to achieve IES (Illuminating Engineering Society) light distribution patterns as shown in FIG. 10 (refer to IESNA LM-31-95). IESNA (Illuminating Engineering Society of North America). In FIG. 10, a roadway is indicated in connection with each IESNA Type at. 165 with the sides of the roadway indicated by 166 and 167 with the distribution pattern indicated by 169 and the location of the lighting fixture indicated at 171. Type I shows a lighting fixture mounted at 171 on the center of the roadway 165 with the greatest intensity of the light output along the roadway in both directions with small amounts of light in other directions. IESNA Type II shows a lighting fixture mounted at 171 on the side of the roadway 165 with the greatest intensity of the light output along the roadway in both directions with some light in other directions. IESNA Type III shows a lighting fixture mounted at 171 on the side of a roadway 165 with the greatest intensity of the light output along the roadway in both directions with greater amounts of light in other directions adjacent the roadway than Type II. IESNA Type IV shows a lighting fixture mounted at 171 on the side of a roadway 165 with substantial intensity of the light output along the roadway in both directions with similar amounts of light the directions adjacent the roadway and opposite the fixture than Type IV. IESNA Type V shows a lighting fixture mounted at 171 in the center of a roadway 165 with uniform distribution of the light output around the fixture. The above descriptions of the IESNA Types are only provided as a general description and for more detailed information, the IESNA publication should be referenced.

The lighting fixture 100 of the present invention may be provided with a wide variety of other lighting configurations. For purposes of describing the invention, a fixture of the present invention is described for illustrative purposes in connection with several IESNA Types and it should be understood that a lighting fixture of the present invention may be provided to meet a wide variety of other desired lighting distribution configurations.

The emitter boards 109 are mounted to the outer faces 130*a*-130*h* of the tower 105, such that the resultant emission of visible light could vary in any given direction, allowing control of the candela distribution throughout 360 degrees of are of the horizontal plane. This enables the light output of the light fixture to be tuned to meet specific optical requirements such as the various roadway lighting distribution classifications as defined in standard LM-79-08 for photometric testing of solid state lighting products, published by the IESNA (Illuminating Engineering Society of North America).

Figure 11A:
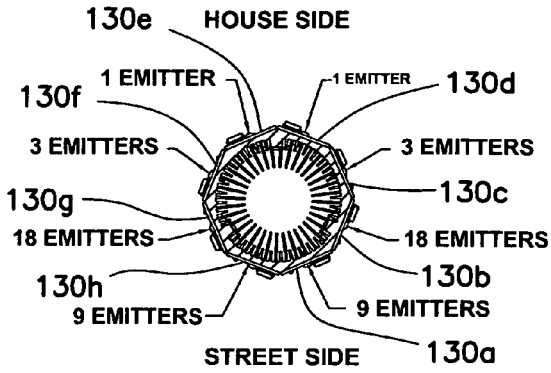
FIG. 11A is a schematic of the emitters to achieve one distribution and light intensity pattern.
Figure 11B:
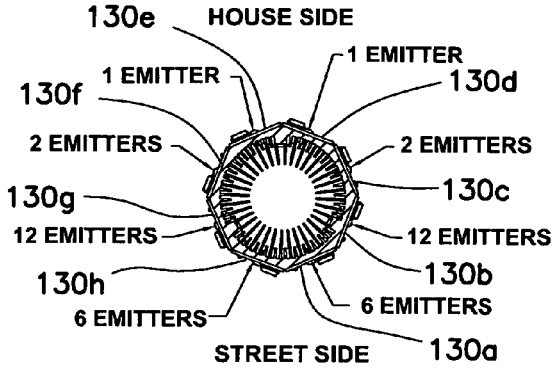
FIG. 11B is a schematic of the emitters to achieve another distribution and light intensity pattern.
Figure 11C:
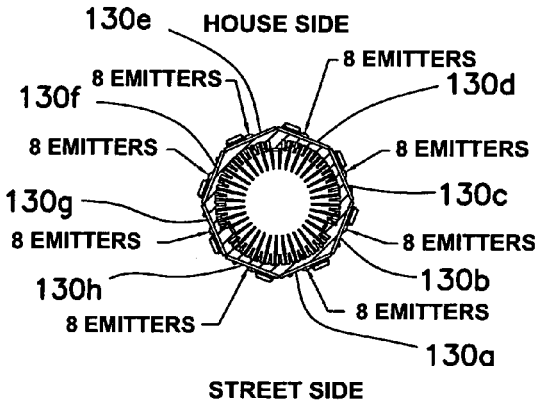
FIG. 11C is a schematic of the emitters to achieve yet another distribution and light intensity pattern.
Figure 11D:
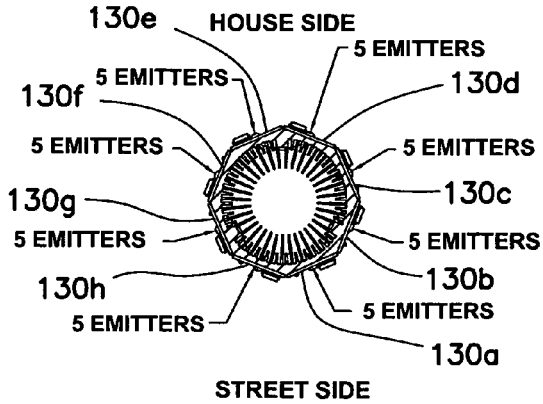
FIG. 11D is a schematic of the emitters to achieve an additional distribution and light intensity pattern.
Figure 12A:
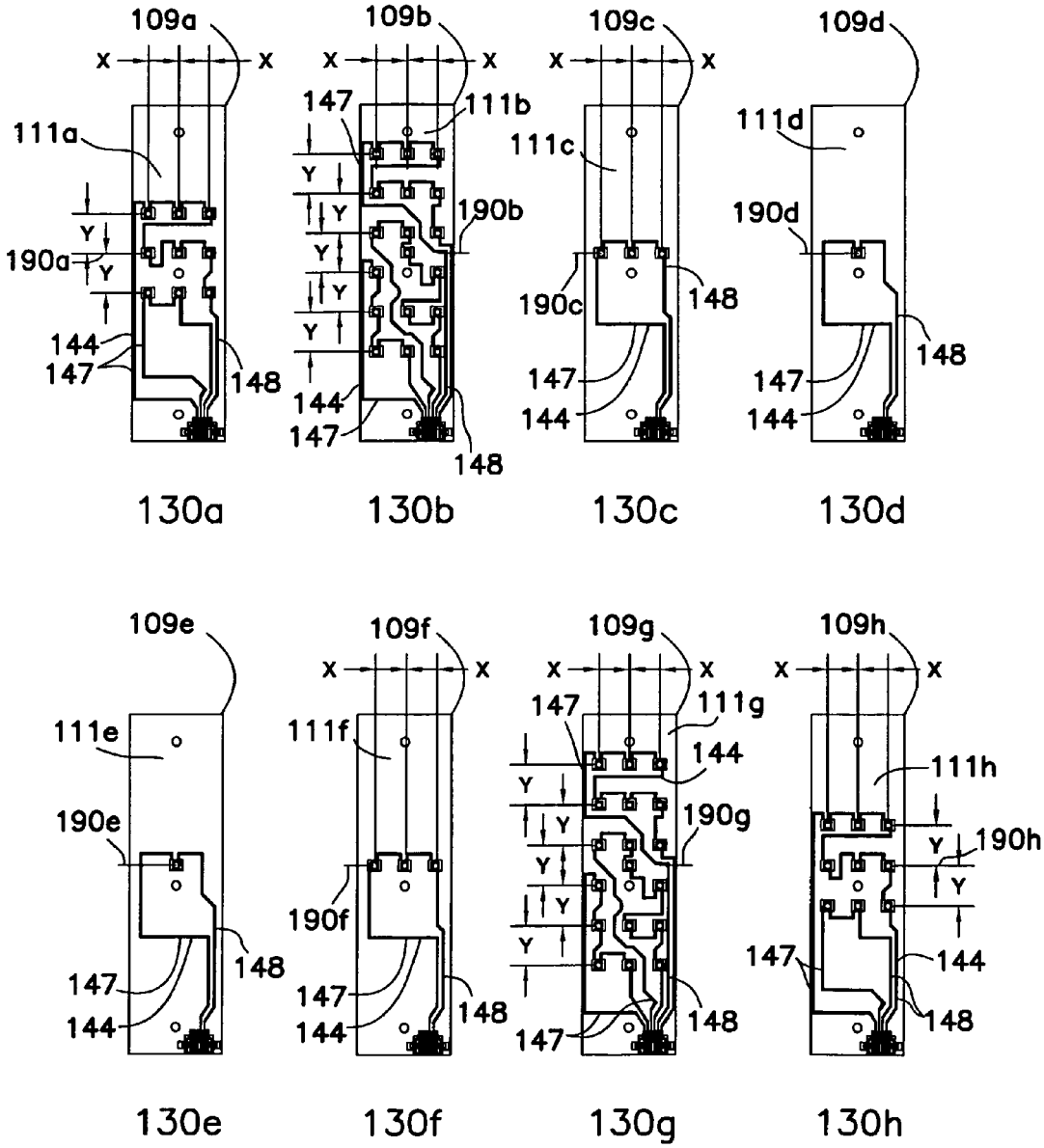
FIG. 12A is a schematic view of the emitter boards mounted on a tower shown in FIG. 11A to provide the desired lighting distribution.
Figure 12B:
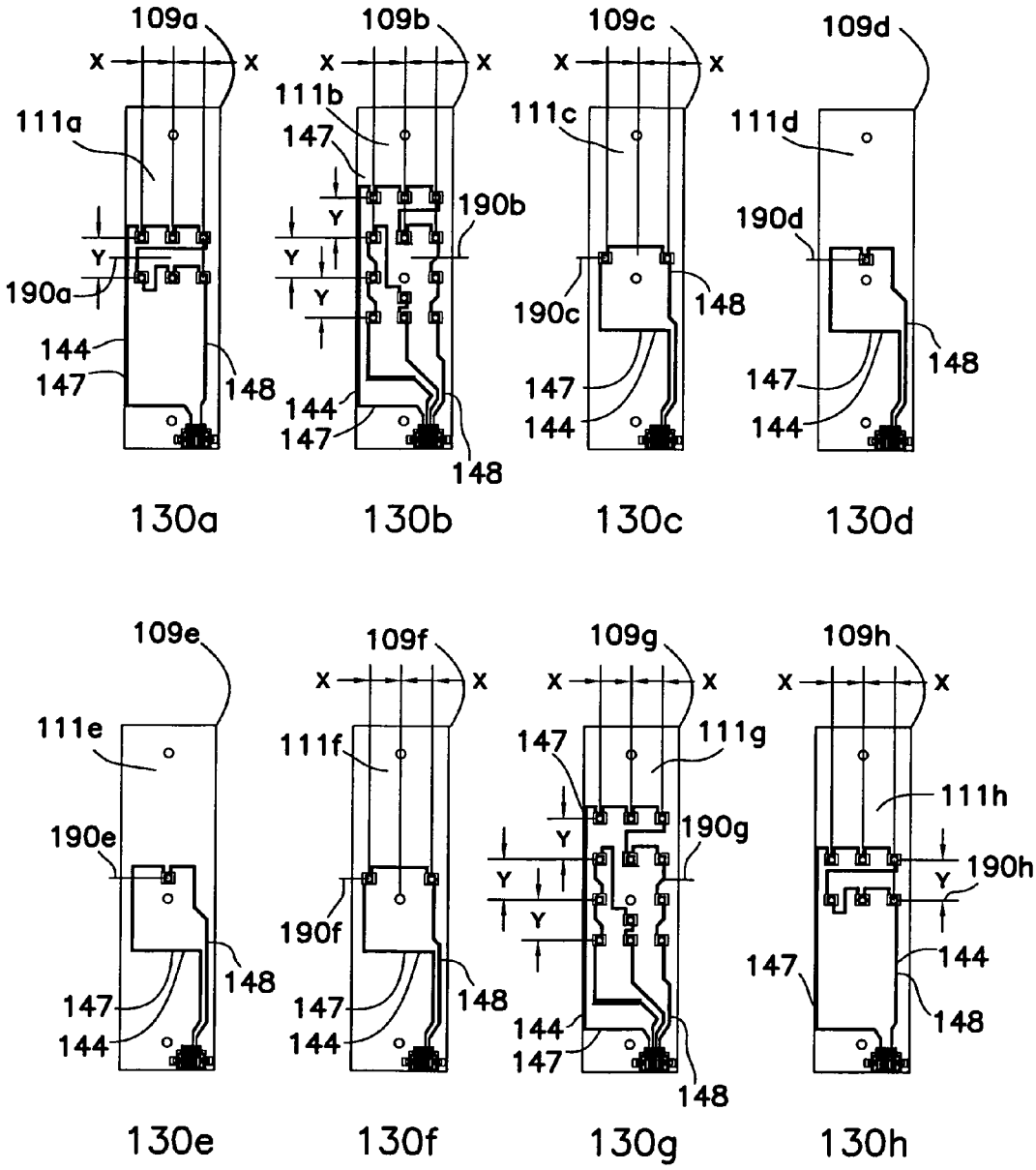
FIG. 12B is a schematic view of the emitter boards mounted on a tower shown in FIG. 11B to provide the desired lighting distribution.
Figure 12C:
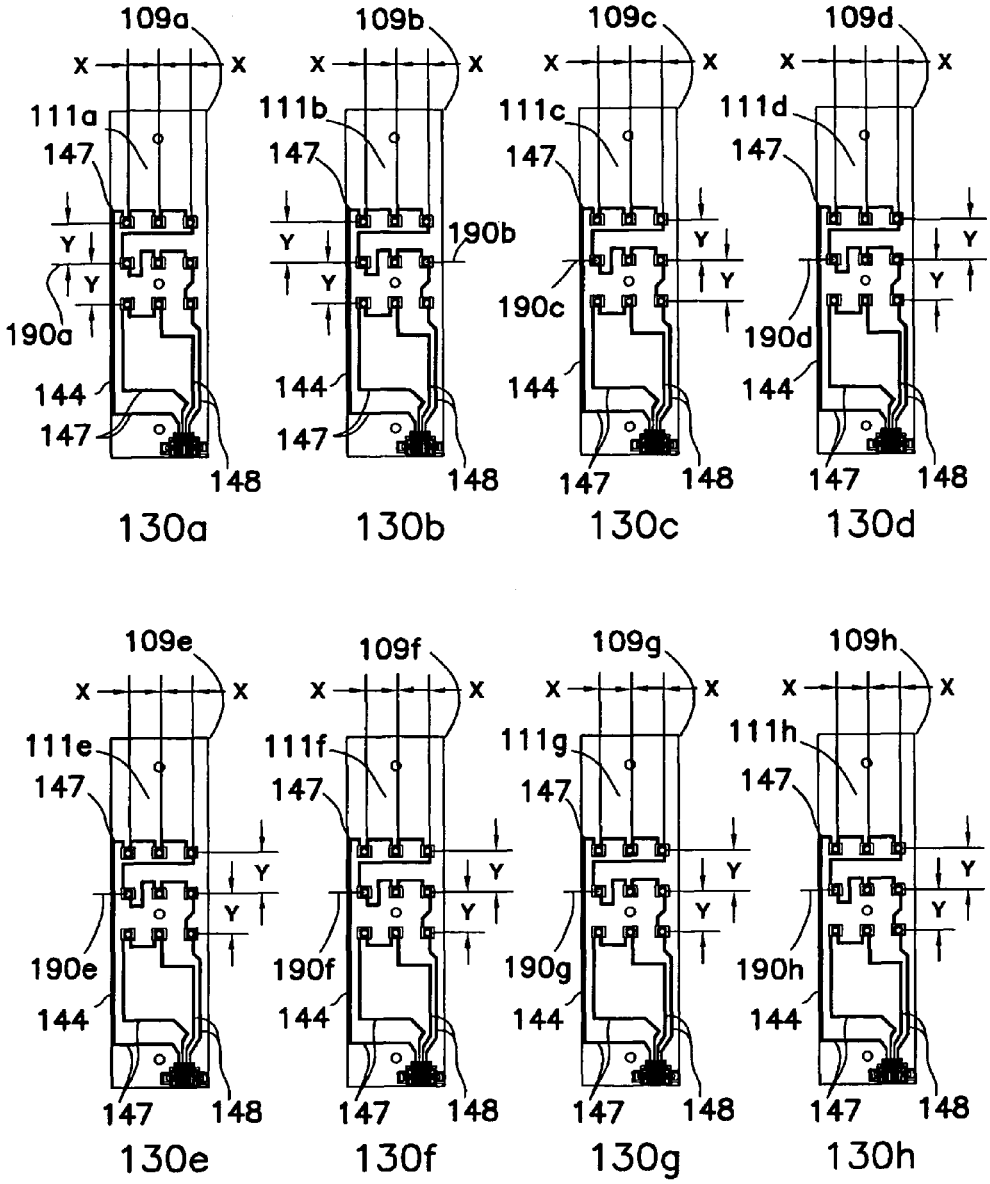
FIG. 12C is a schematic view of the emitter boards mounted on a tower shown in FIG. 11C to provide the desired lighting distribution.
Figure 12D:
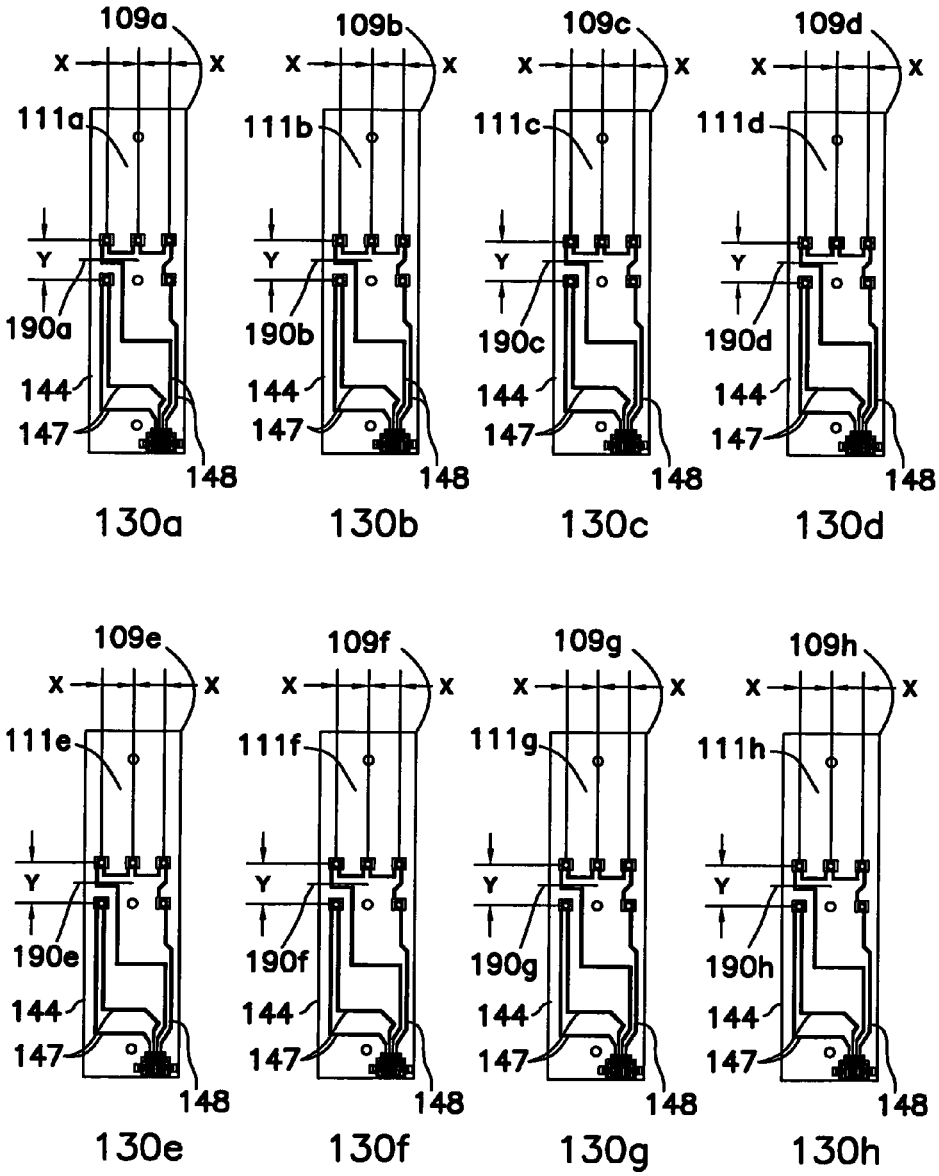
FIG. 12D is a schematic view of the emitter boards mounted on a tower shown in FIG. 11D to provide the desired lighting distribution.

Different lighting fixtures are provided to generate different total amounts of light. For example, solely for purposes of description herein, an 8000 Series Fixture generates approximately 8000 Initial lumens, and a 5000 Series Fixture generates approximately 5000 Initial lumens. FIGS. 11A and 12A show the number of emitters on each emitter board 109*a*-109*h* for mounting on the sides 130*a*-130*h* of the tower for the light distribution for a 8000 Series Fixture IESNA Type III. FIGS. 11B and 12B show the number of emitters on each emitter board 109*a*-109*h* for mounting on the sides 130*a*-130*h* of the tower for the light distribution for a 5000 Series Fixture IESNA Type II. FIGS. 11C and 12C show the number of emitters on each emitter board 109*a*-109*h* for mounting on the sides 130*a*-130*h* of the tower for the light distribution for a 8000 Series Fixture IESNA Type V. FIGS. 11D and 12D show the number of emitters on each emitter board 109*a*-109*h* for mounting on the sides 130*a*-130*h* of the tower for the light distribution for a 5000 Series Fixture IESNA Type V. The light output of the fixture can be increased or decreased by the number of LEDs mounted on the fixture.

The LEDs 107 are mounted on the circuit boards 130*a*-130*h* in different arrays 111*a*-111*h* with varying heights, widths, patterns, and numbers to achieve the desired lighting distribution configurations as described below. The selection of the emitter properties is first addressed.

The emitters 107 used in the preferred design are latest generation, high out-put (1+watts per emitter). It should be understood that as the emitter technology develops, other improved emitters can be used with the present invention. Each emitter has certain characteristics including different types and have differing power requirements. It is within the contemplation of this invention to adapt the various components of the present invention to accommodate the characteristics of various emitters. In one design, emitters are solid state devices that emit an incoherent beam of light when electrically stimulated. High Output LED emitters generally convert the electrical power that they draw into approximately 25% usable light, which is focused into a cone shaped beam centered around the front center 173 of the emitter (shown in FIG. 15), while the remaining approximately 75% of the power is converted into heat, which exits the emitter 180 degrees opposite the light. This heat, which would otherwise cause the emitters to fail, and reduce the light output, over a short period of time, must be drawn away from the emitter 107 as efficiently as possible.

It has been found that by spacing the LEDs on the emitter board closely together as described below, the smaller the light source and the more control may be had over the optics. Because of the limitation on the lumen output per emitter, in some cases a greater number of emitters are needed on different faces of the tower to deliver the output required for the particular lighting configuration and lighting distribution. In the case where a great amount of light is required, an array 111, such as the array 111*b* shown in FIG. 12A, of emitters with a substantial number of emitters 107 is needed. This enlarges the profile of the light source requiring new and different ways of optically controlling the light when compared to a single light source.

The optics for emitters and single light sources are different. Placing the individual emitters in an array as close together as physically possible is not an option either, because grouping the emitters too close would have an adverse effect on the heat dissipation capacity of the heat sink. The design of the present invention groups as large a number of emitters together as possible while still enabling adequate heat dissipation and optical control.

The array patterns 111 of the emitters of the present invention, although they may be of different shapes and sizes per face, all have the center points 190 of their arrays 111 located at substantially the same vertical distance "XB" from the bottom 126 of the vertical tower as seen for example in FIGS. 4 and 12A.

As shown in FIG. 12A-12D, the arrays 111*a*-111*h* of the emitters 107 on each of the emitter boards 130*a*-130*h*, as noted in conjunction with their respective emitter boards 109*a*-109*h* are grouped as close together as possible to maximize the controllability of the generated light. This close grouping generates very high temperatures in a relatively small area. It is this heat which necessitates the need for an efficient heat dissipation system. It has been found that the best close grouping of the emitters is positioning them a horizontal distance "x" as shown in FIG. 12A. The horizontal distance is determined by the amount of heat generated by the emitter. For the emitter described above it has been found that the horizontal distance "x" is preferably from between about 0.4 inch to 0.7 inch as the distance between the emitters from each other in the horizontal direction. The emitters are positioned in a vertical distance "y" so that they are positioned between the upper and lower surfaces of the baffles as will be described. The vertical distance is determined by vertical distances of the emitters from the light center points 190 (190*a*-190*h*) and the configuration of the curve defining the light output of the emitter. For the emitter described herein, it has been found that the vertical distance "y" is preferably from between about 0.6 inch to 1.0 inch as the distance between the emitters from each other in the vertical direction. As will be further described, the fixture has baffles with upper and lower surfaces to control the direction of the light. It should be understood that the vertically adjacent emitters may be positioned any distance "x" from each other but are vertically spaced a distance "y" from each other.

The arrays 111 are located on the tower in such a way that there is at least as much empty space on a given tower face 130*a*-130*h* above the array as there is below the array. If the array is located vertically off center on a given face, then it is preferably located closer to the bottom 126 of the tower extrusion. This is to enable the rising cooling medium, that is the air in the center of the tower, to encounter as much heated surface area of the heat sink as possible.

The various emitters 107 are mounted on the respective emitter boards 109 which are mounted to the different faces 130*a*-130*h* of the tower 105 in various configurations and numbers and patterns, as shown in FIGS. 11A-11D and FIGS. 12A-12D. Depending on which of the five lighting patterns or configurations or lighting distributions shown in FIG. 10 is desired, the quantity of emitters 107 per face of the multi-sided tower 105 is varied to control the intensity of the light output in a given direction. For example a Type V distribution is a completely symmetrical pattern, and therefore the total number of emitters 107 would be spread evenly over each of the faces or outer surfaces of the tower 105.

FIGS. 11A and 12A show the configuration of emitters on each side 130*a*-130*h* of the tower for the light distribution for a 8000 Series Fixture IESNA Type III. As seen in FIG. 10 an IESNA Type 3 configuration provides positioning the lighting fixture along one side 167 of the roadway 165 with a greater amount of light directed along the roadway in both directions and with a lesser amount of light on areas adjacent the roadway. Since the fixture is positioned on one side of the roadway, a greater number of emitters are provided in a direction along the roadway with 18 emitters in each direction of the emitter boards 130*b* and 130*h*. Nine emitters are mounted on emitter boards 130*a* and 130*h* since additional light is required to reach across the roadway 165 on the side 166 opposite to the side 167 that the fixture is mounted. Emitter boards 130*c* and 130*f* face generally along the side 167 and behind the roadway 165 on the side of the roadway that the fixture is mounted on and the amount of light required to meet IESNA Type III requirements is not as great in this direction. Emitter boards 130*d* and 130*e* having 1 emitter each face generally behind the roadway on the side of the roadway that the fixture is mounted on and the amount of light required to meet IESNA Type III requirements is nominal.

As can be seen in FIGS. 7 and 12A, the printed circuits 144 on each of the emitter boards 130*a*-130*h* carry electrical power thru their electrically conductive terminal sections 147-148 to the terminal pads 151-153 which are interconnected by the emitters mounted thereon to complete the electrical circuit as a known series circuit.

The array patterns 111 of the LEDs of the present invention, although they may be of different shapes and sizes per face, all have the light center points 190*a*-190*h* of their respective arrays 111*a*-111*h* located at substantially the same vertical distance "XB" from the bottom 126 of the vertical tower as seen for example in FIGS. 4 and 12A. The vertical distance "ZT" from the light center points 190*a*-190*h* of the arrays 111*a*-111*h* to the top 124 of the vertical tower is equal or preferably greater than the vertical distance "ZB". By locating the light center points 190*a*-190*h* of the arrays 111*a*-111*h* closer to the bottom of the tower enables the rising cooling medium, that is the air in the cooling aperture 168 of the tower, to encounter as much heated surface area of the heat sink as possible. Accordingly, the lighting center points 190*a*-190*h* position is adapted to be located closer to the bottom of the tower than the top of the tower. For ease of description, it should be understood that the design parameters described in connection with FIGS. 11A and 12A are not described in detail with respect to every array described herein but all of the arrays of the present invention are designed in accordance with these design parameters.

FIGS. 11B and 12B show the configuration of emitters on each side of the tower for the light distribution for a 5000 Series Fixture IESNA Type III. The difference between the 5000 Series Fixture IESNA Type II and the 8000 Series described above in connection with FIGS. 11A and 12A is the amount of light output. The same description in connection with the configuration of the LEDs in a Series 8000 Fixture (FIGS. 11A, 12A) is applicable to the 5000 Series fixture (11B, 12B) except that less emitters are required to achieve the desired lumen output.

FIGS. 11C and 12C show the number of emitters on each side of the tower for the light distribution for a 8000 Series Fixture IESNA Type V. IESNA Type V shows a lighting fixture mounted in the center of a roadway with uniform distribution of the light output around the fixture. Since a substantially equal number of emitters are mounted on each of the emitter boards, the light emitted by the fixture is substantially equal in each direction. It should be understood that the electrical components may not readily allow for exactly the same number of emitters. For example the driver in a commercially viable fixture may necessitate providing a substantially equal number of emitters on each board. As can be seen in FIG. 12C, the printed circuits on each of the emitter boards carry electrical power to each of the emitters mounted on each respective emitter board in a series circuit.

FIGS. 11D and 12D show the configuration of emitters on each side of the tower for the light distribution for a 5000 Series Fixture IESNA Type V. The difference between the 5000 Series Fixture IESNA Type V and the 8000 Series described above in connection with FIGS. 11C and 12C is the amount of light output. The same description in connection with the configuration of the LEDs in a Series 8000 Fixture (FIGS. 11C, 12C) is applicable to the 5000 Series fixture (11D, 12D) except that less emitters are required to achieve the desired lumen output.

The emitter board printed board circuit 144 described above requires various emitter boards having different circuitry depending on the number of LEDs on each particular emitter board. While these designs have been provided to simplify the understanding of the present invention, in some cases where a wide variety of circuits on the emitter board is necessary, it is preferable to provide a circuit 144 on the emitter boards that is designed to allow differing numbers of emitters to be mounted on the emitter board without requiring different printed circuitry as shown in FIGS. 13A and 13B.

The number and location of LEDs 107 on each emitter board 109 varies with the desired illumination and distribution of light, as discussed above and shown in FIGS. 11A through 11D and FIGS. 12A through 12D. And as the number and location of LEDs 107 on each emitter board 109 varies, different emitter board printed board circuits 144 are required to electrically connect LEDs 107 to their power source, driver 115.

The cost of design, manufacture, inventory and maintenance of emitter boards 109 may be substantially reduced by providing an emitter 109 that carries a variable and selectable number of LEDs 107, as required by the application. For example, in the exemplary embodiment of the emitter board shown in FIG. 13A, designated with the numeral 109', either eighteen or twelve LEDs are mounted and operate on that emitter board. Similarly, in the exemplary embodiment of the emitter board shown in FIG. 13B, designated with the numeral 109", from one through nine LEDs 107 are mounted and operate on that emitter board. In order to provide emitter boards that have such variable number of LEDs, the emitter board printed board circuits 144' and 144" employ a plurality of on board switches in which jumpers are formed from zero ohm resistors which are bonded to pads on the circuit accordingly defining a circuit. The on board switches route the current to the preselected number of LED 107 on emitter boards 109' and 109".

Figure 13A:
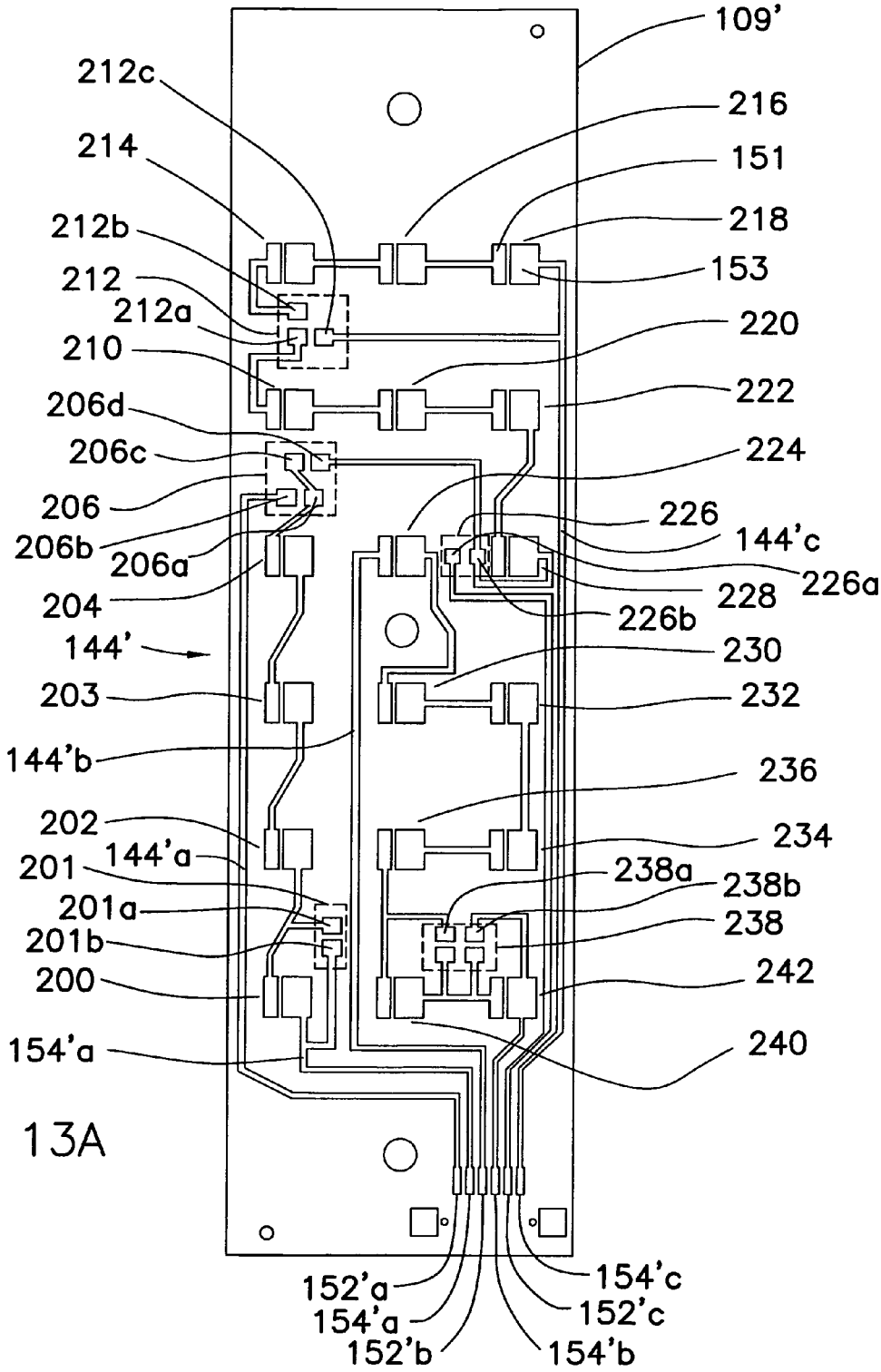
FIG. 13A is a schematic side view of an emitter board.
Figure 13B:
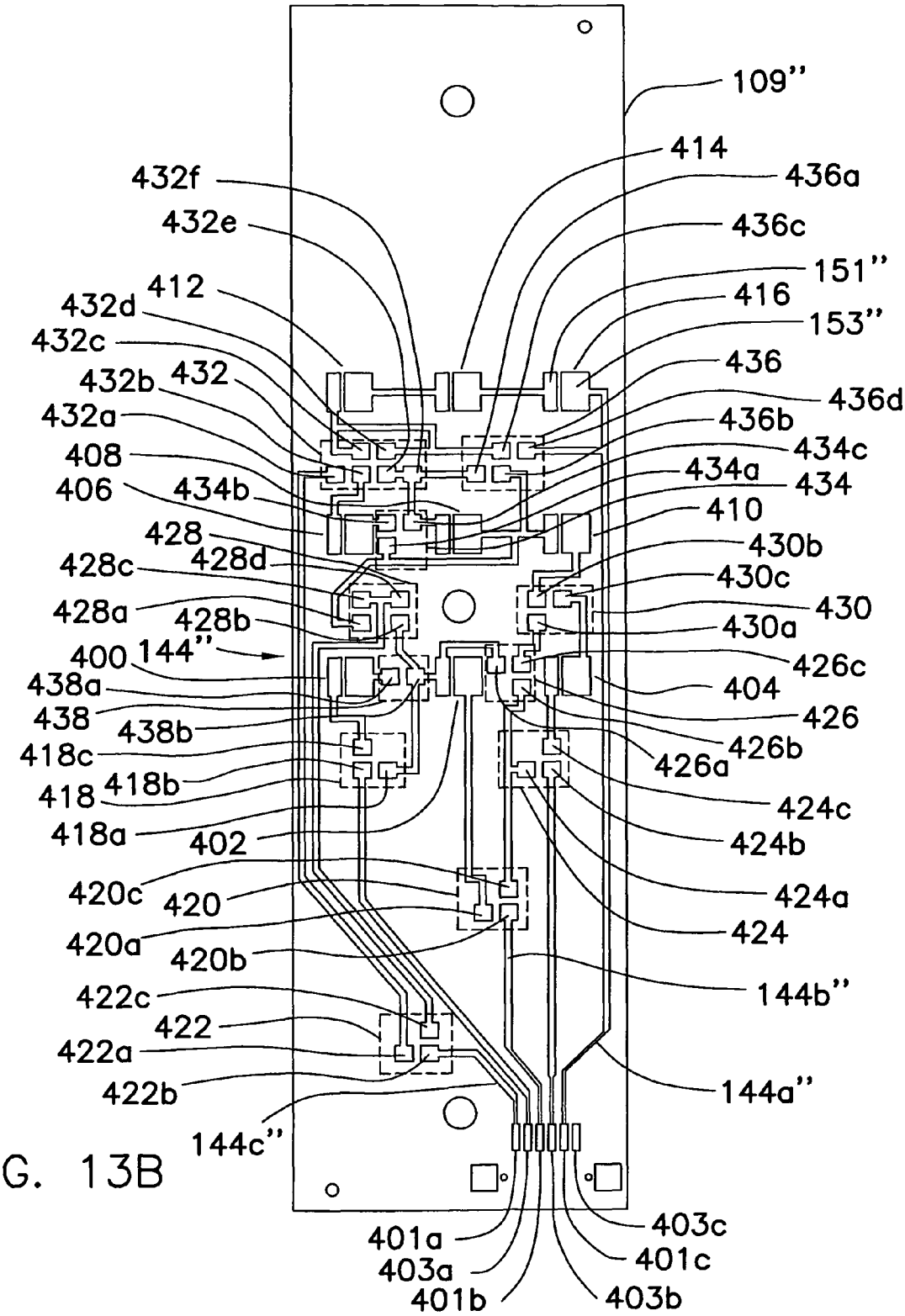
FIG. 13B is a schematic side view of another emitter board.

Exemplary emitter board 109' shown in FIG. 13A is numbered with numerals that are the same as the number used for like parts in connection with the emitter board 109, followed by a prime (') mark The emitter board 109' shown in FIG. 13A has a printed circuit 144' on the emitter board that is designed to allow differing numbers of LEDs, either eighteen or twelve LED emitters, to be mounted on the emitter board without requiring different printed circuitry. The printed circuit 144' has three basic circuits, 144'*a*, 144'*b* and 144'*c*. Circuits, 144'*a*, 144'*b* and 144'*c* each have conductors 152'*a*, 152'*b*, 152'*c* and conductors 154'*a*, 154'*b* and 154'*c* respectively conducting electrical power to the LED emitters associated with that circuit. Each of the circuits receive electrical power from a driver as described in connection with the driver 115 shown in FIGS. 3 and 6. Conductors 152'*a*, 152'*b*, 152'*c* receive power from one side of the driver and conductors 154'*a*, 154'*b* and 154'*c* receive power from the other side of the driver 115.

The emitter board 109' as shown in FIG. 13A is designed so that the circuitry can be modified by way of on board switches 201, 206, 226, and 238, such that the single emitter board 109' can be used for an eighteen LED emitter board assembly having LED emitters mounted in positions 200, 202, 203, 204, 210, 214, 216, 218, 220, 222, 224, 228, 230, 232, 236, 234, 240, and 242, as well as a twelve LED emitter board assembly having LED emitters mounted in positions 202, 203, 204, 210, 220, 222, 224, 228, 230, 232, 236, and 234. The on board switches 212, 206, 226, and 238 are closed by means of a zero ohm resistor placed on the emitter circuit board such that it connects two of the conducting pads such as 201*a* and 201*b*.

In the context of the eighteen LED emitter version, when power is provided to conductors 154'*c* and 152'*c* of circuit 144'*c*, power flows through the conductor 154'*c* to LED position 218 where there are terminal pads 151' and 153'. It should be understood that each of the LED positions described in connection with the circuit 144' have terminal pads 151' and 153' for mounting an LED emitter thereon as described in connection with the terminal pads 151, 153. If an LED emitter is mounted in LED position 218, the electrical power is conducted there through and conducted by circuit 144' to LED position 216. If an LED emitter is mounted in LED position 216, the electrical power is conducted there through and conducted by circuit 144' to LED position 214 and subsequently through to on board switch 212.

In the context of the eighteen emitter version, a zero ohm resistor is mounted to the circuit board such that the conducting pads 212*b* and 212*a* are electrically connected, the electrical power is conducted there through and conducted by circuit 144' to LED position 210. If an LED emitter is mounted in LED position 210, the electrical power is conducted there through and conducted by circuit 144' to LED position 220. If an LED emitter is mounted in LED position 220, the electrical power is conducted there through and conducted by circuit 144' to LED position 222. If an LED emitter is mounted in LED position 222, the electrical power is conducted there through and conducted by circuit 144' to LED position 228. If an LED emitter is mounted in LED position 228, the electrical power is conducted there through and conducted by circuit 144' to on board switch 226.

In the context of the eighteen LED emitter version, a zero ohm resistor is mounted to the circuit board such that the conducting pads 226*b* and 226*a* are electrically connected, the electrical power is conducted there through and conducted by circuit 144' to conductor 152'*c*, thus closing circuit 144'*c*. In the context of the eighteen LED emitter version the LED emitters mounted in positions 210, 220, 222, and 228 are rotated 180 degrees such that the polarity of the anode and cathode of LED emitters in those positions are reversed in relation to the anode and cathode of LED emitters mounted in positions 214, 216, and 218, thus maintaining the correct relationship between the anodes and cathodes of all seven of the LED emitters in circuit 144'*c*.

In the context of the eighteen LED emitter version, when power is provided to conductors 154'*b* and 152'*b* of circuit 144'*b*, power flows through the conductor 154'*b* to LED position 242. If an LED emitter is mounted in LED position 242, the electrical power is conducted there through and conducted by circuit 144' to LED position 240. If an LED emitter is mounted in LED position 240, the electrical power is conducted there through and conducted by circuit 144' to LED position 236. If an LED emitter is mounted in LED position 236, the electrical power is conducted there through and conducted by circuit 144' to LED position 234. If an LED emitter is mounted in LED position 234, the electrical power is conducted there through and conducted by circuit 144' to LED position 232. If an LED emitter is mounted in LED position 232, the electrical power is conducted there through and conducted by circuit 144' to LED position 230. If an LED emitter is mounted in LED position 230, the electrical power is conducted there through and conducted by circuit 144' to LED position 224. If an LED emitter is mounted in LED position 224, the electrical power is conducted there through and conducted by circuit 144' to conductor 152'*b* thus closing circuit 144'*b*.

In the context of the eighteen LED emitter version, the LED emitters mounted in positions 236, 234, 232, 230 and 224 are rotated 180 degrees such that the polarity of the anode and cathode of LED emitters in those positions are reversed in relation to the anode and cathode of LED emitters mounted in positions 240 and 242, thus maintaining the correct relationship between the anodes and cathodes of all seven of the LED emitters in circuit 144'*b*.

In the context of the eighteen LED emitter version, when power is provided to conductors 154'*a* and 152'*a* of circuit 144'*a*, power flows through the conductor 154'*a* to LED position 200. If an LED emitter is mounted in LED position 200, the electrical power is conducted there through and conducted by circuit 144' to LED position 202. If an LED emitter is mounted in LED position 202, the electrical power is conducted there through and conducted by circuit 144' to LED position 203. If an LED emitter is mounted in LED position 203, the electrical power is conducted there through and conducted by circuit 144' to LED position 204. If an LED emitter is mounted in LED position 204, the electrical power is conducted there through and conducted by circuit 144' to on board switch 206. In the context of the eighteen LED emitter version, a zero ohm resistor is mounted to the circuit board such that the conducting pads 206*a* and 206*b* are electrically connected, the electrical power is conducted there through and conducted by circuit 144' to conductor 152'*a* thus closing circuit 144'*a*.

In the context of the twelve LED emitter version, when power is provided to conductors 154'*c* and 154'*a* of circuit 144'*c*, power flows through the conductor 154'*c* to on board switch 212. In the context of the twelve LED emitter version no LED emitters are mounted in LED positions 218, 216 and 214. In the context of the twelve emitter version, a zero ohm resistor is mounted to the circuit board such that the conducting pads 212*c* and 212*a* are electrically connected, the electrical power is conducted there through and conducted by circuit 144' to LED position 210. If an LED emitter is mounted in LED position 210, the electrical power is conducted there through and conducted by circuit 144' to LED position 220. If an LED emitter is mounted in LED position 220, the electrical power is conducted there through and conducted by circuit 144' to LED position 222. If an LED emitter is mounted in LED position 222, the electrical power is conducted there through and conducted by circuit 144' to LED position 228. If an LED emitter is mounted in LED position 228, the electrical power is conducted there through and conducted by circuit 144' to on board switch 226.

In the context of the twelve LED emitter version, no resistor is used in the on board switch 226, thus the electrical power is conducted there through and conducted by circuit 144' to on board switch 206. In the context of the twelve emitter version, a zero ohm resistor is mounted to the circuit board such that the conducting pads 206*d* and 206*c* are electrically connected, the electrical power is conducted there through and conducted by circuit 144' to LED position 204. If an LED emitter is mounted in LED position 204, the electrical power is conducted there through and conducted by circuit 144' to LED position 203. If an LED emitter is mounted in LED position 203, the electrical power is conducted there through and conducted by circuit 144' to LED position 202. If an LED emitter is mounted in LED position 202, the electrical power is conducted there through and conducted by circuit 144' to on board switch 201.

In the context of the twelve emitter version, a zero ohm resistor is mounted to the circuit board such that the conducting pads 201*b* and 201*a* are electrically connected, the electrical power is conducted there through and conducted by circuit 144' to conductor 154'*a*, thus closing circuit 144'*a*.

In the context of the twelve LED emitter version, when power is provided to conductors 154'*b* and 152'*b* of circuit 144'*b*, power flows through the conductor 154'*b* to LED position 242. In the context of the twelve emitter version, no LED emitters are mounted in positions 200, 240 and 242. Thus the electrical power is conducted there through and conducted by circuit 144' to on board switch 238. In the context of the twelve emitter version, a zero ohm resistor is mounted to the circuit board such that the conducting pads 238*b* and 238*a* are electrically connected, the electrical power is conducted there through and conducted by circuit 144' to LED position 236. If an LED emitter is mounted in LED position 236, the electrical power is conducted there through and conducted by circuit 144' to LED position 234. If an LED emitter is mounted in LED position 234, the electrical power is conducted there through and conducted by circuit 144' to LED position 232. If an LED emitter is mounted in LED position 232, the electrical power is conducted there through and conducted by circuit 144' to LED position 230. If an LED emitter is mounted in LED position 230, the electrical power is conducted there through and conducted by circuit 144' to LED position 224. If an LED emitter is mounted in LED position 224, the electrical power is conducted there through and conducted by circuit 144' to conductor 152'*b*, thus closing circuit 144'*b*.

Exemplary emitter board 109" shown in FIG. 13B is numbered with numerals that are the same as the number used for like parts in connection with the emitter board 109, followed by a double prime (") mark The emitter board 109" shown in FIG. 13B provides a printed circuit 144", on the emitter board that is designed to allow differing numbers of LEDs to be mounted on the emitter board without requiring different printed circuitry. The printed circuit 144" has 3 basic circuits, 144*a*", 144*b*" and 144*c*". Each of the circuits, 144*a*", 144*b*" and 144*c*" each have conductors 401*a*, 401*b*, 401*c* and conductors 403*a*, 403*b* and 403*c* respectively conducting electrical power to the LED emitters associated with that circuit. Each of the circuits receives electrical power from a driver as described in connection with the driver 115 shown in FIGS. 3 and 6. Conductors 401*a*, 401*b*, 401*c* may receive power from one side of the driver and conductors 403*a*, 403*b* and 403*c* may receive power from one side of the driver.

The emitter board 109" as shown in FIG. 13B is designed so that the circuitry can be modified by way of on board switches 418, 420, 422, 424, 426, 428, 430, 432, 434, 436 and 438, such that the single emitter board 109" can be used for a nine LED emitter board assembly having LED emitters mounted in positions 400, 402, 404, 406, 408, 410, 412, 414, and 416, as well as an eight LED emitter board assembly having LED emitters mounted in positions 400, 404, 406, 408, 410, 412, 414 and 416, as well as a seven LED emitter board assembly having LED emitters mounted in positions 402, 406, 408, 410, 412, 414 and 416, as well as a six LED emitter board assembly having LED emitters mounted in positions 406, 408, 410, 412, 414 and 416, as well as a five LED emitter board assembly having LED emitters mounted in positions 406, 410, 412, 414 and 416, as well as a four LED emitter board assembly having LED emitters mounted in positions 406, 408, 410 and 402, as well as a three LED emitter board assembly having LED emitters mounted in positions 406, 408 and 410, as well as a two LED emitter board assembly having LED emitters mounted in positions 406 and 410, as well as a single LED emitter board assembly having an LED emitter mounted in position 408. The on board switches 418, 420, 422, 424, 426, 428, 430, 432, 434, 436 and 438 are closed by means of a zero ohm resistor placed on the emitter circuit board such that it connects two of the conducting pads such as 418*a* and 418*b*.

In the context of the nine and eight LED emitter version, when power is provided to conductors 401*c* and 403*b* of circuit 144*a*", power flows through the conductor 401*c* to LED position 416 where there are terminal pads 151" and 153". It should be understood that each of the LED positions described in connection with the circuit 144" have terminal pads 151" and 153" for mounting an LED emitter thereon as described in connection with the terminal pads 151, 153. If an LED emitter is mounted in LED position 416, the electrical power is conducted there through and conducted by circuit 144" to LED position 414. If an LED emitter is mounted in LED position 414, the electrical power is conducted there through and conducted by circuit 144" to LED position 412 and subsequently to on board switch 432. In the context of the nine and eight LED emitter version, a zero ohm resistor is mounted to the circuit board such that the conducting pads 432*c* and 432*b* are electrically connected, the electrical power is conducted there through and conducted by circuit 144" to LED position 406. If an LED emitter is mounted in LED position 406, the electrical power is conducted there through to on board switch 434. In the context of the nine and eight LED emitter version, a zero ohm resistor is mounted to the circuit board such that the conducting pads 434*b* and 434*c* are electrically connected, the electrical power is conducted there through and conducted by circuit 144" to LED position 408. If an LED emitter is mounted in LED position 408, the electrical power is conducted there through and conducted by circuit 144" to LED position 410. If an LED emitter is mounted in LED position 410, the electrical power is conducted there through and conducted by circuit 144" to on board switch 430. In the context of the nine and eight LED emitter version, a zero ohm resistor is mounted to the circuit board such that the conducting pads 430*b* and 430*c* are electrically connected, the electrical power is conducted there through and conducted by circuit 144" to LED position 404. If an LED emitter is mounted in LED position 404, the electrical power is conducted there through and conducted by circuit 144" to on board switch 424. In the context of the nine and eight LED emitter version, a zero ohm resistor is mounted to the circuit board such that the conducting pads 424*c* and 424*b* are electrically connected, the electrical power is conducted there through and conducted by circuit 144" to conductor 403*b*, thus closing circuit 144*a*". In the context of the nine and eight LED emitter version the LED emitters mounted in positions 406, 408 and 410 are rotated 180 degrees such that the polarity of the anode and cathode of LED emitters in those positions are reversed in relation to the anode and cathode of LED emitters mounted in positions 404, 412, 414 and 416, thus maintaining the correct relationship between the anodes and cathodes of all seven of the LED emitters in circuit 144*a*".

In the context of the nine LED emitter version, when power is provided to conductors 401*b* and 403*a* of circuit 144*b*", power flows through the conductor 401*b* to on board switch 420. In the context of the nine LED emitter version, a zero ohm resistor is mounted to the circuit board such that the conducting pads 420*b* and 420*a* are electrically connected, the electrical power is conducted there through and conducted by circuit 144" to LED position 402. If an LED emitter is mounted in LED position 402, the electrical power is conducted there through and conducted by circuit 144" to on board switch 438. In the context of the nine LED emitter version, a zero ohm resistor is mounted to the circuit board such that the conducting pads 438*b* and 438*a* are electrically connected, the electrical power is conducted there through and conducted by circuit 144" to LED position 400. If an LED emitter is mounted in LED position 400, the electrical power is conducted there through and conducted by circuit 144" to on board switch 418. In the context of the nine LED emitter version, a zero ohm resistor is mounted to the circuit board such that the conducting pads 418*c* and 418*b* are electrically connected, the electrical power is conducted there through and conducted by circuit 144" to conductor 403*a* thus closing circuit 144*b*".

In the context of the eight LED emitter version, when power is provided to conductors 403*a* and 401*a* of circuit 144*c*", power flows through the conductor 403*a* to onboard switch 418. In the context of the eight LED emitter version, a zero ohm resistor is mounted to the circuit board such that the conducting pads 418*b* and 418*c* are electrically connected, the electrical power is conducted there through and conducted by circuit 144" to LED position 400. If an LED emitter is mounted in LED position 400, the electrical power is conducted there through and conducted by circuit 144" to on board switch 438. In the context of the eight emitter version, a zero ohm resistor is mounted to the circuit board such that the conducting pads 438*a* and 438*b* are electrically connected, the electrical power is conducted there through and conducted by circuit 144" to on board switch 428. In the context of the eight LED emitter version, a zero ohm resistor is mounted to the circuit board such that the conducting pads 428*d* and 428*b* are electrically connected, the electrical power is conducted there through and conducted by circuit 144" to on board switch 422. In the context of the eight LED emitter version, a zero ohm resistor is mounted to the circuit board such that the conducting pads 422*c* and 422*b* are electrically connected, the electrical power is conducted there through and conducted by circuit 144" to conductor 401*a*, thus closing circuit 144*c*".

In the context of the seven LED emitter version, when power is provided to conductors 401*c* and 403*b* of circuit 144*a*", power flows through the conductor 401*c* to LED position 416 where there are terminal pads 151" and 153". It should be understood that each of the LED positions described in connection with the circuit 144" have terminal pads 151" and 153" for mounting an LED emitter thereon as described in connection with the terminal pads 151, 153. If an LED emitter is mounted in LED position 416, the electrical power is conducted there through and conducted by circuit 144" to LED position 414. If an LED emitter is mounted in LED position 414, the electrical power is conducted there through and conducted by circuit 144" to LED position 412 and subsequently through to on board switch 432. In the context of the seven LED emitter version, a zero ohm resistor is mounted to the circuit board such that the conducting pads 432*c* and 432*b* are electrically connected, the electrical power is conducted there through and conducted by circuit 144" to LED position 406. If an LED emitter is mounted in LED position 406, the electrical power is conducted there through to on board switch 434. In the context of the seven LED emitter version, a zero ohm resistor is mounted to the circuit board such that the conducting pads 434*b* and 434*c* are electrically connected, the electrical power is conducted there through and conducted by circuit 144" to LED position 408. If an LED emitter is mounted in LED position 408, the electrical power is conducted there through and conducted by circuit 144" to LED position 410. If an LED emitter is mounted in LED position 410, the electrical power is conducted there through and conducted by circuit 144" to on board switch 430. In the context of the seven LED emitter version, a zero ohm resistor is mounted to the circuit board such that the conducting pads 430*b* and 430*a* are electrically connected, the electrical power is conducted there through and conducted by circuit 144" to on board switch 426. In the context of the seven LED emitter version, a zero ohm resistor is mounted to the circuit board such that the conducting pads 426*c* and 426*b* are electrically connected, the electrical power is conducted there through and conducted by circuit 144" to on board switch 424. In the context of the seven LED emitter version, a zero ohm resistor is mounted to the circuit board such that the conducting pads 424*a* and 424*b* are electrically connected, the electrical power is conducted there through and conducted by circuit 144" to conductor 403*b*, thus closing circuit 144*a*". In the context of the seven LED emitter version the LED emitters mounted in positions 406, 408, and 410 are rotated 180 degrees such that the polarity of the anode and cathode of LED emitters in those positions are reversed in relation to the anode and cathode of LED emitters mounted in positions 402, 412, 414 and 416, thus maintaining the correct relationship between the anodes and cathodes of all seven of the LED emitters in circuit 144*a*".

In the context of the seven LED emitter version, when power is provided to conductors 401*b* and 403*a* of circuit 144*b*", power flows through the conductor 401*b* to on board switch 420. In the context of the seven LED emitter version, a zero ohm resistor is mounted to the circuit board such that the conducting pads 420*b* and 420*a* are electrically connected, the electrical power is conducted there through and conducted by circuit 144" to LED position 402. If an LED emitter is mounted in LED position 402, the electrical power is conducted there through and conducted by circuit 144" to on board switch 418. In the context of the seven LED emitter version, a zero ohm resistor is mounted to the circuit board such that the conducting pads 418*a* and 418*b* are electrically connected, the electrical power is conducted there through and conducted by circuit 144" to conductor 403*a*, thus closing circuit 144*b*".

In the context of the six LED emitter version, when power is provided to conductors 401*c* and 403*b* of circuit 144*a*", power flows through the conductor 401*c* to LED position 416 where there are terminal pads 151" and 153". It should be understood that each of the LED positions described in connection with the circuit 144" have terminal pads 151" and 153" for mounting an LED emitter thereon as described in connection with the terminal pads 151, 153. If an LED emitter is mounted in LED position 416, the electrical power is conducted there through and conducted by circuit 144" to LED position 414. If an LED emitter is mounted in LED position 414, the electrical power is conducted there through and conducted by circuit 144" to LED position 412 and subsequently through to on board switch 432. In the context of the six LED emitter version, a zero ohm resistor is mounted to the circuit board such that the conducting pads 432*c* and 432*b* are electrically connected, the electrical power is conducted there through and conducted by circuit 144" to LED position 406.

If an LED emitter is mounted in LED position 406, the electrical power is conducted there through to on board switch 434. In the context of the six LED emitter version, a zero ohm resistor is mounted to the circuit board such that the conducting pads 434*b* and 434*c* are electrically connected, the electrical power is conducted there through and conducted by circuit 144" to LED position 408. If an LED emitter is mounted in LED position 408, the electrical power is conducted there through and conducted by circuit 144" to LED position 410. If an LED emitter is mounted in LED position 410, the electrical power is conducted there through and conducted by circuit 144" to on board switch 430. In the context of the six LED emitter version, a zero ohm resistor is mounted to the circuit board such that the conducting pads 430*b* and 430*a* are electrically connected, the electrical power is conducted there through and conducted by circuit 144" to on board switch 426. In the context of the six LED emitter version, a zero ohm resistor is mounted to the circuit board such that the conducting pads 426*c* and 426*b* are electrically connected, the electrical power is conducted there through and conducted by circuit 144" to on board switch 424. In the context of the six LED emitter version, a zero ohm resistor is mounted to the circuit board such that the conducting pads 424*a* and 424*b* are electrically connected, the electrical power is conducted there through and conducted by circuit 144" to conductor 403*b*, thus closing circuit 144*a*". In the context of the six LED emitter version the LED emitters mounted in positions 406, 408, and 410 are rotated 180 degrees such that the polarity of the anode and cathode of LED emitters in those positions are reversed in relation to the anode and cathode of LED emitters mounted in positions 412, 414 and 416, thus maintaining the correct relationship between the anodes and cathodes of all six of the LED emitters in circuit 144*a*".

In the context of the five LED emitter version, when power is provided to conductors 401*c* and 403*b* of circuit 144*a*", power flows through the conductor 401*c* to LED position 416 where there are terminal pads 151" and 153". It should be understood that each of the LED positions described in connection with the circuit 144" have terminal pads 151" and 153" for mounting an LED emitter thereon as described in connection with the terminal pads 151, 153. If an LED emitter is mounted in LED position 416, the electrical power is conducted there through and conducted by circuit 144" to LED position 414. If an LED emitter is mounted in LED position 414, the electrical power is conducted there through and conducted by circuit 144" to LED position 412 and subsequently through to on board switch 436. In the context of the five LED emitter version, a zero ohm resistor is mounted to the circuit board such that the conducting pads 436*c* and 436*b* are electrically connected, the electrical power is conducted there through and conducted by circuit 144" to LED position 410. If an LED emitter is mounted in LED position 410, the electrical power is conducted there through and conducted by circuit 144" to on board switch 430. In the context of the five LED emitter version, a zero ohm resistor is mounted to the circuit board such that the conducting pads 430*b* and 430*a* are electrically connected, the electrical power is conducted there through and conducted by circuit 144" to on board switch 426. In the context of the five LED emitter version, a zero ohm resistor is mounted to the circuit board such that the conducting pads 426*c* and 426*b* are electrically connected, the electrical power is conducted there through and conducted by circuit 144" to on board switch 424. In the context of the five LED emitter version, a zero ohm resistor is mounted to the circuit board such that the conducting pads 424*a* and 424*b* are electrically connected, the electrical power is conducted there through and conducted by circuit 144" to conductor 403*b*, thus closing circuit 144*a*". In the context of the five LED emitter version the LED emitter mounted in position 410 is rotated 180 degrees such that the polarity of the anode and cathode of LED emitters in those positions are reversed in relation to the anode and cathode of LED emitters mounted in positions 412, 414 and 416, thus maintaining the correct relationship between the anodes and cathodes of all four of the LED emitters in circuit 144*a*".

In the context of the five LED emitter version, when power is provided to conductors 401*a* and 403*a* of circuit 144*c*", power flows through the conductor 401*a* to on board switch 422. In the context of the five emitter version, a zero ohm resistor is mounted to the circuit board such that the conducting pads 422*b* and 422*a* are electrically connected, the electrical power is conducted there through and conducted by circuit 144" to onboard switch 432. In the context of the five emitter version, a zero ohm resistor is mounted to the circuit board such that the conducting pads 432*a* and 432*b* are electrically connected, the electrical power is conducted there through and conducted by circuit 144" to LED position 406. If an LED emitter is mounted in LED position 406, the electrical power is conducted there through and conducted by circuit 144" to on board switch 434. In the context of the five LED emitter version, a zero ohm resistor is mounted to the circuit board such that the conducting pads 434*b* and 434*a* are electrically connected by circuit 144" to on board switch 428. In the context of the five LED emitter version, a zero ohm resistor is mounted to the circuit board such that the conducting pads 428*a* to 428*c* and 428*d* to 428*b* are electrically connected the electrical power is conducted there through and conducted by circuit 144" to onboard switch 418. In the context of the five LED emitter version, a zero ohm resistor is mounted to the circuit board such that the conducting pads 418*a* and 418*b* are electrically connected the electrical power is conducted there through and conducted by circuit 144" to conductor 403*a*, thus closing circuit 144*b*".

In the context of the four LED emitter version, when power is provided to conductors 401*c* and 401*b* of circuit 144*a*", power flows through the conductor 401*c* to on board switch 436. In the context of the four LED emitter version, a zero ohm resistor is mounted to the circuit board such that the conducting pads 436*d* and 436*c* are electrically connected, the electrical power is conducted there through and conducted by circuit 144" to on board switch 432. In the context of the four LED emitter version, a zero ohm resistor is mounted to the circuit board such that the conducting pads 432*c* and 432*b* are electrically connected, the electrical power is conducted there through and conducted by circuit 144" to LED position 406 where there are terminal pads 151" and 153" which are identical in nature to the pads shown on position 416. It should be understood that each of the LED positions described in connection with the circuit 144" have terminal pads 151" and 153" for mounting an LED emitter thereon as described in connection with the terminal pads 151, 153. If an LED emitter is mounted in LED position 406, the electrical power is conducted there through and conducted by circuit 144" to on board switch 434. In the context of the four LED emitter version, a zero ohm resistor is mounted to the circuit board such that the conducting pads 434*b* and 434*c* are electrically connected, the electrical power is conducted there through and conducted by circuit 144" LED position 408. If an LED emitter is mounted in LED position 408, the electrical power is conducted there through and conducted by circuit 144" to LED position 410. If an LED emitter is mounted in LED position 410, the electrical power is conducted there through and conducted by circuit 144" to on board switch 430. In the context of the four LED emitter version, a zero ohm resistor is mounted to the circuit board such that the conducting pads 430*b* and 430*a* are electrically connected, the electrical power is conducted there through and conducted by circuit 144" to on board switch 426. In the context of the four LED emitter version, a zero ohm resistor is mounted to the circuit board such that the conducting pads 426*c* and 426*a* are electrically connected, the electrical power is conducted there through and conducted by circuit 144" to LED position 402. If an LED emitter is mounted in LED position 402, the electrical power is conducted there through and conducted by circuit 144" to on board switch 420. In the context of the four LED emitter version, a zero ohm resistor is mounted to the circuit board such that the conducting pads 420*a* and 420*b* are electrically connected, the electrical power is conducted there through and conducted by circuit 144" to conductor 401*b*, thus closing circuit 144*a"*.

In the context of the three LED emitter version, when power is provided to conductors 401*c* and 401*b* of circuit 144*a"*, power flows through the conductor 401*c* to on board switch 436. In the context of the three LED emitter version, a zero ohm resistor is mounted to the circuit board such that the conducting pads 436*d* and 436*c* are electrically connected, the electrical power is conducted there through and conducted by circuit 144" to on board switch 432. In the context of the three LED emitter version, a zero ohm resistor is mounted to the circuit board such that the conducting pads 432*c* and 432*b* are electrically connected, the electrical power is conducted there through and conducted by circuit 144" to LED position 406 where there are terminal pads 151" and 153" which are identical in nature to the pads shown on position 416. It should be understood that each of the LED positions described in connection with the circuit 144" have terminal pads 151" and 153" for mounting an LED emitter thereon as described in connection with the terminal pads 151, 153. If an LED emitter is mounted in LED position 406, the electrical power is conducted there through and conducted by circuit 144" to on board switch 434. In the context of the three LED emitter version, a zero ohm resistor is mounted to the circuit board such that the conducting pads 434*b* and 434*c* are electrically connected, the electrical power is conducted there through and conducted by circuit 144" LED position 408. If an LED emitter is mounted in LED position 408, the electrical power is conducted there through and conducted by circuit 144" to LED position 410. If an LED emitter is mounted in LED position 410, the electrical power is conducted there through and conducted by circuit 144" to on board switch 430. In the context of the four LED emitter version, a zero ohm resistor is mounted to the circuit board such that the conducting pads 430*b* and 430*a* are electrically connected, the electrical power is conducted there through and conducted by circuit 144" to on board switch 426. In the context of the four LED emitter version, a zero ohm resistor is mounted to the circuit board such that the conducting pads 426*c* and 426*b* are electrically connected, the electrical power is conducted there through and conducted by circuit 144" to on board switch 424. In the context of the three LED emitter version, a zero ohm resistor is mounted to the circuit board such that the conducting pads 420*a* and 420*b* are electrically connected, the electrical power is conducted there through and conducted by circuit 144" to conductor 401*b*, thus closing circuit 144*a"*.

In the context of the two LED emitter version, when power is provided to conductors 401*c* and 401*b* of circuit 144*a"*, power flows through the conductor 401*c* to on board switch 436. In the context of the two LED emitter version, a zero ohm resistor is mounted to the circuit board such that the conducting pads 436*d* and 436*c* are electrically connected, the electrical power is conducted there through and conducted by circuit 144" to on board switch 432. In the context of the two LED emitter version, a zero ohm resistor is mounted to the circuit board such that the conducting pads 432*c* and 432*a* are electrically connected, the electrical power is conducted there through and conducted by circuit 144" to LED position 406 where there are terminal pads 151" and 153" which are identical in nature to the pads shown on position 416. It should be understood that each of the LED positions described in connection with the circuit 144" have terminal pads 151" and 153" for mounting an LED emitter thereon as described in connection with the terminal pads 151, 153. If an LED emitter is mounted in LED position 406, the electrical power is conducted there through and conducted by circuit 144" to on board switch 434. In the context of the two LED emitter version, a zero ohm resistor is mounted to the circuit board such that the conducting pads 434*b* and 434*c* are electrically connected, the electrical power is conducted there through and conducted by circuit 144" to on board switch 436. In the context of the two LED emitter version, a zero ohm resistor is mounted to the circuit board such that the conducting pads 436*a* and 436*b* are electrically connected, the electrical power is conducted there through and conducted by circuit 144" to LED position 410. If an LED emitter is mounted in LED position 410, the electrical power is conducted there through and conducted by circuit 144" to on board switch 430. In the context of the two LED emitter version, a zero ohm resistor is mounted to the circuit board such that the conducting pads 430*b* and 430*a* are electrically connected, the electrical power is conducted there through and conducted by circuit 144" to on board switch 426. In the context of the two LED emitter version, a zero ohm resistor is mounted to the circuit board such that the conducting pads 426*c* and 426*b* are electrically connected, the electrical power is conducted there through and conducted by circuit 144" to on board switch 424. In the context of the two LED emitter version, a zero ohm resistor is mounted to the circuit board such that the conducting pads 424*c* and 424*b* are electrically connected, the electrical power is conducted there through and conducted by circuit 144" to conductor 403*b* thus closing circuit 144*a"*.

In the context of the single LED emitter version, when power is provided to conductors 401*c* and 401*a* of circuit 144*a"*, power flows through the conductor 401*c* to on board switch 436. In the context of the single LED emitter version, a zero ohm resistor is mounted to the circuit board such that the conducting pads 436*d* and 436*c* are electrically connected, the electrical power is conducted there through and conducted by circuit 144" to on board switch 432. In the context of the single LED emitter version, a zero ohm resistor is mounted to the circuit board such that the conducting pads 432*d* and 432*e* are electrically connected, the electrical power is conducted there through and conducted by circuit 144" to LED position 408 where there are terminal pads 151" and 153" which are identical in nature to the pads shown on position 416. It should be understood that each of the LED positions described in connection with the circuit 144" have terminal pads 151" and 153" for mounting an LED emitter thereon as described in connection with the terminal pads 151, 153. If an LED emitter is mounted in LED position 408, the electrical power is conducted there through and conducted by circuit 144" to on board switch 428. In the context of the Single LED emitter version, a zero ohm resistor is mounted to the circuit board such that the conducting pads 428*a* and 428*c* are electrically connected, the electrical power is conducted there through and conducted by circuit 144" to on board switch 422. In the context of the Single LED emitter version, a zero ohm resistor is mounted to the circuit board such that the conducting pads 422*c* and 422*b* are electrically connected, the electrical power is conducted there through and conducted by circuit 144" to conductor 401*a* thus closing circuit 144*a"*.

The above addresses the amount of light created by the fixture in predetermined directions. The fixture 100 of the present also has optical baffle assembly 300 as shown in FIGS. 14A-14C which controls the horizontal distribution of light radiated by the fixture of the present invention. The above description has not included a description of the baffle assembly 300 to provide a more clear understanding of the emitter array 111 and emitter mounting in the lighting fixture of the present invention.

The fixture 100 has optical baffle assemblies 300 mounted to each of the emitter boards 109*a*-109*h* which are mounted to the respective sides 130*a*-130*h* of the tower. The optical baffle assembly 300 includes a frame 302 having upper and lower mounting members 304, 306 and side members 308 interconnecting the ends 310, 312 of each of the mounting members 304, 306 respectively. The upper and lower mounting members 304, 306 have an aperture 314 therein for attaching the optical baffle assembly 300 to the emitter boards 109 and consequently the tower as shown in FIGS. 8 and 14A-14C.

The optical baffle assembly 300 also has a number of optical baffles 316 (including 316*a*-316*f*) extending between the side members 308 as shown in FIGS. 14A-14C and 15. Each of the optical baffles 316 have an inner upper surface 318 extending from the upper inner end 320 to an outer upper surface 322. The upper surfaces 318, 322 join each other at the edge 321. The outer upper surface 322 extends outwardly therefrom and terminates in an outer end 324. Each of the optical baffles 316 have a lower surface 326 extending from the lower inner end 328 to the outer end 324. The surfaces 318, 322 and 326 are configured to achieve the desired control of the direction of light as described more fully below.

A series of optical baffles 316*a*-316*f* are provided on each optical baffle assembly 300 shown in FIGS. 14A-14C. The distance between the lower inner end 328 of one baffle, for example baffle 316*b*, is spaced from and positioned a distance 330 from the upper inner end 320 of the optical baffle 316*c* positioned immediately below baffle 316*b* and defines a baffle emitter aperture 331. The lower inner end 328*b* of the upper baffle 316*b* is positioned above and adjacent to the emitter and the upper inner end 320*c* of the lower baffle 316*c* is positioned below and adjacent to the emitter. It should be understood that the baffles 316*a*-316*f* are similarly positioned with respect to each other.

Adjacent the lower mounting member 306 is a bottom baffle member 332 which has an upper surface 318 extending from the upper inner end 320 and terminates in the lower outer end 334. The bottom baffle member 332 is positioned below the baffle 316*f* and is positioned as described above in connection with baffle 316*b* and baffle 316*c* and has an emitter aperture 331 between the baffles 316*f* and 332. The shape of the surfaces 318, 322, 326 are configured to control the light emitted from the emitters 107 as will be described below.

To secure optical baffle assembly 300 to the emitter board 109 as shown in FIGS. 8 and 14A-14C, an attachment device 160, such as the threaded fastener, extends through the apertures 314 in the upper and lower mounting members 304, 306. The threaded fastener 160 extends through the aperture 162 in the emitter board and threadedly engages the threaded aperture 164 in the tower to secure the optical baffle assembly 300 to the emitter board 109 and the tower. The apertures 314 are positioned so that the emitters 107 mounted on the emitter boards 109 are positioned in the emitter apertures 331 as defined by the distance 330 between the upper inner end 320 and the lower inner end 328 of adjacent baffles.

The side members 308 are provided not only to support the baffles 316 on their ends 336, 338 but also to control the direction of the light emitted by the emitters 107 in a direction toward the side members 308. The longitudinal ends 336, 338 of the baffles 316 are formed integrally with the side members 308 so that the baffles 316 adjacent each other are provided with a aperture 331 in which the emitters 107 on their respective emitter boards are received. The baffles 316 are positioned so that the upper inner end 320, outer end 324, and lower inner end 328 are in a substantially horizontal direction.

Each of the side members 308 have a side reflective surface 340 extending from an inner end 342 to and outer end 344 as shown in FIG. 14A-14C. The side reflective surfaces 340 of each of the side members extend between each of the longitudinal ends 336, 338 of the baffles 316 on each end 336, 338 of the baffles. These vertical side reflective surfaces 340 are used to control the horizontal distribution of the light in such a way that the amount of light which is visible and measurable in the vertical direction above a degrees above nadir is kept as small as possible. This reduces the effects of light pollution due to stray light above the cutoff angle $\alpha$. In the baffles 316 shown in FIGS. 14A-17, the angle $\alpha$ is shown as 70°. The maximum cutoff angle $\alpha$ range is from about between 55 and 75°. Any cutoff angle greater than 75° produces too much glare. Any cutoff angle less than 55° does not give enough horizontal throw of the light to provide a competitive fixture. If an adequate amount of light is not being thrown far enough across the horizontal plane from the luminarie, the required spacing of two or more luminarie's is not great enough to make the luminarie competitive. The preferred cut off angle is from between about 60 to 70°, except when additional horizontal throw of the light is necessary depending on the lighting configuration as will be described. In that case, the preferred cut off angle is from between about 60 to 75°.

The inner end 342 of the surface 340 of the side members 308 is in alignment and coplanar with the upper inner end 320 and lower inner end 328 of the baffles 316. The outer end 344 of the side members 308 are coplanar with the outer end 324 of the baffles.

The side reflective surfaces 340 of the baffles extend radially outwardly from the inner end 342 to the outer end 344 at an angle 346 dependent on the number of sides of the tower. If, as shown in the drawings, the tower has eight sides, the angle 346 is equal to the number of sides of the tower divided into 360 degrees or 45°. Accordingly, in this design, side reflective surfaces 340 of each of the side members 308 of one optical baffle assembly 300 diverge from each other at an angle of 45° as shown in FIG. 14C. It should be understood that in the case of a tower having six sides the angle 346 would be 60°. It is within the compilation of this invention to provide a tower with the number of sides that are appropriate to generate the desired lighting characteristics as further described herein. In the case where the sides of the tower are not equal, the angle for each face is the angle between the horizontal lines passing through the center 346 of the tower and the edges defining the sides of that face.

The optical baffles assemblies 300 described above many be made of injection molded, ABS plastic or equivalent material with preferably a reflective coating 341 preferably having at least an A2 finish on the surfaces 318, 322, 326 and 340. This reflective finish provides for reflecting and directing the light generated by the emitters in a direction as will be hereinafter described. It should also be understood that is within the contemplation of this invention that the baffles 316 may be individual baffles mounted to the emitter board and positioned thereon as described herein and the baffles are made from any desired material having the reflective properties.

The number of emitters mounted on each emitter board 130*a*-130*h* is dependant on the amount of light desired in any particular direction and to provide control of the direction of that light, the emitters are mounted in each baffle aperture 331 as will be more fully described.

To achieve the high optical performance required for roadway lighting in terms of both fixture spacing and the prevention of uplight pollution, the optical baffles 316 are mounted above and below each row of emitters 107 that are mounted on the respective emitter boards 109. These baffles 316 are designed for use with the lighting fixture 100, and include surfaces 318, 322,326 and 340 which are configured to:

A) Provide a definite cut-off angle, α, above which the lumen output of the fixture is much reduced, or eliminated. This is to prevent the potential for disabling glare to pedestrians and motorists and up light pollution. The maximum cutoff angle range is from about between 55 and 75°. Any cutoff angle greater than 75° produces too much glare. Any cutoff angle less than 55° does not give enough horizontal throw of the light to provide a competitive fixture. If an adequate amount of light is not being thrown far enough across the horizontal plane from the luminarie, the required spacing of two or more luminarie's is not great enough to make the luminarie competitive. The preferred cut off angle is from between about 60 to 70°, except when additional horizontal throw of the light is necessary depending on the lighting configuration as will be described. In that case, the preferred cut off angle is from between about 60 to 75°. The height at which the fixture is mounted does not substantially change the cutoff angle, but does effect the spacing of the lighting fixtures. The lower the fixture is mounted, the closer the fixtures must be provided.

B) Redirect the visible light output from the emitters to provide the highest level of horizontal surface illumination values on the ground or roadway 165 as possible while maintaining as much horizontal uniformity in light over the illuminated area as possible as will be more fully described. The baffles also redirect any light that was directed above the range of from between a degrees above Nadir, (nadir being vertical with 0 degrees straight down) and therefore lost, to a direction down and away from the fixture as will be more fully described. When used for street lighting fixtures, this design allows the maximum spacing requirements between the luminaries to achieve required IESNA (Illuminating Engineering Society of North America) specifications as published in the American National Standard Practice for Roadway Lighting, RP-8-00 by the IESNA.

C) Provide the desired horizontal distribution pattern such as, for example, IESNA distribution patterns shown in FIG. 10.

Figure 15:
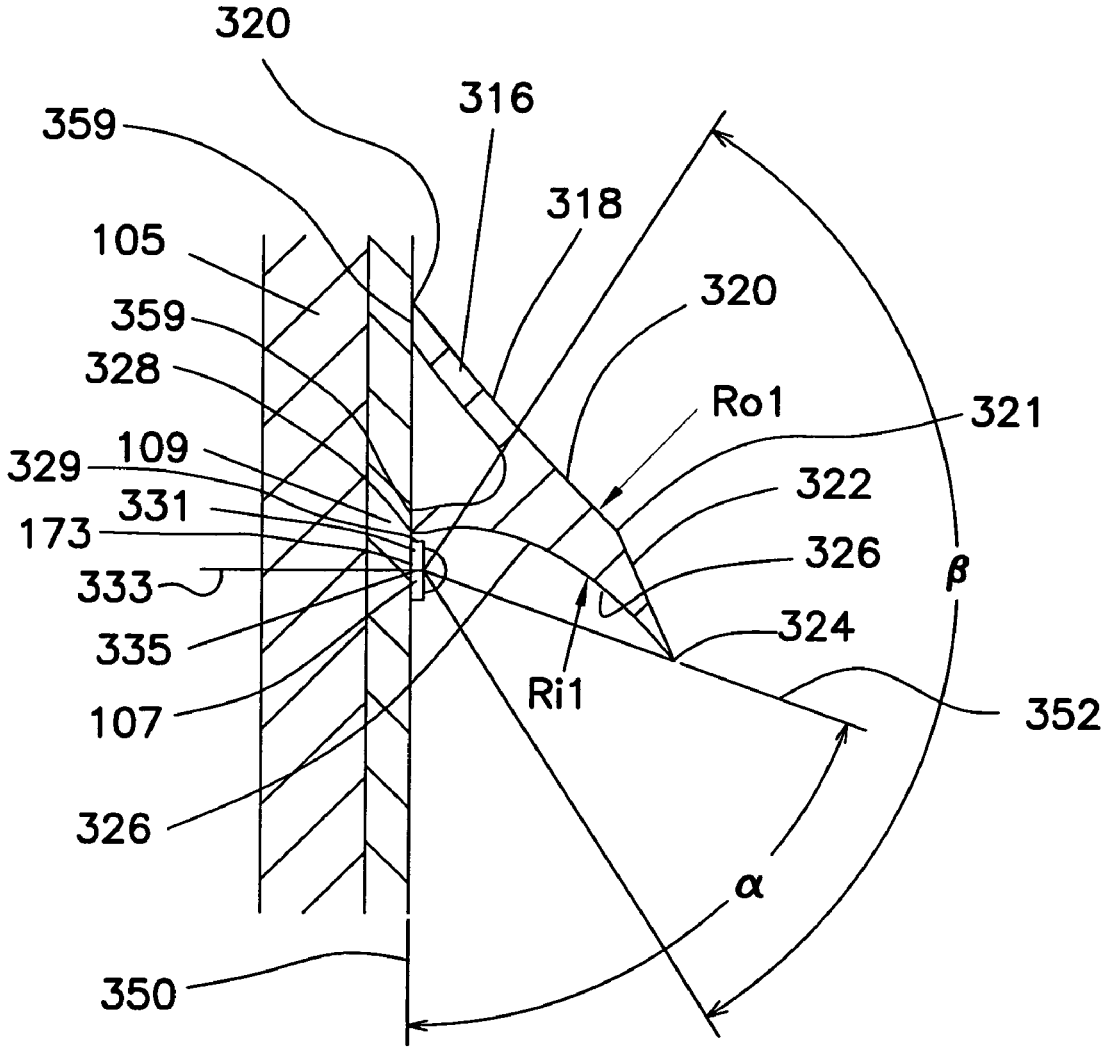
FIG. 15 is an enlarged sectional view of a portion of an emitter and an adjacent baffle of the baffle assembly shown in FIG. 14B as indicated by the dashed encircled area indicated at 15.

FIG. 15 shows an emitter 107 positioned below a baffle 316, shown in cross-section, and spaced in a position represented by the aperture 331 with respect to the baffle 316. The emitter 107 is centered on the horizontal centerline 333 which is centrally located in the baffle aperture 331. The lower inner end 328 of the baffle 316 is mounted adjacent the top side 329 of the emitter 107. The emitter 107 emits light in a direction generally outwardly and away from the emitter with the majority of light in a direction directly away from the emitter. The direction of the light generally extends at an angle β, which for the emitter described therein is equal to approximately 115°. The distribution of the intensity of the light emitted by the emitter is in general in the shape of a bell curve with the greatest intensity of light along the centerline 333 and in a direction directly away from the emitter. Outside of the area defined by β, there is no significant light created by the emitter.

The cut off angle α defines the angle which reduces disabling glare from the fixture. If light is allowed to be transmitted in, for example, a horizontal direction above the cutoff angle α, observers, drivers and pedestrians can have their vision impaired which would create a hazardous condition. It should be understood that the term cut off angle α as used in this description is the angle from a vertical line 350 passing through the center 335 of the light of emitting diode and a line 352 passing through the center 335 of the light emitting diode and through the outer end 324 of the baffle. The outer end 324 of the baffle restricts light from being transmitted above the line 352, thus minimizing disabling glare.

In the illustrations of the present invention shown in the drawings, the baffle outer end 324 and line 352 is positioned at an angle α of preferably, for street lighting configurations, from between about 70 degrees to 73 degrees from a vertical line 350 passing through the light emitting diode 107 and a line 352 passing through the center 335 of the light emitting diode 107 and through the baffle end 324.

The baffle arrays 300 are mounted on the emitter board with each of the horizontal rows of the light emitting diodes 107 on their respective emitter boards 109 positioned in the apertures 331 between adjacent baffles of the baffle assemblies as illustrated in connection with the baffles 316*b* and 316*c* in FIGS. 16A-16C. The lower inner end 328*b* of the upper baffle 316*b* is mounted adjacent the top side 329 of the emitter 107. The upper inner end 320*c* of the baffle 316 is mounted adjacent the bottom side 337 of the emitter 107. The spacing of the upper baffle with respect to the lower baffle is important to ensure that the light which strikes the various surfaces of the baffles, does so at the proper angle so that the reflected light leaves the baffles at the appropriate angle as defined by the Zones shown in FIGS. 16A-16C.

The baffles redirect the visible light output from the emitters to provide desirable levels of horizontal surface illumination the ground or roadway, in an efficient manner, while also maintaining a relatively smooth distribution of light over the illuminated area.

The distinct downward curve of the lower surface 326 at the tip or end 324 of the baffle profile is to achieve the desired cut-off angle α as described herein. The upper surfaces 318, 322 and a lower surface 326 of the adjacent baffles 316 are designed to work in conjunction with each other (illustrated as baffles 316*b* and 316*c* in FIGS. 16A, 16C). The light from the emitter 107 above the line 352 impinges on the lower surface 326*b* of the baffle 316*b*. The lower inner end 328*b* of the upper baffle 316*b* is mounted adjacent to and above the top side 329 of the emitter, see FIGS. 15 and 16A. The upper inner end 320*c* of the lower baffle 316*c* is mounted adjacent to and below the bottom side 337 of the emitter. The light from the emitter above the direction of the line 352 is prevented from traveling upwards of the cutoff angle α, and is redirected downwards in Zone 1. This means that light from the emitter above the cutoff angle α, is now being redirected downwards by the lower surface 326*b* to illuminate the ground below the fixture.

The lower baffle surface 326*b* is configured in a compound curve so that the light of the emitter in a direction above the cutoff line 352 is reflected by the lower surface 326*b* in Zone 1 defined by a line 343 through the end 324*b* of the baffle 316*b* and the end 324*c* of the baffle 316*c* and a line 325. Line 325 is a line extending through the first point 327 that light from the emitter in an upward direction contacts and is reflected by the lower surface 326*b* of the baffle 316*b* toward the roadway. It should be understood that the line 325 can be designed at different angles dependent on the configuration of the lower surface 326*b*.

By way of example, in the emitter shown, the direction of the light from the emitter generally extends at the angle β, which, for the emitter described therein is equal to approximately 115°. The first point 327 that light from the emitter in an upward direction contacts the lower surface 326*b* would be a line 345 passing thru the center of the emitter and at an angle of 57.5 degrees above the horizontal line 333 thru the center of the emitter or alternatively 147.5 degrees between line 345 and a the vertical line 350. The portion of the light reflected by the lower surface of the upper baffle is the light impinging on point 327 to the outer end of the upper baffle. Zone 1 is defined by the area between the line 343 and the line 325 that impinges on the roadway or ground. Zone 1 defines an area closest to the lighting fixture. By so configuring the lower baffle surface, compound reflection of the light reflected thereby is avoided, which is desirable since each time light is reflected some of its intensity is lost.

Figure 16A:
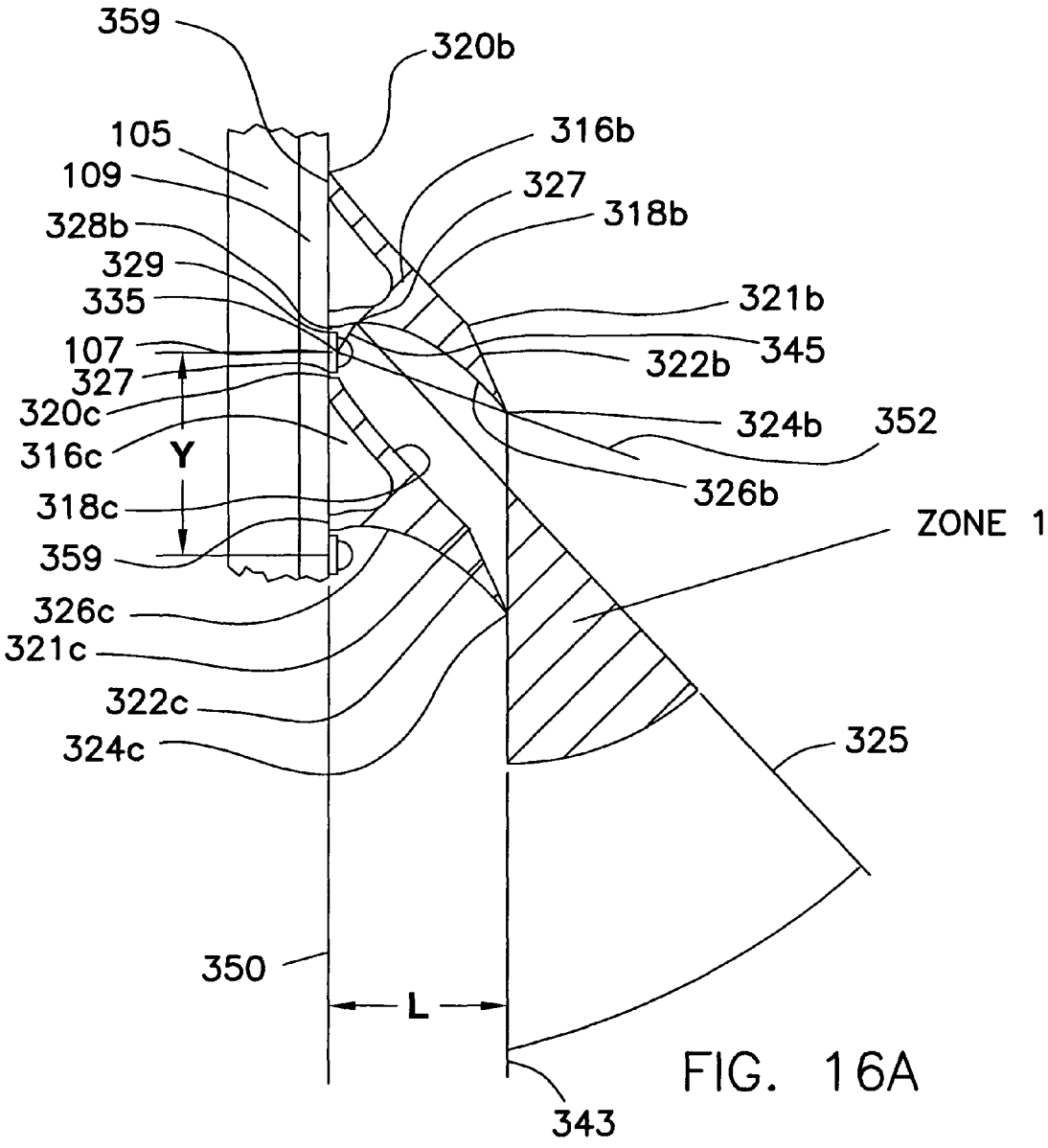
FIG. 16A is a partial sectional view of the baffle assembly shown in FIG. 14A and taken along lines 16A-16A showing Zone 1 optical characteristics thereof.
Figure 16B:
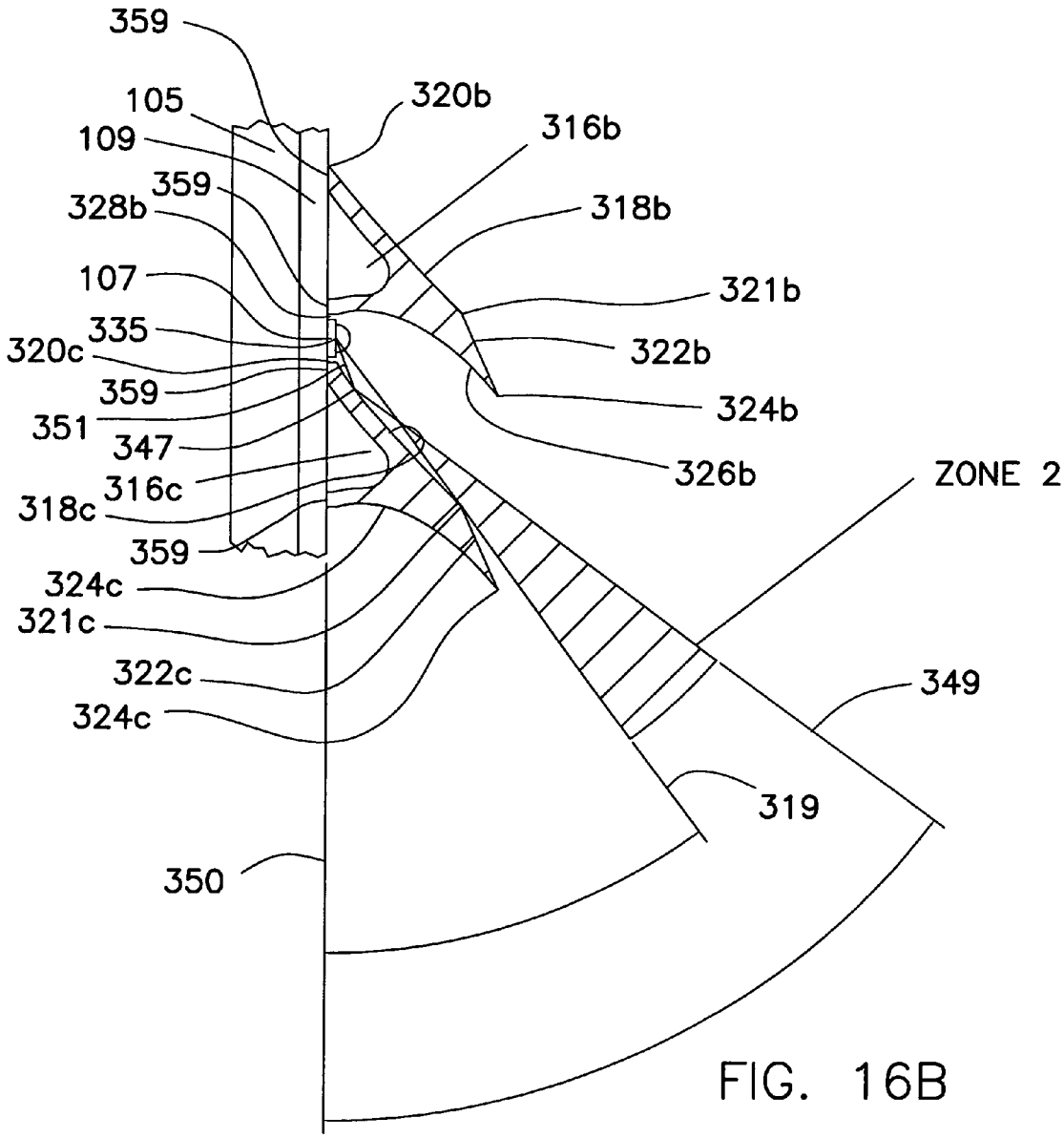
FIG. 16B is a partial sectional view of the baffle assembly shown in FIG. 16A showing Zone 2 optical characteristics thereof.

Zone 2 is described in FIG. 16B with reference to FIG. 15. The light directed toward the top surface 318*c* is the light directed below a line 319 extending from the center 335 of the emitter through the edge 321*c*. The light from the emitter 107 below the line 319 impinges on the top surface 318*c* of the baffle 316*c* (which is mounted below the emitter) and is redirected upwardly and outwardly in Zone 2. The upper inner end 320*c* of the lower baffle 316*c* is mounted adjacent to and below the bottom side 337 of the emitter. Line 349 is a line extending through the first point 347 that light from the emitter in an downward direction contacts and is reflected by the upper surface 318*c* of the baffle 316*c* toward the roadway. The portion of light reflected by the upper surface of the lower emitter is the light emitted by the emitter that impinges on the lower baffle between points 347 and 321*c* on the lower baffle. It should be understood that the line 349 can be designed at different angles dependent on the configuration of the upper surface 318*c*. This means that light that would be directed immediately below the fixture is directed outwards to illuminate the ground away from the mounting pole.

By way of example, in the emitter shown, the direction of the light from the emitter generally extends at the angle β, which, for the emitter described therein is equal to approximately 115°. The first point 347 that light from the emitter in an downward direction contacts the upper surface 318*c* would be a line 351 passing thru the center of the emitter and at an angle of 57.5 degrees above the horizontal line 333 thru the center of the emitter or alternatively 147.5 degrees between line 327 and a vertical line 350. Zone 2 is an area which is at least in part outwardly away from said Zone 1. Zone 2 is defined by area between the line 319 and the line 349 that impinges on the roadway or ground. By so configuring the upper baffle surface, compound reflection of the light reflected thereby is avoided, which is desirable since each time light is reflected some of its intensity is lost.

Figure 16C:
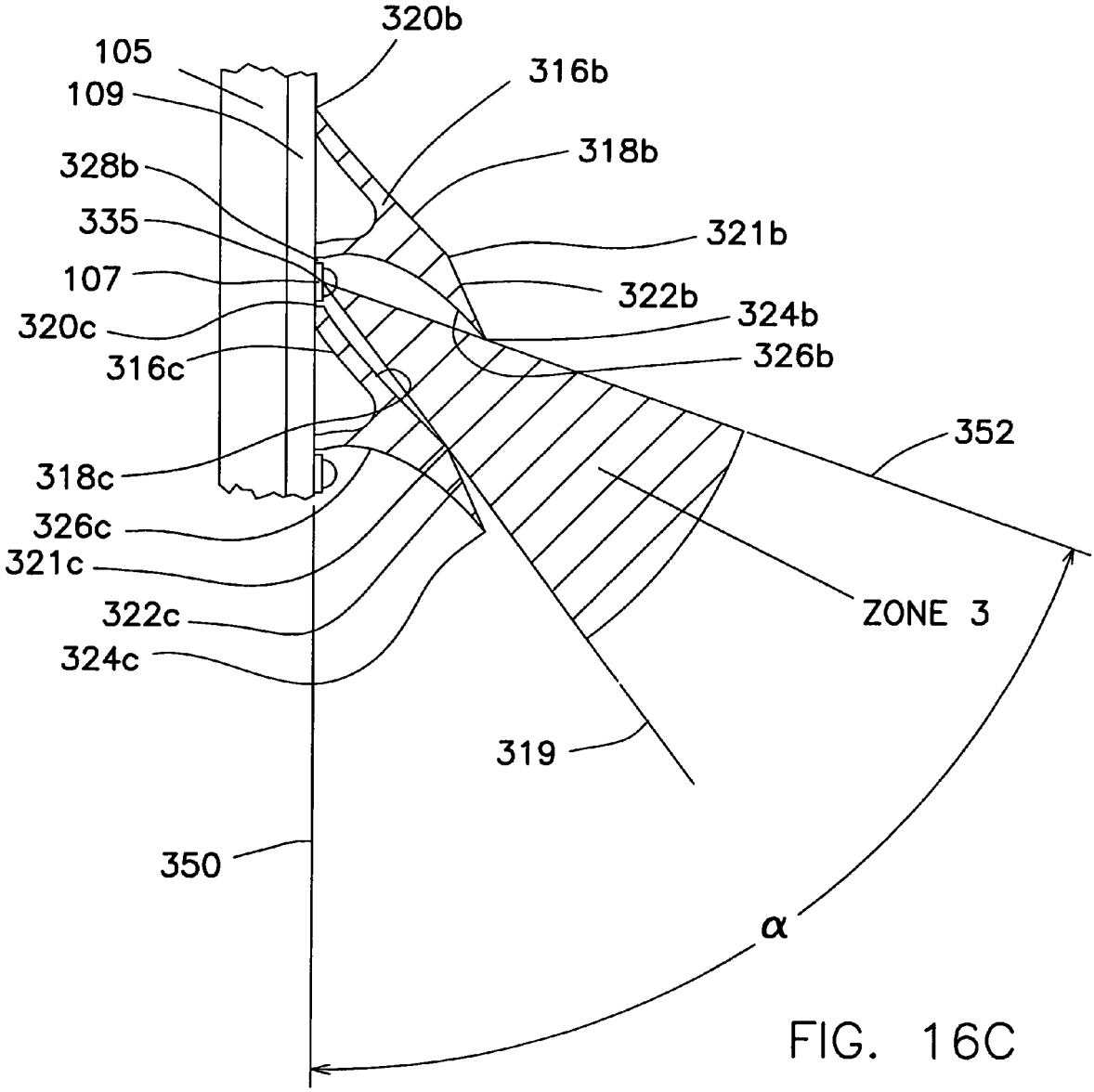
FIG. 16C is a partial sectional view of the baffle assembly shown in FIG. 16BA showing Zone 3 optical characteristics thereof.

As shown in FIG. 16C, Zone 3 is composed primarily of light coming directly from the emitter 107 with no reflection, and is not redirected by the baffles 316. This direct light extends between lines 319 and 352. Since it is not reflected its intensity is not diminished by reflection and assists that light reaching a distance from the fixture.

This combination of direct light from the emitters 107 in Zone 3, light reflected by the lower surface 318 in Zone 2, and light reflected from the upper surface 326 in Zone 1, provides an improved level of horizontal surface illumination values on the ground, while also maintaining as smooth a distribution over the illuminated area as possible.

As shown in FIG. 16A, Zone 1 is composed primarily of light which is reflected off of the lower surface 326*b* of the upper baffle 316*b*. In one street lighting design shown in FIGS. 16A-16*c*, Zone 1 falls within the range of from between about 0 degrees to 42 degrees above nadir. The lower surface 326*b* is configured so that all of the light reflected by it falls within Zone 1. The exact configuration of the lower surface 326*b* is designed to distribute the light across Zone 1 as desired to achieve the desired lighting. Since the light in Zone 1 is reflected light, its intensity is not as great as the light emitted directly from the emitter. The light in Zone 1 is used for lighting the area closest to the luminarie.

As shown in FIG. 16B, Zone 2 is composed primarily of light from the emitter reflected off of the inner upper surface 318*c* of the lower baffle 316*c* between lines 319 and 349. In one street lighting design shown in FIGS. 16A-16*c*, Zone 2 falls within the range of from between about 36 degrees to 53 degrees above nadir. The inner upper surface 318*c* is configured so that all of the light reflected by it falls within Zone 2. The exact configuration of the inner upper surface 318*c* is designed to distribute the light across Zone 2 as desired to achieve the desired lighting. All of the light from the emitter 107 reflected by inner upper surface 318*c* falls within Zone 2. Since the light in Zone 2 is reflected light, its intensity is not as great as the light emitted directly from the emitter. The light in Zone 2 shown in FIG. 16B is used for lighting a section of the horizontal plane on the roadway further from the luminarie that is substantially intermediate Zone 1 and Zone 3 as shown.

As shown in FIG. 16C, Zone 3 is composed primarily of light coming directly from the LED emitter 107 with no reflection, and is not redirected by the baffles 316. Zone 3 defines an area which is at least in part outwardly away from Zone 2. In one street lighting design shown in FIGS. 16A-16C, Zone 3 falls within the range of from between about 36 degrees to 70 degrees above nadir. The direct light in Zone 3 is cut off by the edge 321*c* of the lower baffle 316*b* and the end 326*b* of the upper baffle member. Since the light in Zone 3 is direct and not reflected light, its intensity is greater than the reflected light in Zones 1 and 2. The light in Zone 3 is used to illuminate the area furthest away from the lighting fixture. This greater intensity assists in the distance the light in Zone 3 is projected. The light in Zone 3 is used to light the horizontal plane furthest from the luminarie.

The lower surface 326 of the baffle is reflective and is configured to control the light emitted from the emitter 107 as described herein. As seen in FIG. 15, the lower surface 326 is formed by a compound radius Ri1. The compound radius Ri1 is determined by a series of points that reflect the light impinging on the lower surface 326 along the desired distribution pattern in Zone 1. The inner upper surface 318*c* of the lower baffle 316*c* is formed by the compound radius Ro1. The compound radius Ro1 is determined by a series of points that reflect the light impinging on the inner upper surface 318*c* along a desired distribution pattern in Zone 2.

For purposes of illustration, the cut off angle α of 70 degrees will be used in the drawings describing baffle array 300 as illustrated in FIGS. 14A-16C. For purposes of illustration the cut off angle α of 73 degrees will be used in the drawings describing baffle array 300' as illustrated in FIGS. 18-20C since a greater throw of the light is necessary to meet certain lighting configurations. The primary or initial light rays from the emitter 107 between the angles of between 45 to 73 degrees above nadir pass between the upper and lower baffles and is therefore not redirected by them (FIG. 14, Zone 6).

Figure 17:
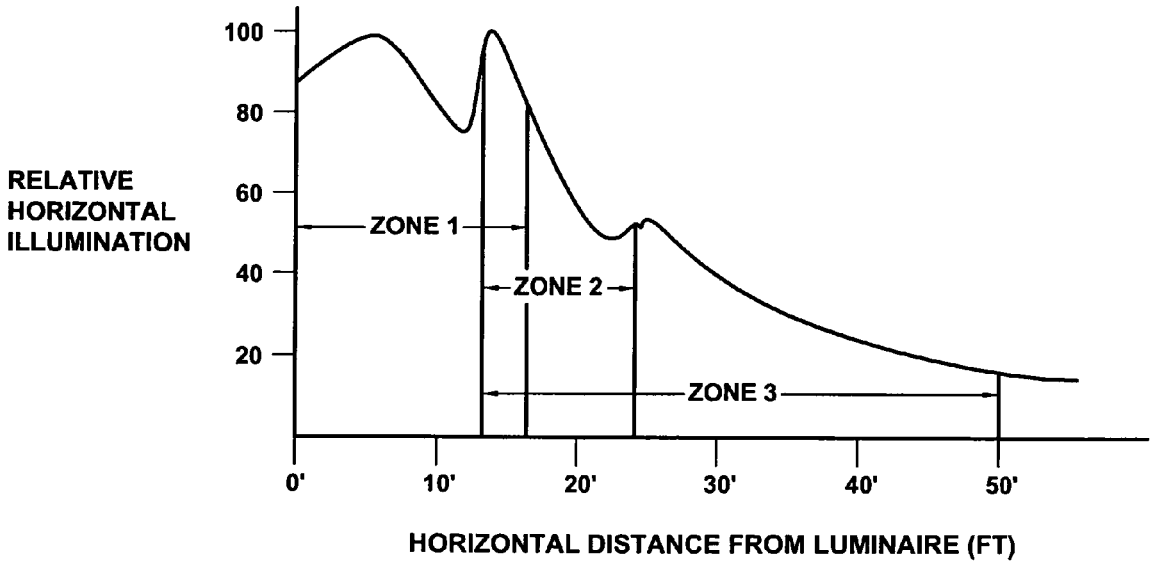
FIG. 17 is a graph showing the light distribution of the fixture utilizing the baffle assembly shown in FIGS. 14A-14C.

The light rays that are redirected by the inner surfaces generated by compound radii Ri1 and Ro1 of the upper baffle are redirected in two Zones. Some light redirected by the inner surface 131 generated by the compound radius Ri1 of the upper baffle pass in an are between 11 degrees and 42 degrees above nadir, missing completely the top radius Ro1 of the lower baffle, thus providing illumination on the horizontal plane closest to the base of the luminarie (FIG. 17, Zone 1). The remainder of the light rays redirected by the upper surface 129 generated by the compound radius Ri1 of the upper baffle, are redirected in an are of between 36 degrees and 53 degrees above nadir (FIG. 17, Zone 2). The combination of the light of the three Zones shown in FIG. 16 results in the horizontal distribution and cut-off pattern as shown in FIG. 17.

In outdoor lighting commercial applications, when using emitters, it is desirable for a number of emitters to appear as a single source of light. Accordingly the distance between the emitters in a vertical direction should preferably be as small as possible while allowing for heat dissipation and sufficient space to mount baffles above and below the emitters. In a baffle assembly with at least 3 baffles, each of the baffles have an emitter aperture between adjacent baffles. At least one emitter is positioned in each emitter aperture a predetermined distance from the emitter mounted in an adjacent emitter aperture. Each of the baffles have a back surface 359 adjacent the upper and lower inner end of the baffles. The distance between the adjacent emitters divided by the length "L" of the baffle is in a range of from between about 1.7 to about 0.75. By maintaining this design ratio, the desirable features are achieved.

In order for the emitters to properly optically coact with baffles vertically spaced with respect to each other, the vertical spacing distance "y" of the emitters has a relationship with respect to the length "L" of the baffles. As seen in FIG. 14B and FIG. 16A, the adjacent emitters are spaced a distance "y" in a vertical direction. The length of the baffles is a horizontal distance "L" measured from a vertical line 350 passing through the back 359 of the baffle to the outer end 324 of the baffle measured along a line perpendicular to the line passing thru the back of the baffle. The upper inner end 320 and lower inner end 328 define the top and the bottom of the back surface 359. When the baffles are assembled with the emitter board, the back surface 359 of the baffle is in contact with the outer surface 136 of the emitter board.

While the length "L" of the baffle and the vertical distance spacing of the emitters "y" may vary, in order to achieve an effective cut off angle $\alpha$ and the optical characteristics of the present invention, the relationship between the vertical distance spacing of the emitters "y" and the length of the baffle "L" must be maintained. It has been found that a ratio of "y"/"L" from between about 1.7 to 0.75 provides the advantageous optical features of the present invention.

FIG. 17 shows the horizontal illumination of the fixture of the present invention. In the illustration shown, the cutoff angle $\alpha$ is 70°. The "Relative Horizontal Illumination" is a unitless number provided to compare the amount of light at various distances from the fixture. FIG. 17 is provided to illustrate a comparison of the different amounts of light at different distances from the fixture. While it is desirable to have the same amount of light at all distances from fixture, the baffles of the present invention are directed to achieving this objective. It should be understood that by placing the fixtures of the present invention certain distances from each other that this objective can be approximately achieved. By positioning the fixtures of the present invention a proper distance from each other, the light provided at the further distances away from the fixture in Zone 3 overlap the light provided at further distances from an adjacent fixture to provide a substantially uniform amount of light on the roadway. While the relative horizontal illumination of only one fixture of the present invention is described below, it should be understood that the overlapping of light in the extremities of Zone 3 from adjacent fixtures achieves this desired feature. It should be understood that different emitters will generate different amounts of light in the relative horizontal illumination axis.

For the particular configuration of the surfaces 318, 326 and position of the end 324 and edge 321 between the surfaces 322 and 318, the illumination for Zones 1, 2, and 3 are shown in FIG. 17. Zone 1 shows the area of illumination closest to the fixture. Zone 2 shows a slight overlap between Zone 1 and 2 to provide improved illumination in that overlap area close to the fixture. Zone 3 overlaps Zone 2 and a portion of Zone 1 to provide the desired lighting distribution configuration. It should be understood that it is within the contemplation of this invention to modify the surfaces 318, 326 and position of the end 324 and edge 321 between the surfaces 322 and 318 and achieve a wide variety of different horizontal illumination configurations.

As can be seen in FIG. 10, there are a variety of IESNA lighting configurations. In particular, Symmetrical lighting pattern Type V, is shown and described in FIGS. 5 and 11C, and 11D. When it is desired to provide an Asymmetrical lighting pattern such as Type III, and shown in FIGS. 11A, 11B, it is desirable to provide a baffle assembly that is capable of illuminating specific areas that are a greater distance from the fixture to provide a further range of light and using baffle assemblies that illuminate specific areas that are a lesser distance from the fixture.

Figure 18:
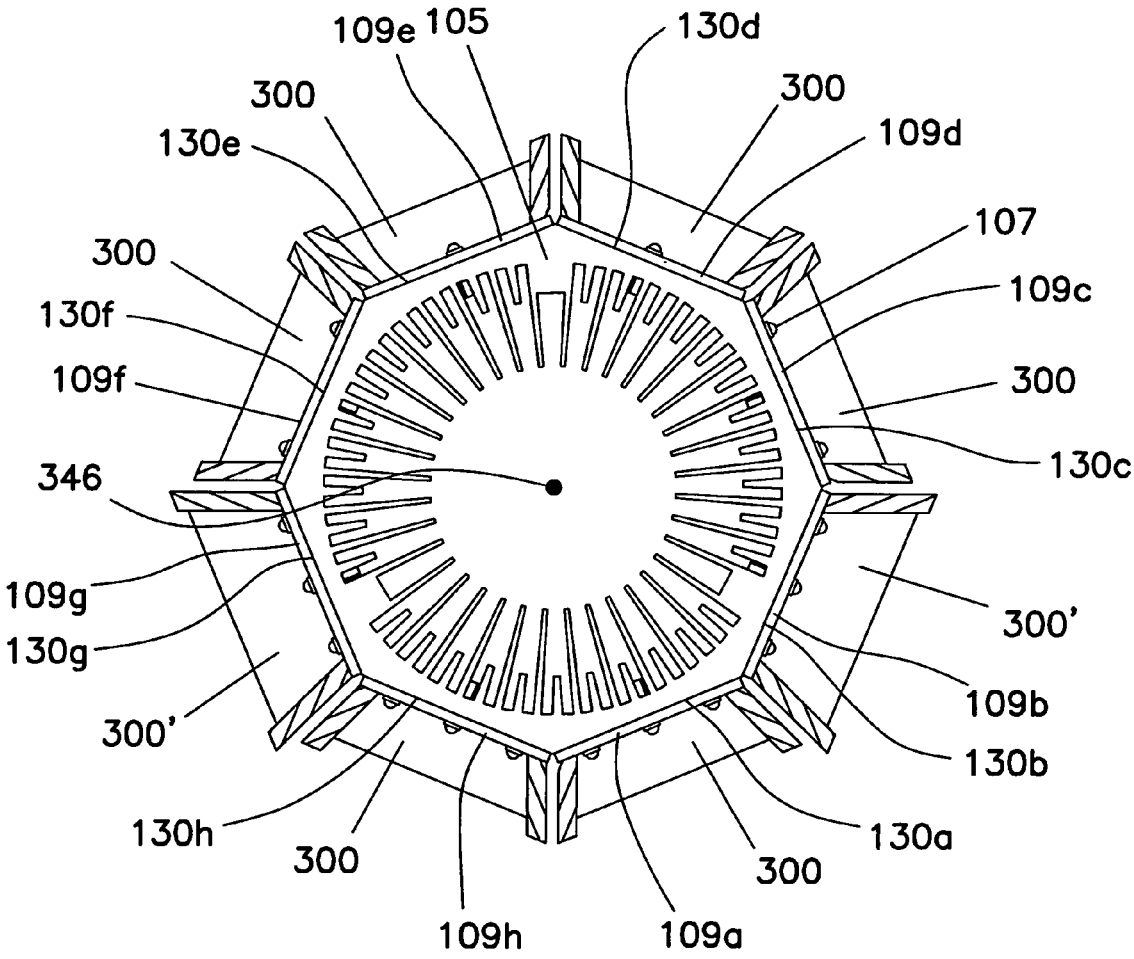
FIG. 18 is a sectional view of the tower shown in FIG. 5 with an alternative baffle assembly mounted thereon.

A variety of baffle assemblies may be provided with different optical characteristics. For example, the baffle assembly 300' as shown in FIGS. 18-20C may be provided to provide a further range of light. The baffle assembly 300' of the present invention is shown in FIG. 18-20C. For ease of description, the baffle assembly 300' is numbered with the numerals the same as used in connection with the baffle assembly 300 to denote common similar parts where appropriate and followed by a prime (') mark to denote the parts of baffle assembly 300'. It should be understood that the battle assembly 300' is used in conjunction with Asymmetrical lighting pattern such as Type III as shown in FIGS. 11A and 11B and are mounted on the surfaces 109*b* and 109*g* as shown in FIG. 18.

FIG. 18 is a cross-section, similar to the cross-section shown in FIG. 5, having a baffle assembly 300' mounted on the faces 130*b* and 130*g* which has a greater cut off angle, for example 73 degrees, than in the baffle assemblies 300 described above in connection with a cutoff angle of 70 degrees. The baffle assemblies 300' provide for illuminating areas at a greater distance from the fixture. As can be seen in FIG. 10, the faces 130*b* and 130*g* face the directions in which a greater range of light is required to meet those specifications.

In the embodiment shown in FIGS. 18-20C, the optical baffle assemblies 300' are mounted to the emitter boards 109*b* and 109*g* which are mounted to the respective sides 130*b* and 130*g* of the tower. The optical baffle assembly 300' includes a frame 302' having upper and lower mounting members 304', 306' and side members 308' interconnecting the ends 310', 312' of each of the mounting members 304', 306' respectively. The upper and lower mounting members 304', 306' have an apertures 314' therein for attaching the optical baffle assembly 300' to the emitter boards 109*b* and 109*g* and the tower as shown in FIGS. 8 and 18.

Figures 19A, 19B, 19C:
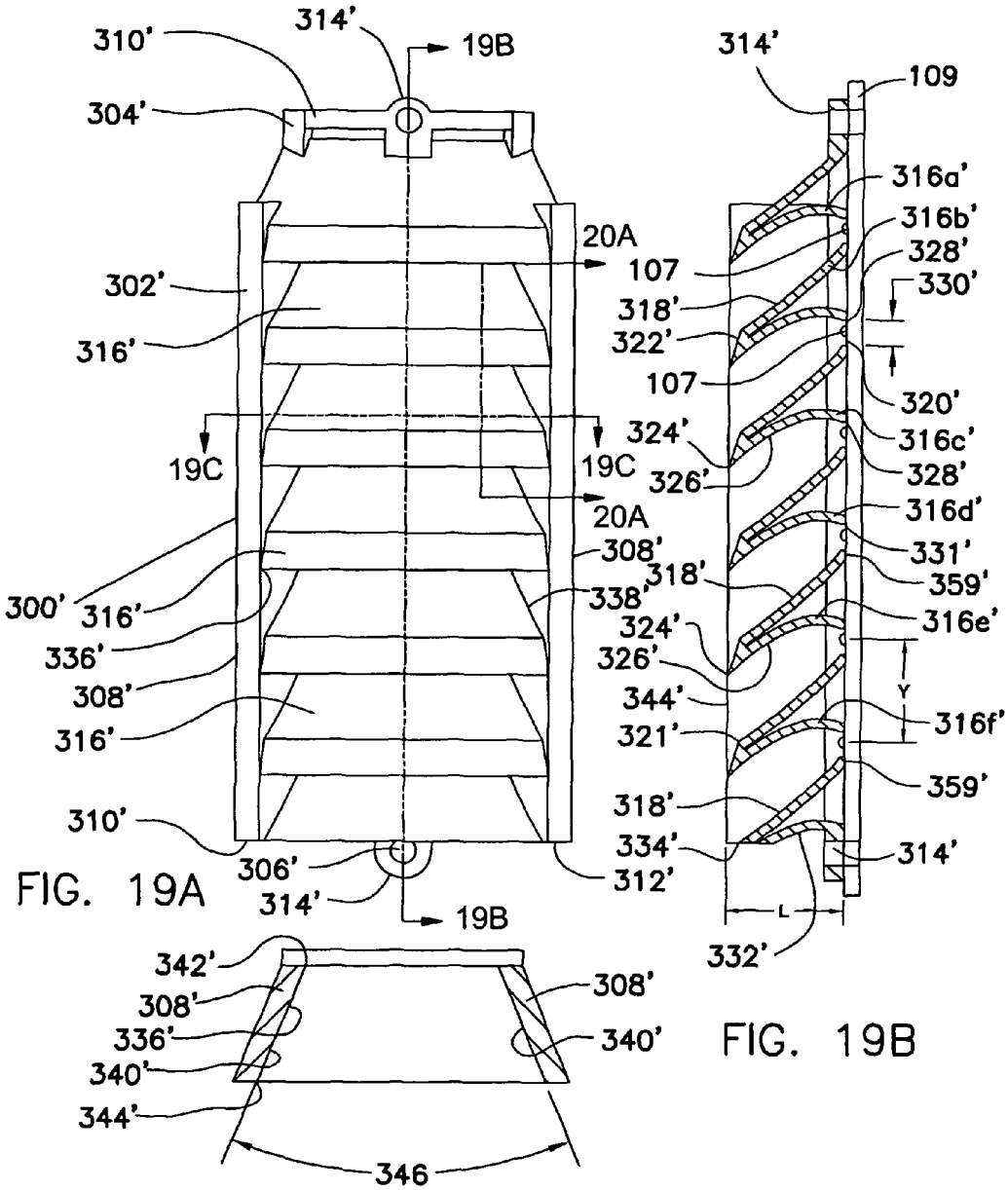
FIG. 19A is a side elevational view of an alternative baffle assembly of the present invention.
FIG. 19B is a sectional view of the alternative baffle assembly shown in FIG. 19A and taken along lines 19B-19B thereof.
FIG. 19C is a sectional view of the alternative baffle assembly shown in FIG. 19A and taken along lines 19C-19C thereof.

The optical baffle assembly 300' also has a number of optical baffles 316' extending between the side members 308' as shown in FIGS. 19A-19C. Each of the optical baffles 316' have an inner upper surface 318' extending from the upper inner end 320' to an outer upper surface 322'. The upper surfaces 318', 322' join each other at the edge 321'. The outer upper surface 322' terminates in an outer end 324'. Each of the optical baffles 316' have a lower surface 326' extending from the lower inner end 328' to the outer end 324'.

A series of optical baffles 316*a*'-316*f*' are provided on each optical baffle assembly 300' shown in FIGS. 19A-19C. The distance between the lower inner end 328' of one baffle, for example baffle 316*b*', is spaced from and positioned a distance 330' from the upper inner end 320' of the optical baffle 316*c*' positioned immediately below baffle 316*b*' and defines a baffle aperture 331'. It should be understood that the baffles 316*a*'-316*f*' are similarly positioned with respect to each other and are adjacent the baffles immediately above and below them respectively.

Adjacent the lower mounting member 306' is a bottom baffle member 332' which has an upper surface 318' extending from the upper inner end 320' and terminates in the lower outer end 334'. The bottom baffle member 332' is positioned below the baffle 316*f*' and is positioned as described above in connection with baffle 316*b*' and baffle 316*c*' and has a emitter aperture 331' between the baffles 316*f*' and 332'. The shape of the surfaces 318', 322', 326' are configured to control the light emitted from the emitters 107 as will be described below.

The side members 308' are provided not only to support the baffles 316' on their ends 336', 338' but also to control the direction of the light emitted by the emitters 107 in a direction toward the side members 308'. The ends 336', 338' of the baffles 316' are formed integrally with the side members 308' so that the baffles 316' adjacent each other are provided with a aperture 331' in which the LEDs 107 on their respective emitter boards are received. The baffles 316' are positioned so that the upper inner end 320', outer end 324', and lower inner end 324' are in substantially horizontal direction.

Each of the side members 308' have a side reflective surface 340' extending from an inner end 342' to and outer end 344' as shown in FIG. 19C. The side reflective surfaces 340' of each of the side members 308' extend between each of the longitudinal ends 336', 338' of the baffles 316' on each end 336', 338' of the baffles. These vertical side reflective surfaces 340' are used to control the horizontal distribution of the light in such a way that the amount of light which is visible and measurable in the vertical direction above a degrees above nadir is kept as small as possible. This reduces the effects of light pollution due to stray light above the cutoff angle β. In the baffles 316' shown in FIGS. 19A-20, the angle α is shown as 73°. It should be understood that it is within the contemplation of this invention that the angle α may be at any angle appropriate to achieve the horizontal lighting distribution desired.

The inner end 342' of the surface 340' of the side members 308' is in alignment and coplanar with the upper inner end 320' and lower inner end 328' of the baffles 316'. The outer end 344' of the side members 308' are coplanar with the outer end 324' of the baffles.

The side reflective surfaces 340' of the baffles extend radially outwardly from the inner end 342' to the outer end 344' at an angle 346' dependent on the number of sides of the tower.

Figure 20A:
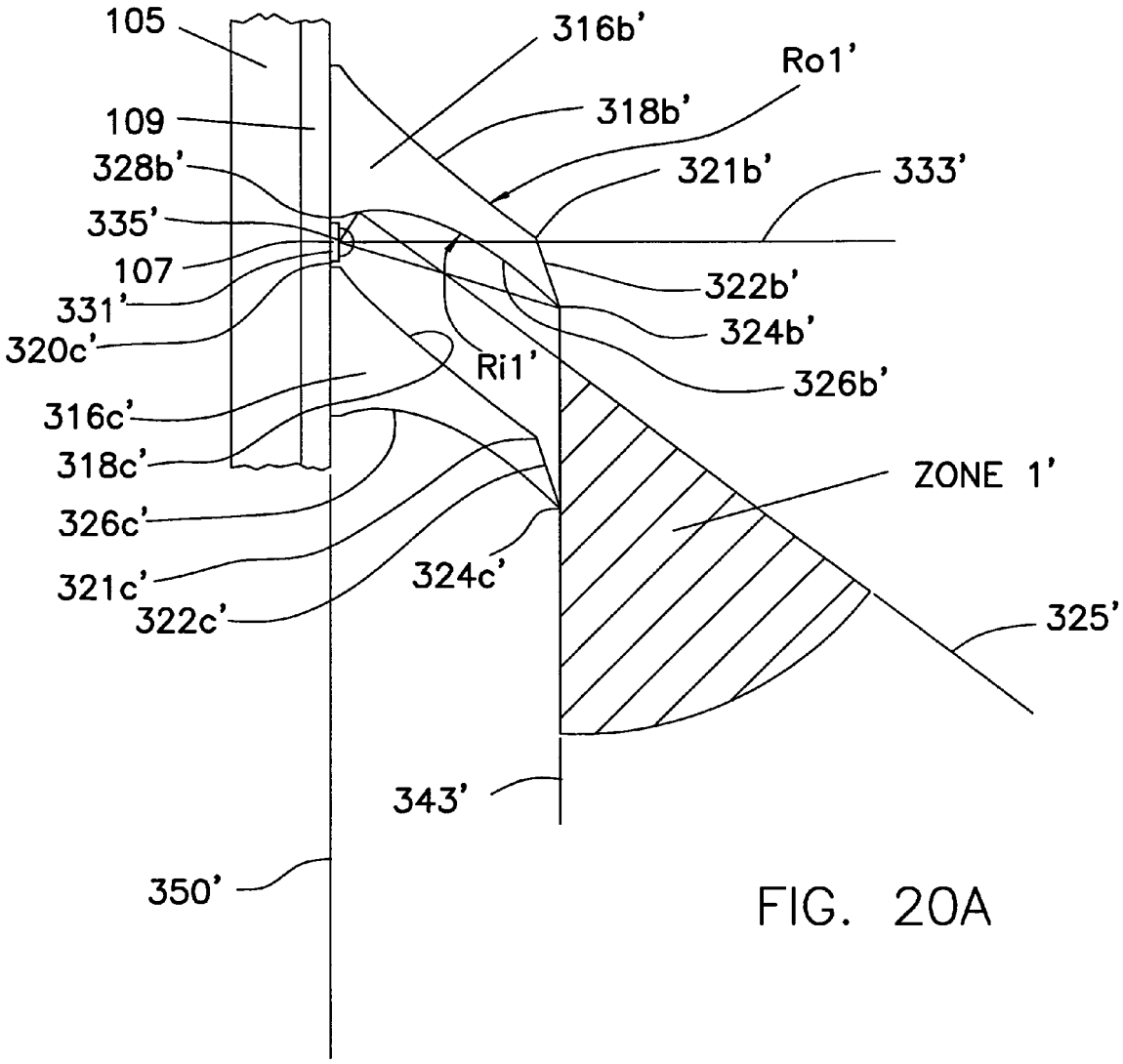
FIG. 20A is a partial sectional view of the baffle assembly shown in FIG. 19A and taken along lines 20A-20A showing Zone 1 optical characteristics thereof.
Figure 20B:
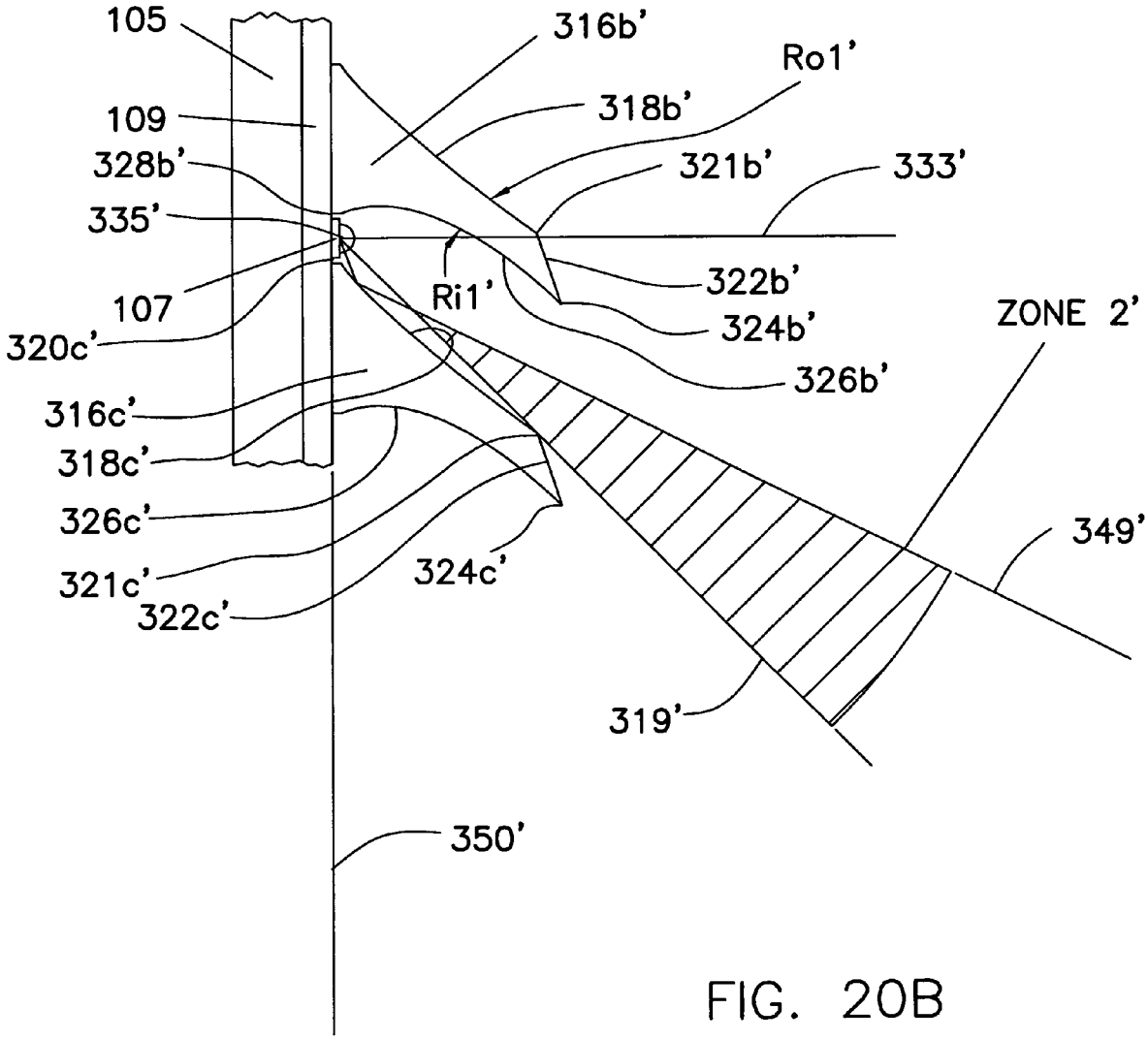
FIG. 20B is a partial sectional view of the baffle assembly shown in FIG. 20A showing Zone 2 optical characteristics thereof.
Figure 20C:
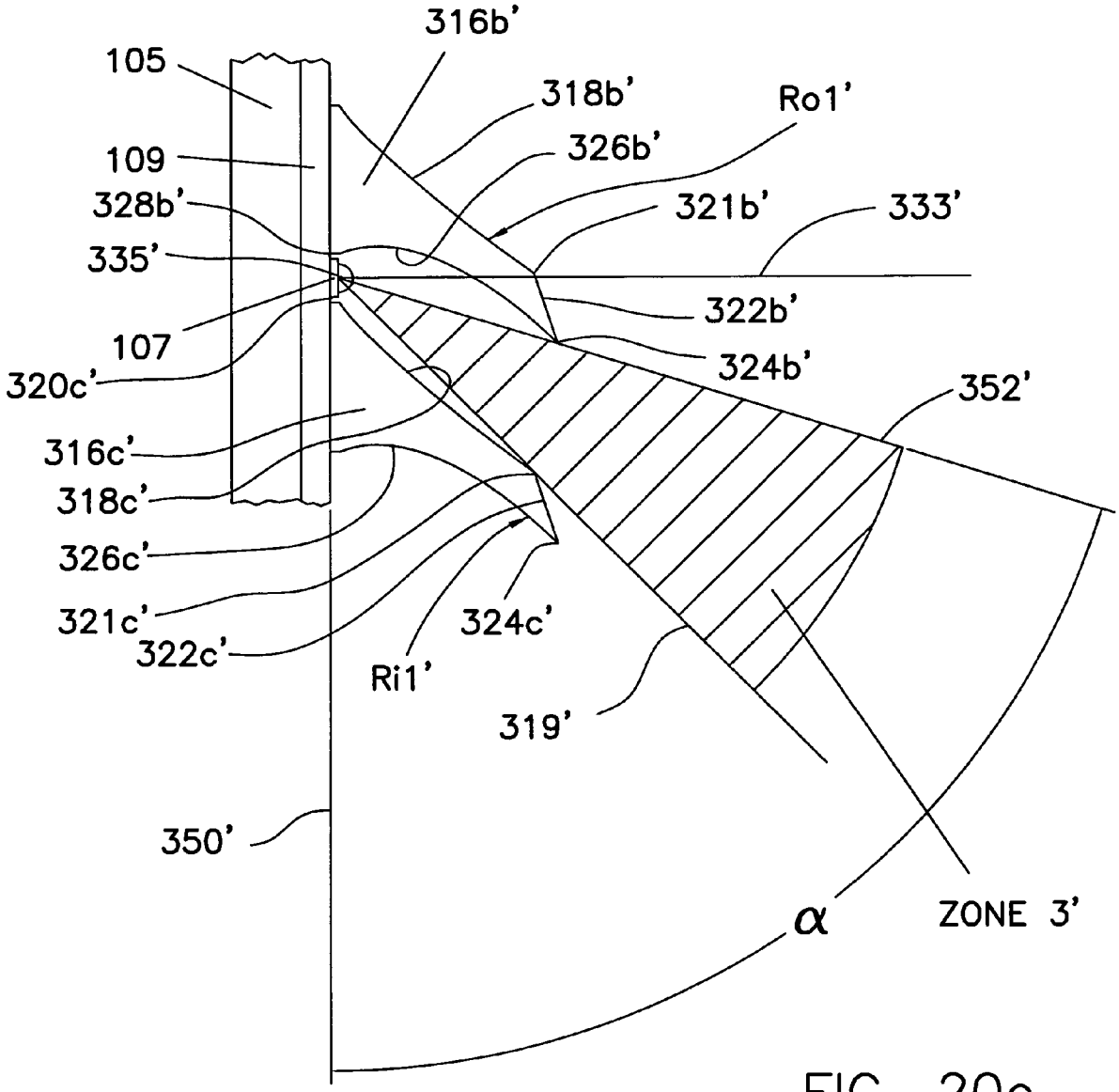
FIG. 20C is a partial sectional view of the baffle assembly shown in FIG. 20A showing Zone 3 optical characteristics thereof.

FIG. 20A-20C shows an emitter 107 positioned below a baffle 316*b*', shown in cross-section, and spaced in a position represented by the aperture 331' with respect to the baffle 316'. The emitter 107 is centered on the horizontal centerline 333'. The emitter 107 emits light in a direction generally outwardly and away from the LED with the majority of light in a direction directly away from the emitter. The direction of the light generally extends at an angle β, which for the emitter described therein is equal to approximately 115°. The distribution of the intensity of the light emitted by the emitter is in general in the shape of a bell curve with the greatest intensity of light along the centerline 333' and in a direction directly away from the emitter. Outside of the area defined by β, there is no significant light created by the emitter.

The cut off angle α defines the angle which reduces disabling glare from the fixture. If light is allowed to be transmitted in, for example, a horizontal direction, observers and pedestrians can have their vision impaired which would create a hazardous condition. It should be understood that the term cut off angle as used in his application is the angle from a vertical line 350' passing through the center 335' of the light emitting diode and a line 352' passing through the center 335' of the light emitting diode and through the outer end 324' of the baffle. The outer end 324' of the baffle restricts light from being transmitted above the line 352', thus minimizing disabling glare.

In the illustrations of the present invention shown in FIGS. 18-20C, the baffle outer end 324' and line 352' is positioned at an angle α which, as shown in FIGS. 20A-20C is 73 degrees from a vertical line 350' passing through the light emitting diode 107.

The baffle arrays 300' are mounted on the emitter board with each of the horizontal rows of the light emitting diodes 107 on their respective emitter boards 109 (see FIG. 2) positioned in the apertures 331' between adjacent baffles of the baffle assemblies 300'. The spacing of the upper baffle to the lower baffle is important to ensure that the light which strikes the various radii of the baffles, does so at the proper angle so that the reflected light leaves the baffles at the appropriate angle as defined by the Zones shown in FIGS. 20A-20C.

The baffles redirect the visible light output from the emitters to provide the highest level of horizontal surface illumination values on the ground as possible, while also maintaining as smooth a distribution over the illuminated area as possible.

The distinct downward curve of the lower surface 326*b*' at the tip or end 324*b*' of the baffle profile is to achieve the desired cut-off angle α as described herein. The upper surfaces 318*b*', 322*b*' and a lower surface 326*c*' of the adjacent baffles 316*b*' and 316*c*' are designed to work in conjunction with each other (FIGS. 20A-20C). The light from the emitter 107 above the line 352' impinges on the lower surface 326*b*' of the baffle (which is mounted above the emitter). The light above the line 352' is prevented from traveling upwards of the cutoff angle α, and is redirected downwards in Zone 1'. This means that light from the emitter above the cutoff angle α, is redirected downwards to illuminate the ground.

The light directed toward the top surface 318*c*' is the light directed below a line 319' from the center 335' of the emitter through the edge 321*c*'. The light from the emitter 107 below the line 319' impinges on the lower surface 318' of the baffle (which is mounted below the LED). The light below the line 319' is redirected downwardly and outwardly in an are in Zone 2'. This means that light from the emitter that would be directed immediately below the fixture is directed outwards to illuminate the ground away from the pole.

This combination of direct light from the emitters 107 in Zone 3', light reflected by the lower surface 318' in Zone 2', and light reflected from the upper surface 326' in Zone 1', provides an improved level of horizontal surface illumination values on the ground as possible, while also maintaining a relatively smooth light distribution over the illuminated area.

As shown in FIG. 20A, Zone 1' is composed primarily of light which is reflected off of the lower surface 326*b*' of the upper baffle 316*b*'. In one street lighting design shown in FIGS. 20A-20C, Zone 1' falls within the range of from between about 0 degrees to 53 degrees above nadir. The lower surface 326*b*' is configured so that all of the light reflected by it falls within Zone 1', that is between lines 343' and 325'. The exact configuration of the lower surface 326*b*' is designed to distribute the light across Zone 1' as desired to achieve the desired lighting. Since the light in Zone 1' is reflected light its intensity is not as great as the light emitted directly from the LED. The light in Zone 1' is used for lighting the area closest to the luminarie.

As shown in FIG. 20B, Zone 2' is composed primarily of light from the LED reflected off of the inner upper surface 318*c*' of the lower baffle 316*c*' and between lines 319' and 349'. In one street lighting design shown in FIGS. 20A-20C, Zone 2' falls within the range of from between about 45 degrees to 64 degrees above nadir. The inner upper surface 318*c*' is configured so that substantially all of the light reflected by it falls within Zone 2'. The exact configuration of the inner upper surface 318*c*'is designed to distribute the light across Zone 2' as desired to achieve the desired lighting. Since the light in Zone 2' is reflected light, its intensity is not as great as the light emitted directly from the emitter. The light in Zone 2' shown in FIG. 20B is used for lighting a section of the horizontal plane further from the luminarie that is substantially intermediate Zone 1' and Zone 3'.

As shown in FIG. 20C, Zone 3' is composed primarily of light coming directly from the LED emitter 107 with no reflection, and is not redirected by the baffles 316'. In one street lighting design shown in FIGS. 20A-20C, Zone 3' falls within the range of from between about 45 degrees to 73 degrees above nadir. The direct light in Zone 3' is cut off by the edge 321*c*' of the lower baffle 316*b*' and the end 324*b*' of the upper baffle member and radiates between lines 319' and 352'. Since the light in Zone 3' is direct and not reflected light, its intensity is greater than the reflected light in Zones 1' and 2'. The light in Zone 3' is used to illuminate the area furthest away from the lighting fixture. This greater intensity assists in the distance the light in Zone 3' is projected. The light in Zone 3 is used to light the horizontal plane furthest from the luminarie.

The lower surface 326' of the baffle is reflective and is configured to control the light emitted from the LED 107 as described herein. As seen in FIG. 20A-20C, the lower surface 326' is formed by a compound radius Ri1'. The compound radius Ri1' is determined by a series of points that reflect the light impinging on the lower surface 326' along a desired distribution pattern in Zone 1. The inner upper surface 318*b*' and 318*c*' of the baffles 316*b*' and 316*c*' are formed by the compound radius Ro1'. The compound radius Ro1' is determined by a series of points that reflect the light impinging on the inner upper surface 318*c*' along a desired distribution pattern.

The advantage of using the baffle assembly 300' is that the cutoff angle α is greater which allows light to be radiated in a greater direction then when a smaller cut off angle is used. As described above, this provides meeting various lighting configurations as described above.

In outdoor lighting commercial applications, when using emitters, it is desirable for a number of emitters to appear as a single source of light. Accordingly the distance between the emitters in a vertical direction should preferably be as small as possible while allowing for heat dissipation and sufficient space to mount baffles above and below the emitters. In a baffle assembly with at least 3 baffles, each of the baffles have an emitter aperture between adjacent baffles. At least one emitter is positioned in each emitter aperture a predetermined distance from the emitter mounted in an adjacent emitter aperture. Each of the baffles have a back surface 359' adjacent the upper and lower inner end of the baffles. The distance between the adjacent emitters divided by the length "L" of the baffle is in a range of from between about 1.7 to about 0.75. By maintaining this design ratio, the desirable features are achieved.

In order for the emitters to properly optically coact with baffles vertically spaced with respect to each other, the vertical spacing distance "y" of the emitters has a relationship with respect to the length "L" of the baffles. As seen in FIGS. 19B, 20A-20C, the adjacent emitters are spaced a distance "y" in a vertical direction. The length of the baffles is a horizontal distance "L" measured from a vertical line 350' passing through the back 359' of the baffle to the outer end 324' of the baffle measured along a line perpendicular to the line passing thru the back of the baffle. The upper inner end 320' and lower inner end 328' define the top and the bottom of the back surface 359'. When the baffles are assembled with the emitter board, the back surface 359' of the baffle is in contact with the outer surface 136' of the emitter board.

While the length "L" of the baffle and the vertical distance spacing of the emitters "y" may vary, in order to achieve an effective cut off angle α and the optical characteristics of the present invention, the relationship between the vertical distance spacing of the emitters "y" and the length of the baffle "L" must be maintained. It has been found that a ratio of "y"/"L" from between about 1.7 to 0.75 provides the advantageous optical features of the present invention.

Figure 21:
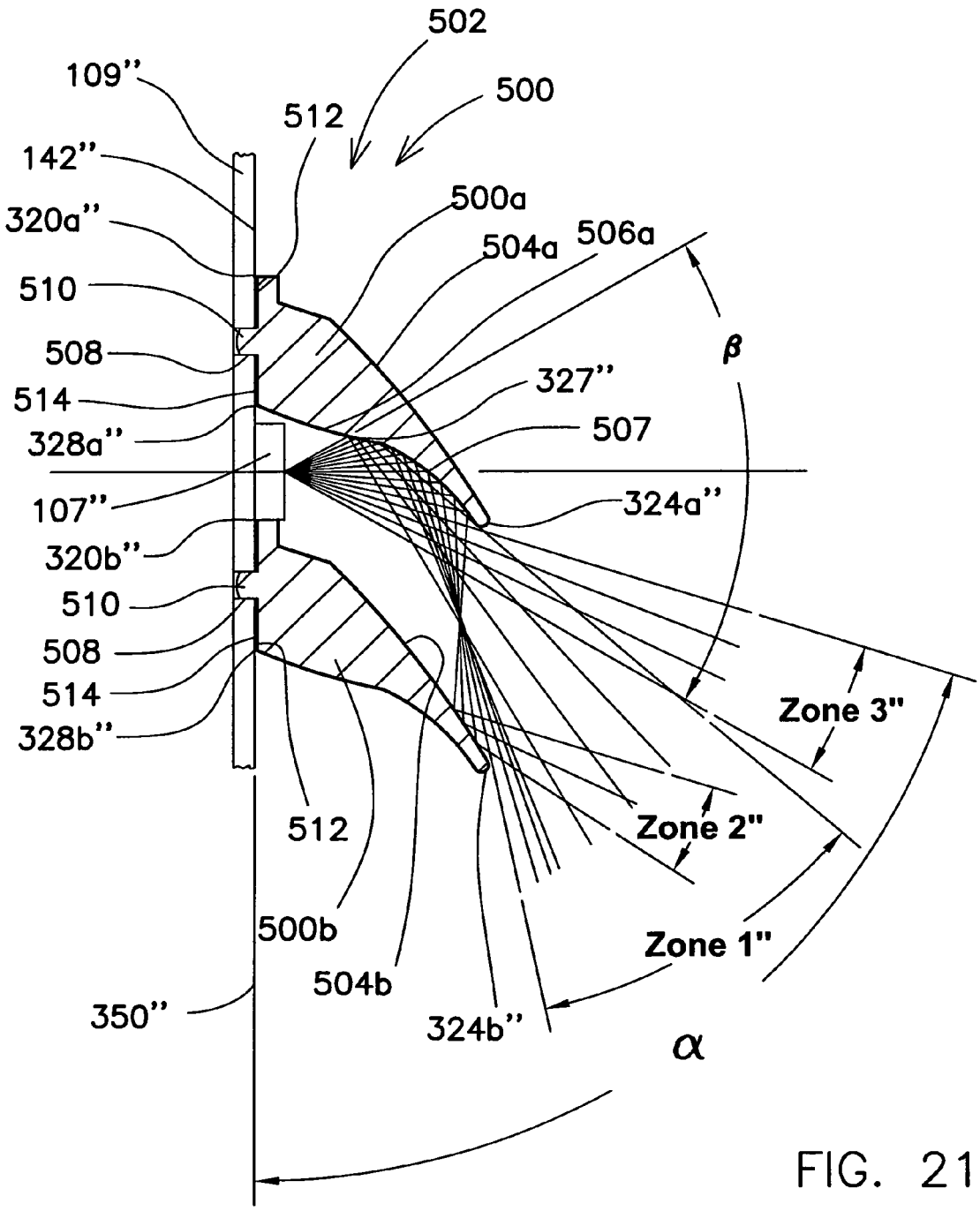
FIG. 21 is a sectional view of an alternative baffle design.

Is also within the contemplation of this invention to provide individual baffles 500 which provide a baffle assembly 502 mounted on the emitter board 109". As shown in FIG. 21, such an individual baffle 500 may be configured in the same manner as the baffles 316 and 316'. For ease of description, the baffle assembly 502 is numbered with the numerals the same as used in connection with the baffle assembly 300 and 300' to denote common similar parts where appropriate and followed by a double prime (") mark to denote the parts of baffle assembly 500'. For purposes of illustration only as to the versatility of the present invention, another configuration of a baffle of the present invention is described herein as an alternative embodiment which allows for reflection of the light impinging on the upper and lower baffle surfaces 504 and 506.

One such individual baffle design is shown in FIG. 21 for describing one method of aligning and mounting individual baffles 500 to the emitter board 109" and an alternative design for reflecting light by the baffles. In order to align and mount the baffles 500*a* and 500*b* on the emitter board, the emitter board 109" has an alignment aperture 508 therein for receiving an alignment pin 510 on the back surface 512 of the baffle 500. When the back surface 512 of the baffle is positioned adjacent the outer surface 142" of the emitter board, the alignment pin 510 is received by the alignment aperture 508 in the emitter board so that it is properly positioned, with respect to the emitter 107". Across the length of the baffles 500*a* and 500*b*, there is another alignment pin that is received in a complimentary aperture in the circuit board as described in connection with the aperture 508 and pin 510. An attachment device 514, such as adhesive, is provided between the back 512 of the baffle and the outer surface 142" of the emitter board to secure the baffle to the emitter board. Accordingly, the baffles 500*a* and 500*b* are positioned and secured with respect the emitter 107" as described above.

For purposes of illustrating an alternative design of the lower and upper surfaces 504, 506, respectively of a baffle 500, the baffles 500*a* and 500*b* are shown in FIG. 21 with the emitter 107" mounted there between in a manner similar as described above in connection with FIGS. 1-20C. The emitter shown in FIG. 21 emits light in substantially a bell shaped curve at the angle β as described above. The upper and lower surfaces 504, 506 of the baffles 500*a*, 500*b* are formed in compound curves to direct light from the emitter 107" into 3 Zones, namely Zone 1", Zone 2" and Zone 3". The cutoff angle α is determined as described above and is determined by the position of the outer end 324" (324*a*" and 324*b*"). The upper surface 504 (504*a* and 504*b*) extends from the lower inner end 328" (328*a*" and 328*b*") of the baffle to its outer end 324" (324*a*" and 324*b*"). The lower surface 506 extends from the from the upper inner end 320" (320*a*" and 320*b*") to the outer end 324" (324*a*" and 324*b*").

The lower surface 506*a* is configured to reflect a portion of the light from the emitter between points 327" and 507 in a downward direction between the outer ends 324*a*" and 324*b*" of the baffles in an area shown in Zone 1". Zone 1" is the area closest the luminarie as described above and the light rays are schematically shown in Zone 1". The balance of the light impinging on the lower surface 506*a*, impinging on the upper surface between point 507 and the end 324*a*" is reflected to impinge on the upper surface 504*b* of the baffle 500*b* and is then reflected thereby into an area described as Zone 2". Zone 2" is described by the light rays schematically shown in Zone 2. This design of reflecting the light rays in Zone 2" allows for a further throw of the light in that Zone a distance away from the fixture and allows for improved illumination at greater distances away from the fixture. The balance of the light from the emitter falls in Zone 3" and is not reflected by the baffles. Zone 1" defines an area closest to the lighting fixture. Zone 2" defines an area which is at least in part outwardly away from said Zone 1" and Zone 3" defines an area which is at least in part outwardly away from said Zone 2". As can be seen from the above, the surfaces of the baffle can be designed in a wide variety of configurations to achieve the desired lighting results.

In outdoor lighting commercial applications, when using emitters, it is desirable for a number of emitters to appear as a single source of light. Accordingly the distance between the emitters in a vertical direction should preferably be as small as possible while allowing for heat dissipation and sufficient space to mount baffles above and below the emitters. In a baffle assembly with at least 3 baffles, each of the baffles have an emitter aperture between adjacent baffles. At least one emitter is positioned in each emitter aperture a predetermined distance from the emitter mounted in an adjacent emitter aperture. Each of the baffles have a back surface 359' adjacent the upper and lower inner end of the baffles. The distance between the adjacent emitters divided by the length "L" of the baffle is in a range of from between about 1.7 to about 0.75. By maintaining this design ratio, the desirable features are achieved.

In order for the emitters to properly optically coact with baffles vertically spaced with respect to each other, the vertical spacing distance "y" of the emitters has a relationship with respect to the length "L" of the baffles. As seen in FIGS. 19B, 20A-20C, the adjacent emitters are spaced a distance "y" in a vertical direction. The length of the baffles is a horizontal distance "L" measured from a vertical line 350' passing through the back 359' of the baffle to the outer end 324' of the baffle measured along a line perpendicular to the line passing thru the back of the baffle. The upper inner end 320' and lower inner end 328' define the top and the bottom of the back surface 359'. When the baffles are assembled with the emitter board, the back surface 359' of the baffle is in contact with the outer surface 136' of the emitter board.

While the length "L" of the baffle and the vertical distance spacing of the emitters "y" may vary, in order to achieve an effective cut off angle α and the optical characteristics of the present invention, the relationship between the vertical distance spacing of the emitters "y" and the length of the baffle "L" must be maintained. It has been found that a ratio of "y"/"L" from between about 1.7 to 0.75 provides the advantageous optical features of the present invention.

It should be understood that a wide variety of emitters have different operating characteristics that can be used in the present invention and the emitter described herein is one of such emitters that may be used with the present invention.

The invention has been described with reference to the preferred and alternate embodiments. Modifications and alterations will occur to others upon reading and understanding the specification. All modifications and alterations in so far as they are within the scope of the appended claims or equivalents thereof are intended to be included.

Having described my invention, I claim:

1. An emitter lighting array assembly having a desired lighting distribution, comprising:

a plurality of emitter support members, each of said emitter support members having an outer surface, said outer surfaces of said emitter support members facing at least two different directions, each of said emitter support members having an emitter circuit thereon, at least one emitter mounted on each of said outer surface of each of said emitter support members and in operative association with said emitter circuit on said emitter support member, the desired lighting distribution having a desired lighting distribution configuration in each said emitter support member direction, the number of said emitters mounted on each of said outer surfaces of said emitter support members determined by the light specified in each direction to meet said desired lighting distribution configuration in each direction, the number of said emitters on said outer surface of one of said emitter support members are different from the number of said emitters on said outer surface of another of said emitter support members and said emitters on each of said emitter support members positioned together around a lighting center point of each of said emitter support member.

2. An emitter lighting array assembly, as described in claim 1, for use with a tower having a top and a bottom, and a plurality of outer faces extending between said top and said bottom of said tower, said emitter support members adapted to be mounted on said outer faces of said tower, and said emitter support members adapted to transfer heat from said emitters to said tower.

3. An emitter lighting array assembly, as described in claim 2, wherein said lighting center point is adapted to be located closer to said bottom of said tower than said top of said tower.

4. An emitter lighting array assembly, as described in claim 1, wherein said emitter support members have a heat transfer capacity, and in which said emitters are positioned on each said emitter support member to maximize the controllability of generated light and not exceed said heat transfer capacity.

5. An emitter lighting array assembly, as described in claim 1, in which vertically adjacent emitters on each emitter support member are positioned a first vertical distance between said vertically adjacent emitters on that emitter support member being from between about 0.6 inch to 1.0 inch.

6. An emitter lighting array assembly, as described in claim 1, in which horizontally adjacent emitters on each emitter support members are positioned a first horizontal distance between said horizontally adjacent emitters on that emitter support member being from between about 0.4 inch to 0.7 inch.

7. An emitter lighting array assembly, as described in claim 1, wherein said emitters in operative association with said emitter circuit on said emitter support members are electrically connected with said emitter circuit.

8. An emitter lighting array assembly, as described in claim 1, wherein said emitter support member is a board.

9. An emitter lighting array assembly, as described in claim 1, further including an emitter baffle having a lower reflective surface extending from a lower inner end and terminating at an outer end and an upper reflective surface extending from an upper inner end and terminating at said outer end, at least one of said upper inner end and said lower inner end positioned adjacent an emitter.

10. A method of configuring an emitter lighting array assembly for use with a lighting fixture including the steps of:

selecting a desired lighting distribution configuration to achieve a desired lighting distribution, selecting a plurality of emitter support members, each of the emitter support members having an outer surface, selecting the characteristics and number of emitters for mounting on the outer surface of each of the emitter support members to achieve the desired lighting distribution configuration, providing at least one emitter circuit on each of the emitter support members for powering the selected characteristic and number of the emitters for each emitter support member, mounting the emitters selected on each of the emitter support members in operational association with the emitter circuit on each emitter support member, and mounting the emitter support members on the lighting fixture with the outer surfaces of the emitter support members facing at least two different directions.

11. A method of configuring the emitter lighting array assembly for use with the lighting fixture, as described in claim 10, wherein said step of mounting the emitters selected on each of the emitter support members includes the step of positioning together the emitters selected on each of the emitter support members around a lighting center point of each of the emitter support members.

12. A method of configuring the emitter lighting array assembly for use with the lighting fixture, as described in claim 11, wherein the lighting fixture includes a tower, the tower has a top and a bottom, and a plurality of outer faces extending between the top and the bottom of the tower, and wherein the step of mounting the emitter support members on the lighting fixture further includes the steps of mounting the emitter support members on the outer faces of the tower, and transferring heat from the emitters to the tower.

13. A method of configuring the emitter lighting array assembly for use with the lighting fixture, as described in claim 12, wherein said step of mounting the emitters selected on each of the emitter support members around the lighting center point includes the step of positioning the lighting center point closer to the bottom of the tower than the top of the tower.

14. A method of configuring the emitter lighting array assembly for use with the lighting fixture, as described in claim 10, wherein the emitter support members have a heat transfer capacity, said step of mounting the emitters selected on each emitter support member further includes the step of positioning the emitters selected on each emitter support member to maximize the controllability of generated light and not exceed the heat transfer capacity.

15. A method of configuring the emitter lighting array assembly for use with the lighting fixture, as described in claim 10, wherein said step of mounting the emitters selected on each of the emitter support members further includes the steps of positioning adjacent emitters on each emitter support member with a first vertical distance there between and a first horizontal distance there between, the first vertical distance being from between about 0.6 inch to 1.0 inch, and the first horizontal distance being from between about 0.4 inch to 0.7 inch.

16. A method of configuring the emitter lighting array assembly for use with the lighting fixture, as described in claim 10, wherein said step of mounting the emitters selected on each of the emitter support members in operational association with the emitter circuit on each emitter support member includes the step of electrically connecting the emitters selected on each of the emitter support members with said emitter circuit.

17. A method of configuring the emitter lighting array assembly for use with the lighting fixture, as described in claim 16, further including the step of selecting a board as the emitter support member.

18. A method of configuring the emitter lighting array assembly for use with the lighting fixture, as described in claim 10, wherein the lighting fixture has an emitter baffle having a lower reflective surface terminating at an outer end and an upper reflective surface terminating at the outer end, and further including the step of positioning the emitter baffle such that the outer end of one of the lower reflective surface and the upper reflective surface is adjacent an emitter on the emitter support member.

* * * * *